US005114837A

United States Patent [19]

Ogawa

[11] Patent Number: 5,114,837

[45] Date of Patent: May 19, 1992

[54] SILVER HALIDE COLOR PHOTOGRAPHIC MATERIAL

[75] Inventor: Tadashi Ogawa, Ashigara, Japan

[73] Assignee: Fuji Photo Film Co., Ltd., Kanagawa, Japan

[21] Appl. No.: 433,138

[22] Filed: Nov. 8, 1989

[30] Foreign Application Priority Data

Nov. 9, 1988 [JP] Japan ..... 63-283121

[51] Int. Cl.[5] ..... G03C 1/46

[52] U.S. Cl. ..... 430/504; 430/505; 430/506

[58] Field of Search ..... 430/504, 505, 506

[56] References Cited

U.S. PATENT DOCUMENTS

| | | | |
|---|---|---|---|
| 3,252,795 | 5/1966 | Deramaix et al. | 430/377 |
| 4,770,980 | 9/1988 | Matejec et al. | 430/506 |
| 4,806,460 | 2/1989 | Ogawa et al. | 430/504 |
| 4,865,962 | 9/1989 | Hasebe et al. | 430/567 |
| 4,902,609 | 2/1990 | Hahm | 430/505 |

FOREIGN PATENT DOCUMENTS

| | | |
|---|---|---|
| 0244184 | 11/1987 | European Pat. Off. . |
| 0273430 | 7/1988 | European Pat. Off. . |
| 0304297 | 2/1989 | European Pat. Off. . |
| 661211 | 11/1951 | United Kingdom . |

*Primary Examiner*—Charles L. Bowers, Jr.
*Assistant Examiner*—Thomas R. Neville
*Attorney, Agent, or Firm*—Burns, Doane, Swecker & Mathis

[57] ABSTRACT

A silver halide color photographic material is disclosed comprising a support having thereon at least one blue-sensitive silver halide emulsion layer containing a yellow coupler, at least one green-sensitive silver halide emulsion layer containing a magenta coupler and at least one sensitive silver halide emulsion layer containing a cyan coupler, wherein the sensitive silver halide emulsion layer containinig a cyan coupler comprises a silver chlorobromide or silver chlorobromoiodide emulsion having a silver chloride content of at least 80 mol % and a silver iodide content of no greater than 1 mol % and said sensitive silver halide emulsion is spectrally sensitized with a red-sensitive sensitizing dye and at least one or both of a blue-sensitive sensitizing dye and a green-sensitive sensitizing dye.

29 Claims, 2 Drawing Sheets

SILVER HALIDE COLOR PHOTOGRAPHIC MATERIAL

FIELD OF THE INVENTION

This invention relates to a silver halide photographic material, and more particularly to a silver halide color photographic material which having excellent rapid processability, good color reproducibility and good tone reproducibility.

BACKGROUND OF THE INVENTION

A silver halide photographic material which can be rapidly processed and has excellent color-reproducibility has been highly demanded and tone-reproducibility in recent years.

With regard to rapid processability, silver halide photographic materials are continuously processed by automatic processors employed in modern processing laboratories. Processed prints are delivered to users in the course of the day on which they are received, as an improved in service to users. Furthermore, finished prints are demanded several hours after being submitted for processing. The need for rapid processing is increasing.

A reduction in processing time produces an improves production efficiency and reduces production costs. Accordingly, the development of rapid processing techniques is urgently in demand.

Rapid processing has been approached with regard to both photographic materials and processing solutions. In order to accelerate color development, it has been proposed to elevate the temperature of the processing solutions, to increase the pH of the processing solutions and to add highly concentrated color developing agents. Furthermore, additives such as developing accelerators have been employed.

1-Phenyl-3-pyrazolidone described in U.K. Patent 811,185, N-methyl-p-aminophenol described in U.S. Pat. No. 2,417,514 and N,N,N',N'-tetramethyl-p-phenylenediamine described in JP-A-50-15554 (the term "JP-A" as used herein means an "unexamined published Japanese patent application") are known developing accelerators.

However, satisfactory rapid processing cannot be achieved by these methods and photographic characteristics are often deteriorated. For example, the fog level is often increased.

The development rate is greatly affected by the shape, size and composition of the silver halide grains comprising the silver halide emulsion of the photographic material. Particularly, the development rate is greatly influenced by the halogen composition. A remarkably high development rate is obtained when silver halide emulsions having a high silver chloride content are used.

In silver halide color photographic materials, dye image is typically formed by reducing the exposed silver halide grains with an aromatic primary amine color developing agent, and than reacting the oxidation product of the developing agent with couplers previously incorporated in the color photographic material. Generally, three kinds of couplers forming dyes of yellow, magenta and cyan are used to effect color reproduction by subtractive color photography.

Various factors must be satisfied to effect better color reproduction. Namely, the level of color reproduction varies depending on the spectral sensitivity interlaminar effect of the photographic material for photographing, the matching of spectral sensitivity of the color print material with the dye images formed in the photographic material for photographing, the overlap in spectral sensitivity of sensitive layers having different color sensitivity, the spectral absorption characteristics of formed dyes, and color mixing between sensitive layers forming different dyes in processing.

Tone reproduction is also an important factor for improving image quality. Furthermore, gray gradation as well as color gradation is an important factor.

Improvements in the quality of color photographs in recent years are mostly attributable to improvements in the multi-layer effects of photographic materials for photographing, and these improvements contribute much to an improvement in color reproducibility. Such photographic materials, however, may not have sufficient color gradation.

New systems have been developed and are being used wherein photographic materials having a high silver chloride content as described above are used in combination with processing solutions free from sulfites or benzyl alcohol once contained in conventional color developing solutions for color paper.

Photographs obtained from high silver chloride color paper adapted for rapid processing are advantageous in that high silver chloride content silver halides or silver chloride does not substantially absorb light in the visible region, and the sensitivity inherent in silver chloride does not damage the discrimination function with regard to red light sensitivity, green light sensitivity and blue light sensitivity, such that , color mixing does not result. On the other hand, silver chloride emulsions are disadvantageous in that color gradation in high density area in particular is deteriorated as compared with the use of a conventional silver chlorobromide emulsion. Good color gradation without detriment to rapid processability or the other advantages of silver chloride or highsilver chloride content emulsions is highly desired.

This problem is liable to be caused when color gradation of the original having red color is to be reproduced, and is evident in color paper containing silver chloride.

Pyrazoloazole magenta dye-forming couplers hereinafter, "magenta couplers", have been widely used in addition to 5-pyrazolone couplers for conventional color papers in recent years. Couplers of this type, especially the 5-pyrazolone couplers, form dyes having good spectral absorption characteristics, good fastness to light, exhibit little stain due to the couplers alone, and are practically advantageous. These couplers are described in U.S. Pat. Nos. 3,369,879 and 3,725,067, *Research Disclosure* 24220 (June 1984), ibid., 24230 (June 1984), U.S. Pat. Nos. 4,500,630 and 4,540,654, JP-A-61-65245, JP-A-61-65246, JP-A-61-147254 and European Patent 0,226,849. Among these pyrazoloazole magenta couplers, pyrazolo[5,1-c][1,2,4]triazoles and pyrazolo[1,5-b][1,2,4]triazoles are preferred from the viewpoint of overall performance in color formation, spectral absorption characteristics of the formed dyes and image fastness. Particularly, the pyrazolo[1,5-b][1,2,4]triazoles described in U.S. Pat. No. 4,540,654 are preferred. Couplers of this type having branched alkyl groups as described in JP-A-61-65245, sulfonamido groups as described in JP-A-61-65246, alkoxysulfonamido groups as described in JP-A-61-147254 and alkoxy or aryloxy groups introduced at the 6-position of as described in European Patent 0,226,849 are particularly preferred.

However, it has been found that when these couplers are used for the green light-sensitive silver halide emulsion layers, the above-described unsatisfactory color gradation is more noticeable, even though use of the capless is advantageous in other respects.

Accordingly, when the pyrazoloazole magenta couplers are used in color paper containing a silver halide emulsion having a high silver chloride content, unsatisfactory color gradation is liable to occur and became pronounced.

Color gradation may be improved as described, for example, in JP-B-58-10737 (the term "JP-B" as used herein means an "examined Japanese patent application") wherein a sensitive layer which forms a black dye image is provided. However, the material cost is increased, because an extra sensitive layer must be provided. In addition, the method is disadvantageous in that the processing time is increased due to an increase in the thickness of the coated layer of the photographic paper. JP-B-58-10737 is silent regarding rapid processing or the improvement of chroma. JP-A-61-91657 (U.S. Pat. No. 4,806,460) discloses a method for improving the tone reproducibility of a colored image by adding a dye image having a different hue exceeding a specific density of a color image. However, this method does not teach compatibility with rapid processing using high content silver chloride emulsions. Furthermore, this method does not suggest means for improving the expression of color gradation while improving color reproducibility, by raising chroma with pyrazoloazole magenta couplers.

SUMMARY OF THE INVENTION

An object of the present invention is to provide a silver halide color photographic material having color tone reproducibility and rapid processability properties which are compatible with each other.

A second object of the present invention is to provide a silver halide color photographic material having excellent color reproducibility as well as color tone reproducibility, even when subjected to rapid processing.

The above-described objects of the present invention have been achieved by providing:

(1) A silver halide color photographic material comprising a spport having thereon at least one blue-sensitive silver halide emulsion layer containing a yellow coupler, at least one green-sensitive silver halide emulsion layer containing a magenta coupler and at least one sensitive layer containing a cyan coupler, wherein the sensitive silver halide emulsion layer containing a cyan coupler comprises a silver chlorobromide or silver chlorobromoiodide emulsion having a silver chloride content of at least 80 mol % and a silver iodide content of not greater than 1 mol % and said sensitive silver halide emulsion is spectrally sensitized with a red-sensitive sensitizing dye and at least one or both of a blue-sensitive sensitizing dye and a green-sensitive sensitizing dye;

(2) A silver halide color photographic material as in 1 above, wherein each of the silver halide emulsions present in the blue-sensitive silver halide emulsion layer containing a yellow coupler, the green-sensitive silver halide emulsion layer containing a magenta coupler and the sensitive silver halide emulsion layer containing a cyan coupler comprises a silver chlorobromide emulsion having a silver chloride content at least 80 mol % and a silver bromide content of not greater than 20 mol %;

(3) A silver halide color photographic material as in 1 above, wherein each of silver halide emulsions constituting in the blue-sensitive silver halide emulsion layer containing a yellow coupler, the green-sensitive silver halide emulsion layer containing a magenta coupler and the sensitive silver halide emulsion layer containing cyan coupler comprises a silver chlorobromide emulsion having a silver chloride content of at least 95 mol % and a silver bromide content of not greater than 5 mol %;

(4) A silver halide color photographic material as in 1, 2 or 3 above, wherein the at least one or both of the blue light sensitivity and green light sensitivity of the sensitive silver halide emulsion layer containing cyan coupler is from 1/12 to ⅓ that of each of the blue light sensitivity of the blue-sensitive silver halide emulsion layer containing a yellow coupler and the green light sensitivity of the green-sensitive silver halide emulsion layer containing a magenta coupler, respectively (5) A silver halide color photographic material as in 1, 2, 3 or 4 above, wherein the magenta coupler is a pyrazoloazole coupler.

DETAILED DESCRIPTION OF THE INVENTION

Figure 1:
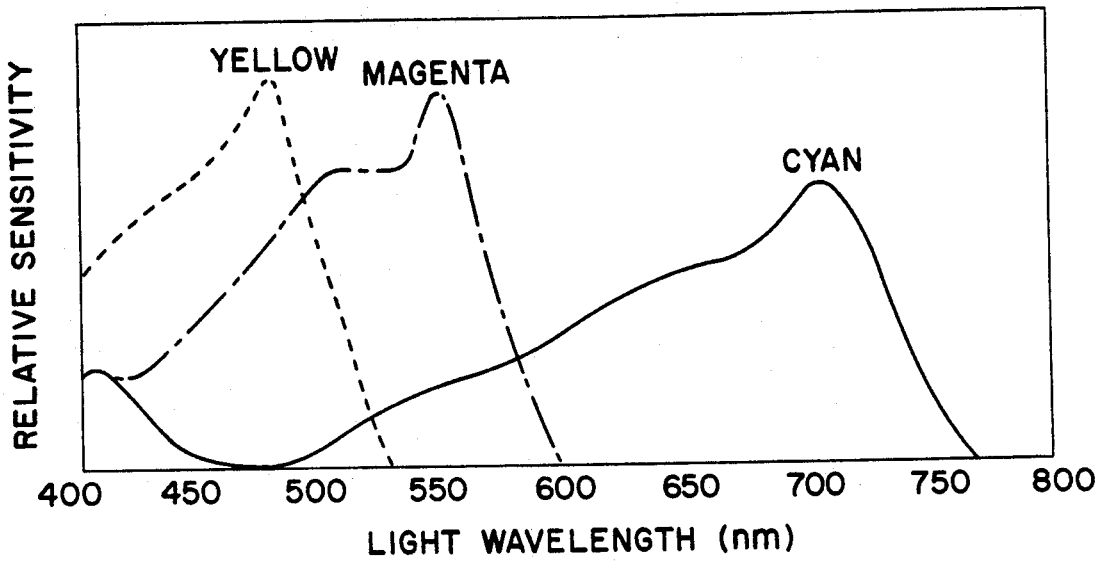
FIGS. 1 to 4 are graphs showing the spectral sensitivity distribution of Samples 1, 4, 5 and 9 of Example 1.

The present invention is illustrated in is detail below.

The sensitive silver halide emulsion layer of the present invention containing a cyan coupler comprises a silver halide emulsion having a silver halide composition consisting of at least 80 mol % of silver chloride. The silver halide emulsion preferably comprises silver chlorobromide containing substantially no silver iodide. When the silver bromide content is high or when silver iodide is present, the problem of color gradation is less severe. However, when the silver bromide content is higher than 20 mol %, and when photographic materials containing the silver halide emulsion having a high silver bromide content are continuously processed, the equilibrium concentration of bromid ion accumulated in the developing solution increases. As a result, the development rate is retarded and rapid processing no longer continues. The silver iodide content is preferably not higher than 1 mol % to likewise prevent adverse effects due to the accumulation of iodide in the processing solutions. It is most preferred that the silver haldie does not contain any silver iodide. The silver chloride content is at least 80 mol %, preferably at least 95 mol %, more preferably at least 98 mol %, most preferably at least 99 mol %. Notwithstanding a fact that a silver chloride is preferably used at higher rate, if the silver chloride is present over 100 mol %, the emulsion is not preferably functioned in terms of absorption property for sensitizing dyes.

When the silver halide is present in an amount of over 100 mol %, that is, other silver halides such as silverbromides, etc., are not present, a balance of amounts or state absorbed silver halides, between a red-sensitive sensitizing dye and a blue-sensitive sensitizing dye and/or green-sensitive sensitizing dye, become unstable during preparing the photosensitive material or are liable to be changed under storing condition, since the silver halide emulsion layer containing cyan coupler according to the present invention contains simultaneously with blue-sensitive sensitizing dye and/or green-sensitive sensitizing dye other than red-sensitive sensitizing dye.

These phonomena are understood that a certain amount of silver bromide is advantageously absorbs and fixes to the sensitive dyes individually since absorption of the sensitizing dyes is weak with respect to the silver chloride, whereas is rather strong to the silver bromide.

The difference in the absorption above is considered to cause permissible sensitivity variation for a well known photosensitive material which is spectrally sensitized by blue-sensitive sensitizing dye or green-sensitive sensitizing dye, however, in the present invention said changes results in a reproduction of a color gradation.

Thus, according to the present invention the silver halide emulsion should contain a small amount of silver bromide or silver iodide, and contain no silver chloride independently. It is more preferable to contain a small amount of silver bromide over surface of silver halide particles.

Thus, a content of the silver chloride to be incorporated in the silver halide emulsion is preferably 99.9 mol % or less.

The silver halide grains of the high silver chloride emulsion content of the present invention preferably have a silver bromide-localized phase containing a relatively high silver bromide content. The silver bromide-localized phase may be present in the interior of the silver halide grain, on the surface thereof, near the surface thereof, or both in the interior of the grain and on the surface thereof. The silver bromide-localized phase may be present in the shell of a core-shell type structure, where the interior or surface of the grain is surrounded by the localized phase to enclose the whole grain in the localized phase. Alternatively, the silver halide-localized phase may be a localized structure where part of the shell structure is missing, or where a plurality of discontinuously isolated areas exist. In a preferred embodiment, the localized phase is present on the surface of silver halide grain or in the interior and near the surface thereof. It is particularly preferred that the localized phase exist on the edge or corner of the crystal surface of grain or on the crystal plane thereof. The localized phase of the emulsion of the present invention has a silver bromide content of from 10 mol % to 95 mol %, preferably from 15 to 90 mol %, more preferably from 20 to 60 mol %, and most preferably from 30 to 60 mol %.

The remaining halide in the localized phase comprises silver chloride. It is preferred that the localized phase contain a very small amount of silver iodide. However, the amount of silver iodide preferably does not exceed 1 mol % of the total silver halide content of the emulsion.

The localized phase preferably constitutes from 0.03 to 35 mol %, and more preferably from 0.1 to 25 mol % of the silver halide content of the entire silver halide grains of the emulsion.

The localized phase need not be composed of a single halide composition and may be composed of two or more localized phases having a clearly different silver bromide content. The interface between the localized phase and other phases may be a boundary where the halide composition is gradually changed.

The silver bromide-localized phase can be formed by reacting an emulsion containing previously formed silver chloride or high content silver chloride grains with a water-soluble silver salt and a water-soluble halide salt containing a water-soluble bromide using the double jet process to precipitate the required grains. Alternetively, a conversion method may be used wherein parts of the previously formed silver chloride content or high silver chloride grains are converted to a silver bromide-rich phase. Also, the localized phase can be formed by adding fine silver bromide or high silver bromide content grains having a smaller grain size than that of the silver chloride or high silver chloride content grains to silver chloride or high silver chloride grains to recrystallize the silver bromide on the surfaces of the silver chloride or high silver chloride content grains.

These methods are described, for example, in European Patent Laid-Open No. 0,273,430A2.

The silver bromide content of the localized phase can be analyzed by X-ray diffractometry as described, for example, in *New Experimental Chemical Lecture* 6, *Structure Analysis,* edited by the Japanese Chemical Society, and published by Maruzen or the XPS method as described, for example, in *Surface Analysis, IMA, Application of O.J. Electron, Photoelectron Spectroscopy.* The silver bromide-localized phase can be detected by electron microscopy, or the method described in the above noted European Patent Laid Open No. 0,273,430A2.

To further enhance color gradation, metal ions (e.g., Group VIII metal ions, Group II transition metal ions, lead ion of Group IV, gold or copper ion of the Group I metals) or a complex ion thereof other than silver ion may be incorporated into the silver halide grains. The metal ion or complex ion may be incorporated unformly into the silver halide grain, the silver bromide-localized phase, or other phases thereof.

Useful metal ions and complex ions include iridium ion, palladium ion, rhodium ion, zinc ion, iron ion, platinum ion, gold ion and copper ion. When these metal ions or complex ions are used in combination, good photographic characteristics can be often obtained. It is preferred that the localized phase be different from other areas of the grain with respect to the amount and species of metal added thereto. It is particularly preferred that iridium ion or rhodium ion be incorporated into the localized phase.

The above described metal ion or complex ion can be incorporated into the localized phase and/or other areas of the silver halide grain by directly adding the metal ions or complex ions to a reaction vessel before or during the formation of silver halide grains, or during physical ripening after the formation of silver halide grains, or by previously adding the metal ions or complex ions to a solution containing a water-soluble halide salt or a water-soluble silver salt. When the localized phase is to be formed from fine grains of silver bromide or high silver bromide content, the metal ions or complex ions are incorporated into the fine grains of silver bromide or high silver bromide content, preferably in an amount of $10^{-8}$ to $10^{-4}$ mol/mol Ag in the same manner as that described above and the resulting silver bromide or high silver bromide content grains may be added to a silver chloride or high silver chloride content emulsion. Alternatively, the metal ion may be incorporated into the localized phase by adding a slightly soluble bromide of the metal ion in the form of a solid or a powder as such, while the localized phaseis being formed.

High silver chloride content emulsions are preferably used for the blue-sensitive silver halide emulsion layer containing a yellow coupler, and the green-sensitive silver halide emulsion layer containing a magenta coupler, and the sensitive silver halide emulsion layer containing a cyan coupler, to enhance rapid processability.

The silver halide grains of the present invention may have a regular crystal form such as cube, octahedron, tetradecahedron or rhombic dodecahedron, irregular crystal form such as sphere or tube (plate form), or a composite form of these crystal forms. The grains may be those having crystal planes of a higher order. A mixture of grains having various crystal forms can be used. In the silver halide emulsion of the present invention, at least 50% (in terms of by weight or the number of grains), preferably at least 70%, and more preferably at least 90% of the silver halide grains have a regular crystal form. Emulsions containing crystalline grains having the (100) crystal plane are particularly preferred.

An emulsion of the present invention containing tubular (plate-form) grains having an average aspect ratio (the ratio of the length of the principal plane of grain in terms of a diameter of a circle to the thickness of the grain) of not less than 5, and preferably not less than 8, and accounting for at least 50% of the entire projected area of the grains, is favorable for rapid processing, and further improves color gradation.

There are no particular limitations with regard to the size of the silver halide grains of the present invention, as long as rapid processability is not deteriorated. Preferably, the grains have a mean grain diameter (when the projected area of grain is converted to a circle) of 0.1 to 1.7 μm. The grain size distribution thereof may be narrow or wide, but monodisperse emulsions are preferable for enhancing photographic characteristics such as latent image stability and pressure resistance, and processing stability such as the dependence of processing solution on pH. The value s/d (i.e., the correlation coefficient) [obtained by dividing standard deviation s of diameter distribution (when the projected area of grain is converted to a circle) by mean diameter d] is preferably not more than 20%, and more preferably not more than 15%.

The silver chlorobromide emulsions of the present invention can be synthesized according to the methods described in P. Glafkide, *Photographic Chemistry Physics* (*Paul Montel*, 1967), *G. F. Duffin, Chemistry of Photographic Emulsion* (Focal Press, 1966) and V. L. Zelickman, et al., *Preparation of Photographic Emulsion and Coating* (Focal Press, 1964). Namely, the silver halide emulsion of the present invention can be prepared by any of an acid process, neutral process or ammonia process. However, the acid process and neutral process are preferred in the present invention from the viewpoint of reducing fog. A soluble silver salt and a soluble halide salt may be reacted using a single jet process, double jet process or a combination thereof. A reverse mixing method in which grains are formed in the presence of excess silver ion can also be used. The double jet process is preferably used to obtain emulsions comprising monodisperse grains, which are preferred for use in the present invention. The controlled double jet process may also be used, wherein the concentration of silver ion in the liquid phase in which the silver halide is formed, is kept constant. According to this process, a silver halide emulsion is obtained having a regular crystal form and narrow grain size distribution, which is preferred for use in the present invention.

Cadmium salt, zinc salt, lead salt, thallium salt, iridium salt or its complex salt, rhodium salt or its complex salt, or iron salt or its complex salt may be present during the formation of the silver halide grains or physical ripening.

During or after the formation of the grains, silver halide solvents may be used (e.g., conventional solvents such as ammonia, thiocyanates and thioethers or the thione compounds described in U.S. Pat. No. 3,271,157, JP-A-51-12360, JP-A-53-82408, JP-A-53-144319, JP-A-54-100717 and JP-A-54-155828). When the solvents are used in combination with the above-described method, a silver halide emulsion is obtained having a regular crystal form and narrow grain size distribution, which is preferred for use in the present invention.

After physical ripening, the soluble salts can be removed from the emulsion by noodle washing, flocculation precipitation, or ultrafiltration.

The emulsions of the present invention can be chemically sensitized by sulfur sensitization, selenium sensitization, reduction sensitization or noble metal sensitization. These sensitization methods may be used either alone or in combination. Namely, sulfur sensitization using sulfur compounds (e.g., thiosulfates, thiourea compounds, mercapto compounds, rhodanine compounds, etc.) capable of reacting with active gelatin or silver ion, reduction sensitization using reducing substances (e.g., stannous salts, amines, hydrazine derivatives, formamidinesulfinic acid, silane compounds, etc.) and noble metal sensitization using metallic compounds (e.g., salts of Group VIII metals of the periodic Table such as platinum, iridium palladium, rhodium and iron and complex salts thereof, gold complex salt, etc.) can be used either alone or in combination. In the present invention, sulfur sensitization or selenium sensitization is preferred, and a combination thereof with gold sensitization is also preferred. For controlling sensitivity and gradation, chemical sensitization is preferably carried out in the presence of a hydroxyazaindene compound or nucleic acid.

In the present invention, sensitizing dyes are used in the following manner. The term "red-sensitive sensitizing dye" as used herein means a sensitizing dye having a peak wavelength of spectral sensitivity at about 590 to 720 nm when adsorbed by a silver chloride emulsion. The term "blue-sensitive sensitizing dye" as used herein means a sensitizing dye having a peak wavelength of spectral sensitivity at about 390 to 510 nm when adsorbed by a silver chloride emulsion. The term "green-sensitive sensitizing dye" as used herein refers to a sensitizing dye having a peak wavelength of spectral sensitivity at about 510 to 590 nm when adsorbed by a silver chloride emulsion. Generally, the blue-sensitive silver halide emulsion layer containing a yellow coupler is sensitized with a blue-sensitive sensitizing dye, the green-sensitive silver halide emulsion layer containing a magenta coupler is sensitized with a green-sensitive sensitizing dye, and the red-sensitive silver halide emulsion layer containing a cyan coupler is sensitized with a red-sensitive sensitizing dye. In the present invention, however, the red-sensitive silver halide emulsion layer containing a cyan coupler is sensitized with a red-sensitizing dye and is further sensitized with at least one or both of either a blue-sensitive sensitizing dye and a green-sensitive sensitizing dye. The emulsion of the red-sensitive silver halide emulsion layer of the present invention containing a cyan coupler comprises a silver halide emulsion having a silver chloride content of at least 80 mol %, as described above. The effect of the present invention on color gradation is obtained under the above conditions. In order to enhance the rapid processing, the emulsion of the blue-sensitive silver halide emulsion containing a yellow coupler preferably comprises a silver halide emulsion having a silver chloride content of at least than 80 mol %. The emulsion of the green-sensitive silver halide emulsion layer containing a magenta coupler preferably comprises a silver halide emulsion having a silver chloride content of at least 80 mol %. It is more preferred that the emulsion of each of these layers comprises a silver halide emulsion having a silver chloride content of at least 95 mol %. It is most preferred that the emulsion of each of these layers comprises a silver halide emulsion having a silver chloride content of at least 98 mol %.

The at least one or both of the blue light sensitivity and green light sensitivity of the red-sensitive silver halide emulsion layer containing a cyan coupler has a sensitivity as printed from a color negative film of preferably from 1/16 to ½ that of the blue light sensitivity of the blue-sensitive silver halide emulsion layer containing a yellow coupler or the green light sensitivity of the green-sensitive silver halide emulsion layer containing a magenta coupler, respectively. Generally, when the sensitivity is ½ or above, color mixing which deteriorates color chroma in the relatively low-density areas does not effect color gradation, whereas when the sensitivity is 1/16 or below, the effect of the present invention is barely noticeable. More preferably, the sensitivity is from 1/12 to ⅓ that of the green light sensitivity of the green-sensitive silver halide emulsion layer containing a magenta coupler or the blue light sensitivity of the blue-sensitive silver halide emulsion layer containing a yellow coupler. The spectral sensitivity is measured with a conventional testing apparatus, for example, Equivalent Energy Spectral Sensitivity Testing Apparatus made by Fuji Photo Film Co., Ltd.

The effect of the present invention is remarkable, particularly when pyrazoloazole couplers are used as the magenta couplers. Namely, when such couplers are used in the present invention, the high color chroma due to the excellent spectral absorption characteristics of the dyes formed from pyrazoloazole couplers is highly compatible with color gradation which otherwise is liable to be deteriorated by the pyrazoloazole couplers. Thus, a color photographic materials excellent in rapid-processability as well as dye image fastness is obtained.

Examples of spectral sensitizing dyes for use in the present invention include cyanine dyes, merocyanine dyes, complex merocyanine dyes, complex cyanine dyes, holopolar cyanine dyes, hemicyanine dyes, styryl dyes and hemioxonol dyes. Preferred examples of cyanine dyes include simple cyanine dyes, carbocyanine dyes and dicarbocyanine dyes. These cyanine dyes are represented by the following formula (I).

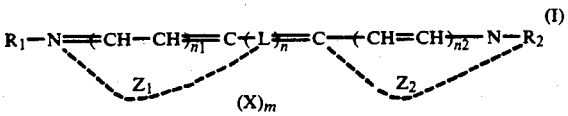

(I)

In the formula (I), L represents a methine group or a substituted methine group; $R_1$ and $R_2$ each represent an alkyl group or a substituted alkyl group; $Z_1$ and $Z_2$ each represent an atomic group which forms a nitrogen-containing 5-membered or 6-membered heterocyclic nucleus; X represents an anion; n represents 1,3 or 5; $n_1$ and $n_2$ each represent 0 or 1, with the proviso that when n=5, $n_1$ and $n_2$ are each 0 and when n=3, one of $n_1$ and $n_2$ is 0; m represents 0 or 1 with the proviso that when an inner salt is formed, m is 0; and when n is 5. the L groups may be combined together to form a substituted or unsubstituted 5-membered or 6-membered ring.

The cyanine dyes represented by the formula (I) are illustrated in detail below.

Examples of substituent groups for the substituted methine group represented by L include a lower alkyl group (e.g., methyl, ethyl) and an aralkyl group (e.g., benzyl, phenethyl).

The alkyl group represented by $R_1$ and $R_2$ may be a straight-chain, branched or cyclic alkyl group. Although there is no specific limitation with regard to the number of carbon atoms, the alkyl group preferably has from 1 to 8 carbon atoms. Examples of substituent groups for the substituted alkyl group include a sulfo group, carboxyl group, hydroxyl group, an alkoxy group, an acyloxy group and an aryl group (e.g., phenyl, a substituted phenyl group). One or more of these substituent groups may be attached to the alkyl group. The sulfo group or carboxyl group may be in the form of a salt such as an alkali metal salt or a quaternary ammonium salt. The description "one or more of these substituent groups" as used herein includes the case where two or more substituent groups are independently attached to the alkyl group and the case where two or more substituent groups are joined to each other and attached to the alkyl group. Examples of the latter case include a sulfoalkoxyalkyl group, a sulfoalkoxyalkoxyalkyl group, a carboxyalkoxyalkyl group and a sulfophenylalkyl group.

Examples of $R_1$ and $R_2$ include a methyl group, ethyl group, n-propyl group, n-butyl group, n-pentyl group, 2-hydroxyethyl group, 4-hydroxybutyl group, 2-acetoxyethyl group, 3-acetoxypropyl group, 2-methoxyethyl group, 4-methoxybutyl group, 2-carboxyethyl group, 3-carboxypropyl group, 2-(2-carboxyethoxy)ethyl group, 2-sulfoethyl group, 3-sulfopropyl group, 3-sulfobutyl group, 4-sulfobutyl group, 2-hydroxy-3-sulfopropyl group, 2 (3-sulfopropoxy)ethyl group, 2-acetoxy-3-sulfopropyl group, 3-methoxy 2-(3-sulfopropoxy)propyl group, 2-[2 (3-sulfopropoxy)ethoxy]ethyl group and 2-hydroxy-3-(3'-sulfopropoxy)propyl group.

Examples of the nitrogen-contining heterocyclic nuclei formed by $Z_1$ and $Z_2$ include an oxazole nucleus, thiazole nucleus, selenazole nucleus, imidazole nucleus, pyridine nucleus, oxazoline nucleus, thiazoline nucleus, selenazoline nucleus, imidazoline nucleus and nuclei formed by condensing these nuclei with a benzene ring, naphthalene ring or other saturated or unsaturated carbon rings. These heterocyclic rings may optionally have one or more substituent groups (e.g., an alkyl group, trifluoromethyl group, alkoxycarbonyl group, cyano group, carboxyl group, carbamoyl group, an alkoxy group, aryl group, acyl group, hydroxyl group, halogen, etc.).

Examples of anions represented by X include $Cl^-$, $Br^-$, $I^-$, $SO_4^-$, $NO_3^-$ and $ClO^-_4$.

A 5-membered or 6-membered nucleus such as pyrazoline-5-one nucleus, thiohydantoin nucleus, 2-thiooxazolidine-2,4-dione nucleus, thiazolidine-2,4-dione nucleus, rhodanine nucleus or thiobarbituric acid nucleus as a nucleus having a ketomethylene structure can be introduced into the merocyanine dye or the complex merocyanine dyes.

In addition to the above-described spectral sensitizing dyes, other spectral sensitizing dyes may be used which have a nucleus formed by fusing a pyrroline nucleus, oxazoline nucleus, thiazoline nucleus, pyrrole nucleus, thiazole nucleus, oxazole nucleus, selenazole nucleus, imidazole nucleus, tetrazole nucleus or pyridine nucleus with an alicyclic hydrocarbon ring or an aromatic hydrocarbon ring.

Examples of useful spectral sensitizing dyes are described in West German Patent 929,080, U.S. Pat. Nos. 2,231,658, 2,493,748, 2,503,774, 2,519,001, 2,912,329, 3,656,959, 3,672,897, 3,694,217, 4,025,349 and 4,046,572, U.K. Patent 1,242,588, JP-B-44-14030 and JP-B-52-24844.

Among these dyes, preferred dyes include those having a benzthiazole nucleus, and the dyes having a benzoxazole nucleus. Simple cyanine dyes having a benzthiazole nucleus, carbocyanine dyes having a benzoxazole nucleus and dicarbocyanine dyes having a benzthiazole nucleus are particularly preferred.

Generally, the silver halide emulsion is spectral-sensitized by allowing spectral sensitizing dyes to be adsorbed on the surfaces of grains after grains are completely formed. On the other hand, U.S. Pat. No. 2,735,766 discloses a method wherein a merocyanine dye is added during the precipitation and formation of silver halide grains to thereby reduce the amount of dye which is not adsorbed. JP-A-55-26589 discloses a method wherein spectral sensitizing dyes are added during the course of the addition of an aqueous solution of a silver salt and an aqueous solution of a halide salt which form crystalline silver halide grains, to thereby allow the dye to be adsorbed by the grains. Accordingly, in the present invention, the spectral sensitizing dyes may be added during the course of the formation of the grains, after the formation of the grains or before the initiation of the formation of grains. The expression "before the initiation of the formation of grains" means that the spectral sensitizing dyes are introduced into a reaction vessel before a reaction is initiated to form silver halide grains. The expression "during the course of the formation of grains" means a method described in the above-identified patent publication. The expression "after the formation of the grains" means that the spectral sensitizing dyes are added and adsorbed by the grains after the stage for the formation of the grains is substantially completed. The silver halide emulsions of the present invention are subjected to chemical sensitization after the formation of grains has been completed. After the formation of the grains, the spectral sensitizing dyes may be added before, during or after chemical sensitization. Alternatively, the spectral sensitizing dyes may be added when the emulsions are coated. In the present invention, it is preferred that the spectral sensitizing dyes be added and adsorbed by the grains after the formation of the silver halide grains is substantially completed. The addition of the spectral sensitizing dyes may be made in two or more stages or in portions. Alternatively, the addition of the dyes may be made concentratedly in a short time within one stage or may be made continuously over a long period of time in one stage. If desired, a combination of two or more sensitizing dyes may be used.

The spectral sensitizing dyes may be added in the form of a crystal or powder as such. However, it is preferred that the spectral sensitizing dyes be dissolved or dispersed, and then added. The dyes may be dissolved in a water-soluble solvent such as an alcohol having from 1 to 3 carbon atoms, acetone, pyridine or methyl cellosolve or a mixture thereof. The dye may be subjected to micellar dispersion using a surfactant. The dispersion of the dyes may be prepared by other methods.

The amounts of the spectral sensitizing dyes to be added vary depending on the type of the silver halide emulsion and the purpose of spectral sensitization, but are generally used in an amount of from $1\times10^{-6}$ to $1\times10^{-2}$ mol, preferably $1\times10^{-5}$ to $5\times10^{-3}$ mol per mol of silver halide.

The spectral sensitizing dyes of the present invention may be used either alone or a combination.

Among the sensitizing dyes preferably used in the present invention, nonlimiting examples of the cyanine dyes having the formula (I) include the following compounds.

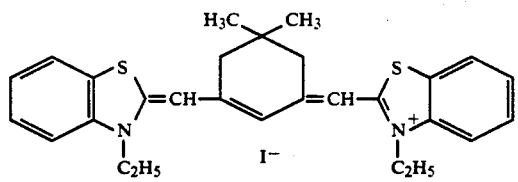

(V-1)

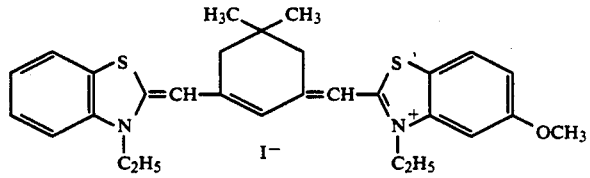

(V-2)

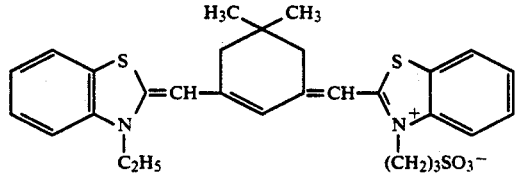

(V-3)

-continued
(V-4)
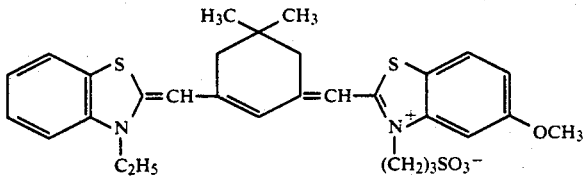
(V-5)
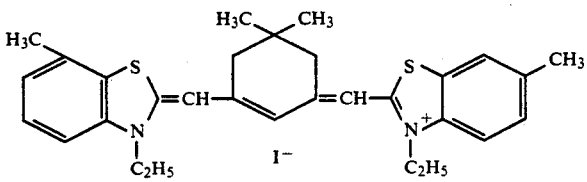
(V-6)
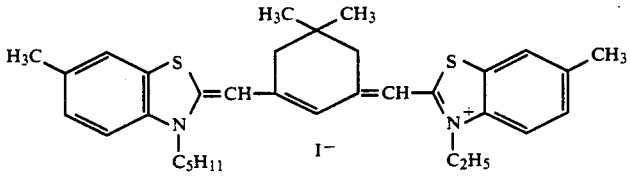
(V-7)
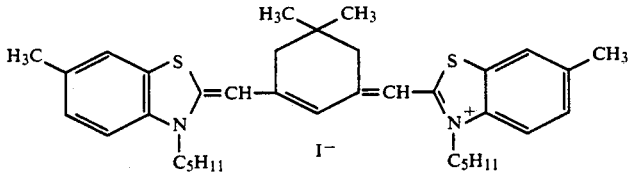
(V-8)
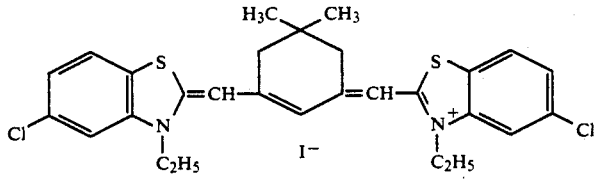
(V-9)
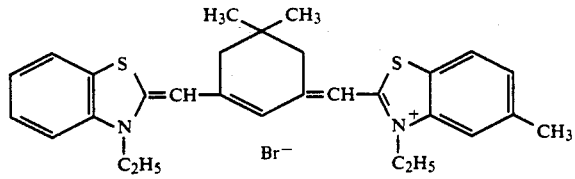
(V-10)
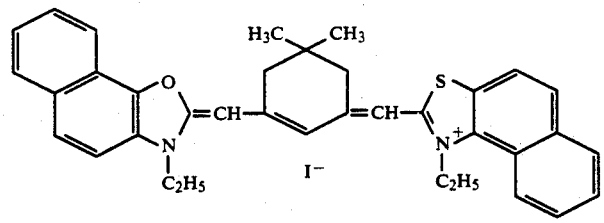
(V-11)
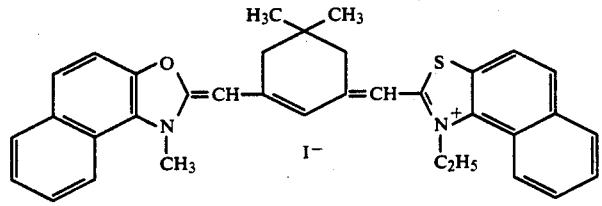

-continued
(V-12)
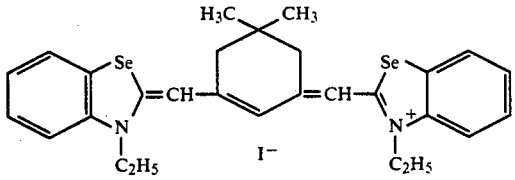
(V-13)
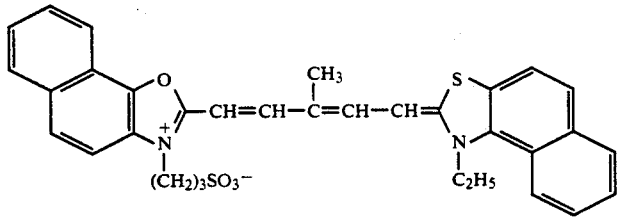
(V-14)
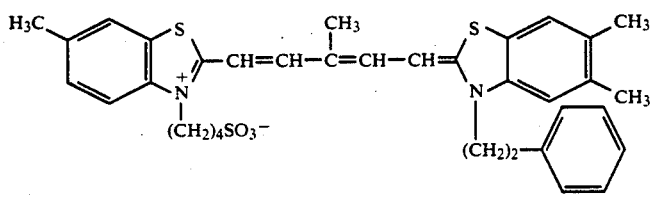
(V-15)
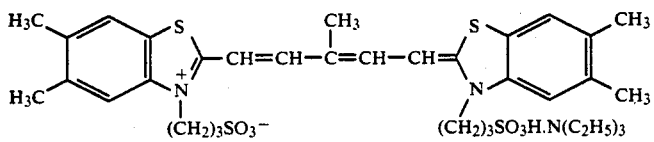
(V-16)
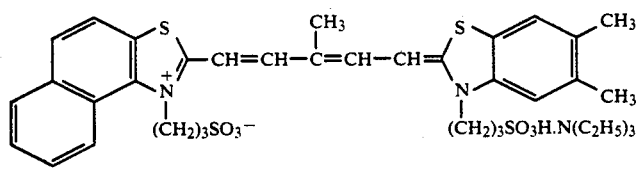
(V-17)
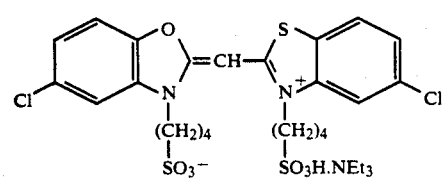
(V-18)
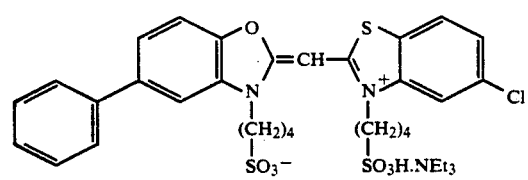
(V-19)
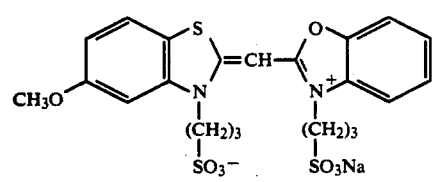
(V-20)
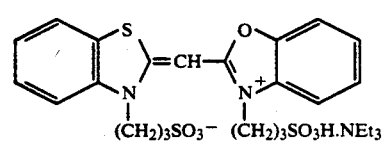

-continued
(V-21)
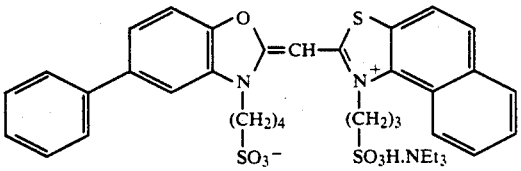
(V-22)
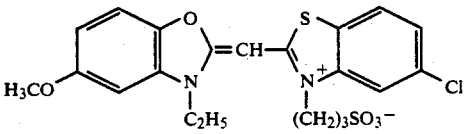
(V-23)
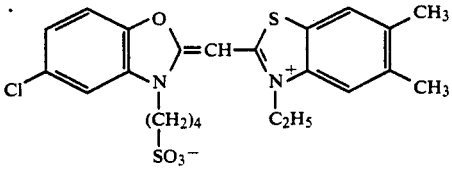
(V-24)
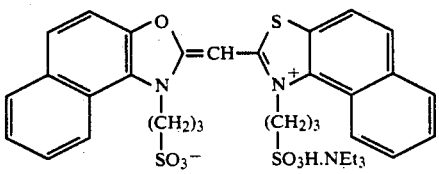
(V-25)
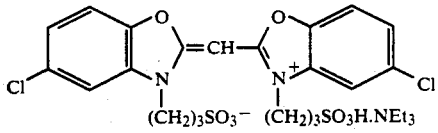
(V-26)
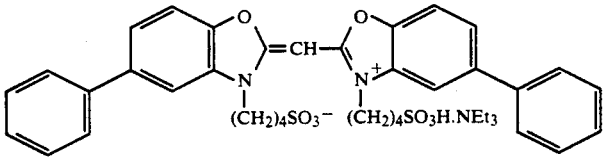
(V-27)
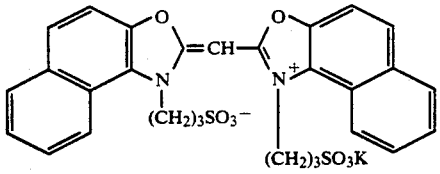
(V-28)
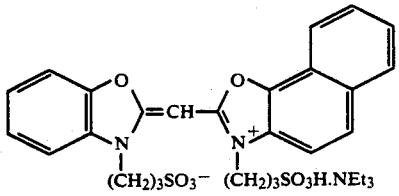
(V-29)
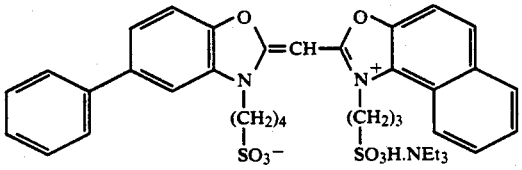

-continued
(V-30)
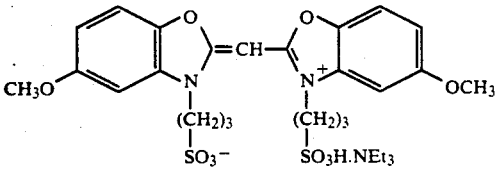
(V-31)
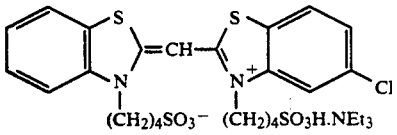
(V-32)
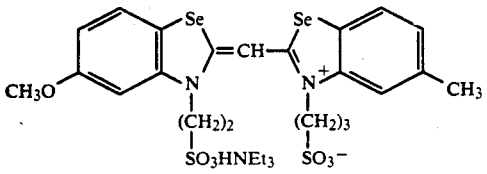
(V-33)
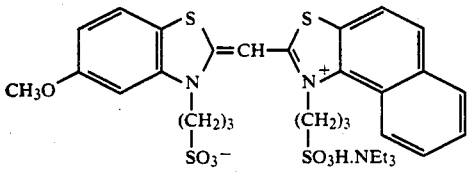
(V-34)
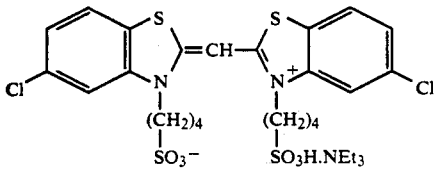
(V-35)
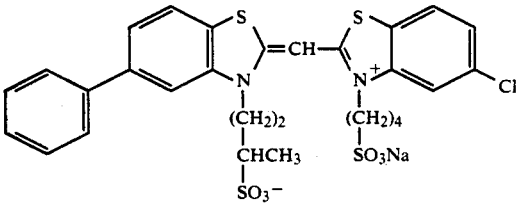
(V-36)
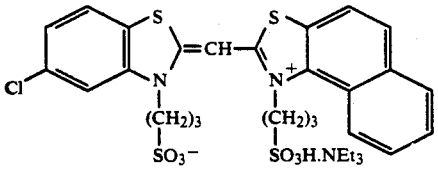
(V-37)
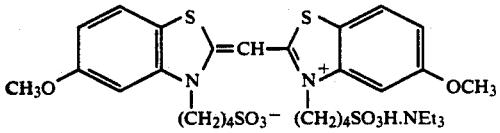
(V-38)
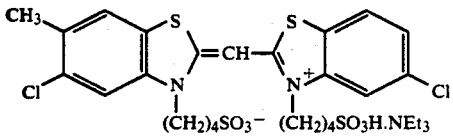

-continued
(V-39)
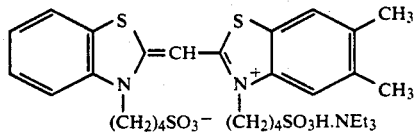
(V-40)
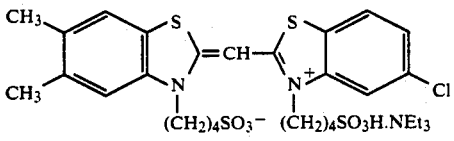
(V-41)
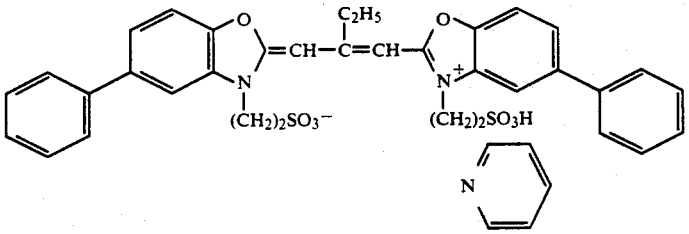
(V-42)
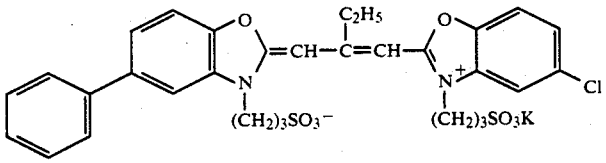
(V-43)
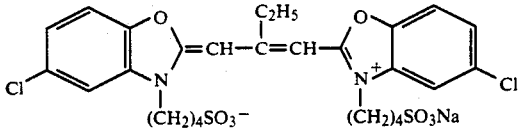
(V-44)
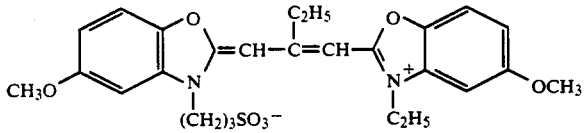
(V-45)
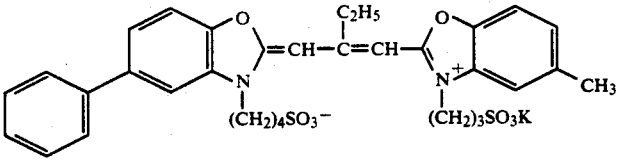
(V-46)
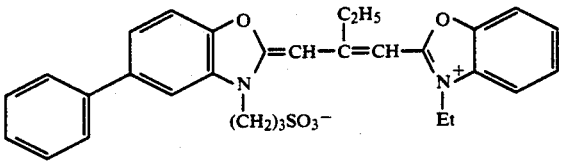
(V-47)
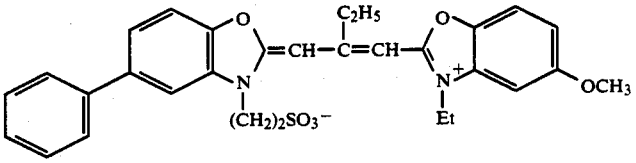

-continued
(V-48)
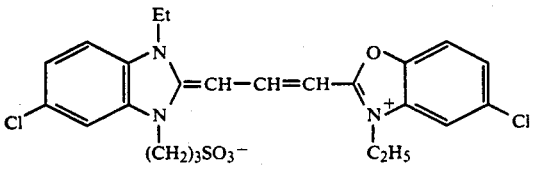
(V-49)
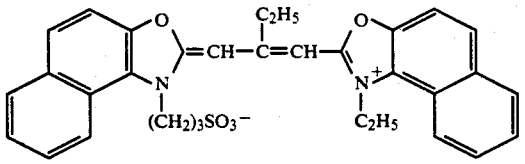
(V-50)
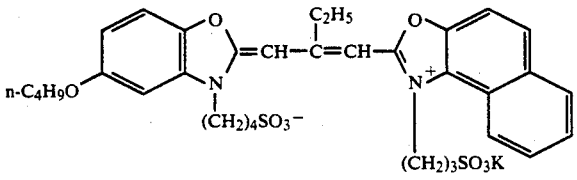
(V-51)
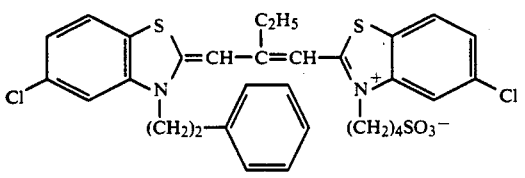
(V-52)
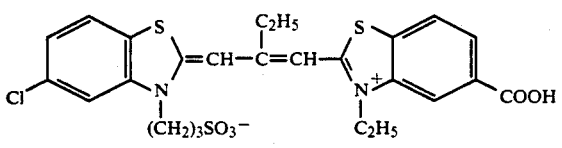
(V-53)
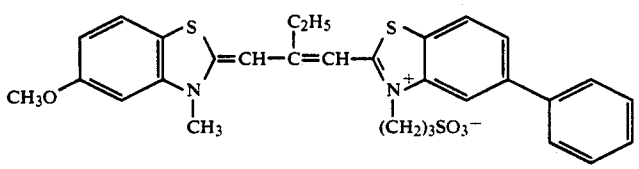
(V-54)
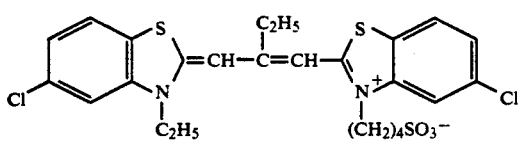
(V-55)
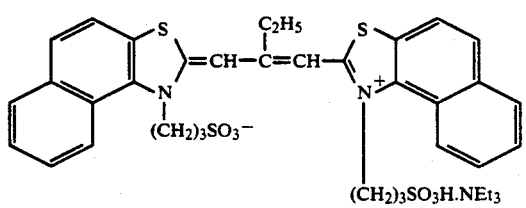

-continued (V-56)

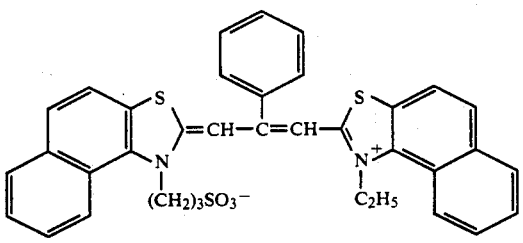

In addition to the sensitizing agents, dyes which themselves do not have spectral sensitizing effect or supersensitizing dyes which do substantially not absorb visible light, but enhance the sensitizing effect of the spectral sensitizing dye, may be used.

In the present invention, nitrogen-containing heterocyclic group-substituted aminostilbene compounds (e.g., the compounds described in U.S. Pat. Nos. 2,933,390 and 3,635,721) are useful in reducing the residual color of carbocyanine dyes having an oxazole nucleus and improving the color sensitization of dicarbocyanine dyes having a benzthiazole nucleus. Hence, it is particularly preferred that said aminostilbene compounds are used in combination with these dyes. In addition thereto, azaindene compounds, particularly hydroxyazaindene compounds and aminoazaindene compounds are preferred.

Preferred examples of the aminostilbene compounds which can be used in the present invention include 4,4'-bis(s-triazinylamino)stilbene-2,2'-disulfonic acid, 4,4'-bis(pyrimidinylamino)stilbene-2,2'-disulfonic acid and alkali metal salts thereof. It is particularly preferred that the s-triazine ring or pyrimidine ring of these compounds is mono- or di-substituted by groups such as a substituted or unsubstituted arylamino group, a substituted or unsubstituted alkylamino group, a substituted or unsubstituted aryloxy group, a substituted or unsubstituted alkoxy group, hydroxyl group and amino group. For reducing residual color, it is even more particularly preferred that this moiety be substituted by a highly water-soluble group such as a sulfo group, hydroxyl group or by groups having a sulfo or hydroxyl radical.

Preferred aminostilbene compounds for use in the present invention are represented by the following formula (F).

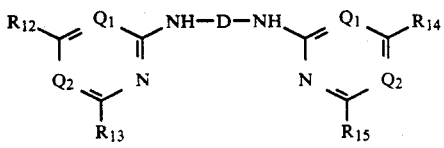

(F)

In the above formula, D represents a bivalent aromatic residue; $R_{12}$, $R_{13}$, $R_{14}$ and $R_{15}$ each represent a hydrogen atom, a hydroxyl group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an arylamino group, a heterocyclic amino group, an aralkylamino group or an aryl group; and $Q_1$ and $Q_2$ each represent —N= or —C=, and at least of $Q_1$ and $Q_2$ is —N=.

Preferred nonlimiting examples of the aminostilbene compounds for use in the present invention include the following.

(F-1)

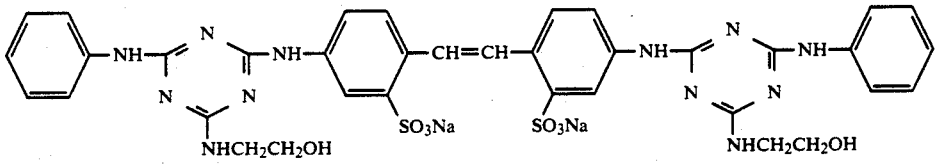

(F-2)

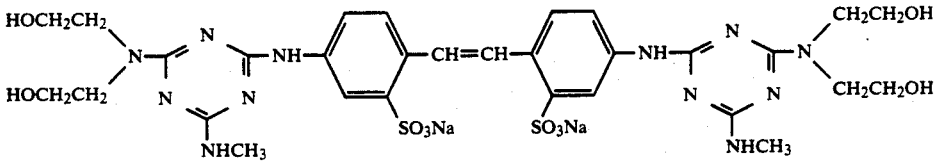

(F-3)

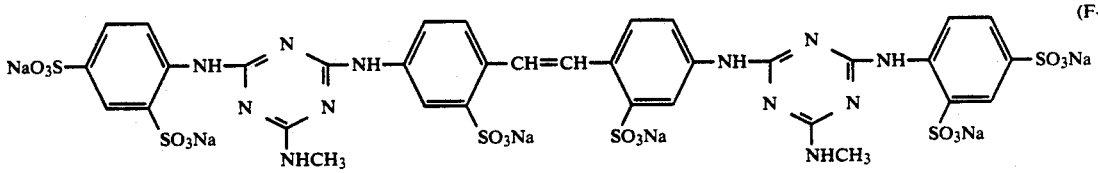

-continued
(F-4)
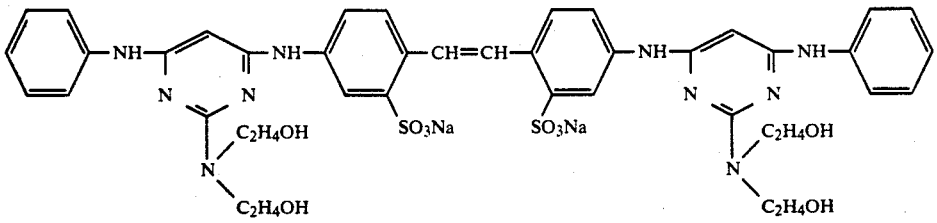
(F-5)
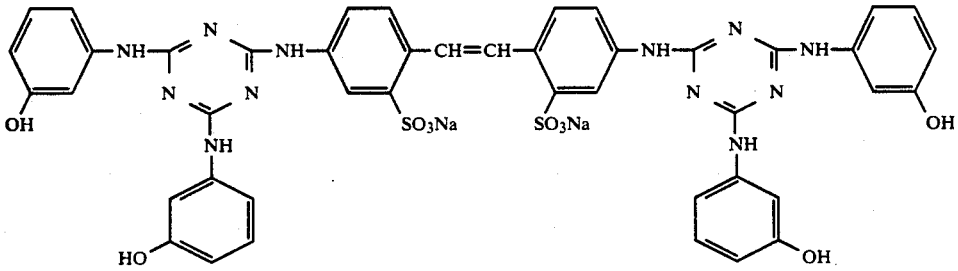
(F-6)
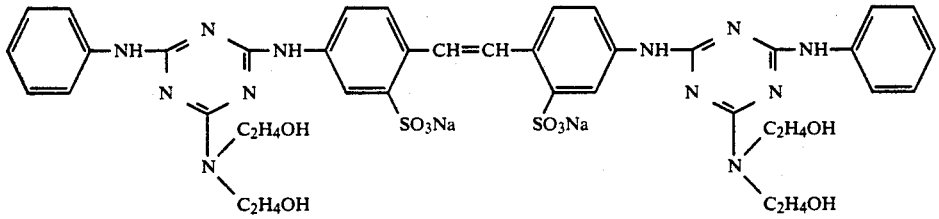
(F-7)
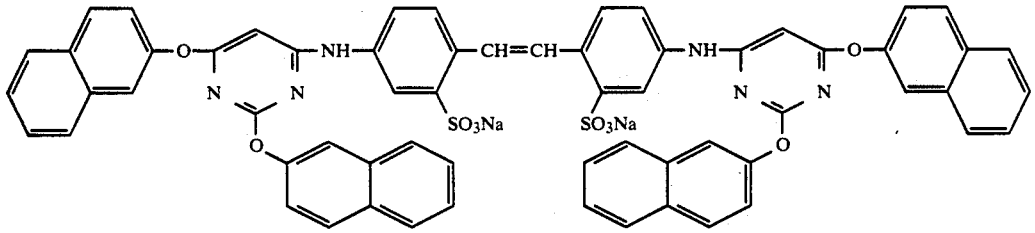
(F-8)
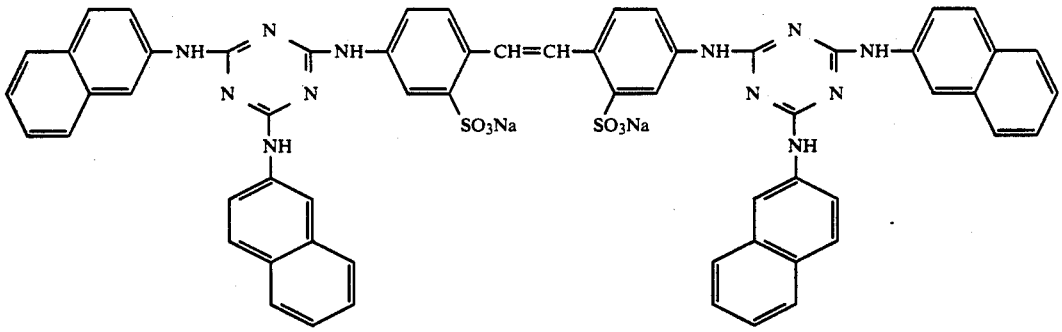
(F-9)
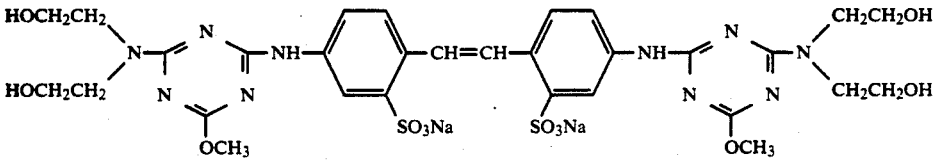

-continued
(F-10)
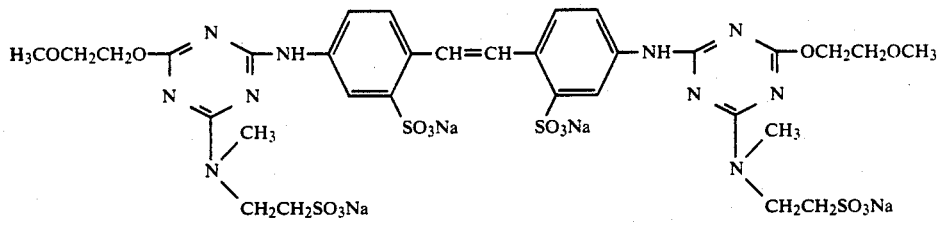
(F-11)
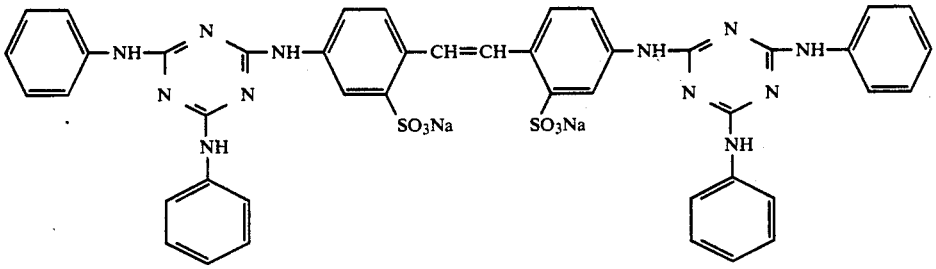
(F-12)
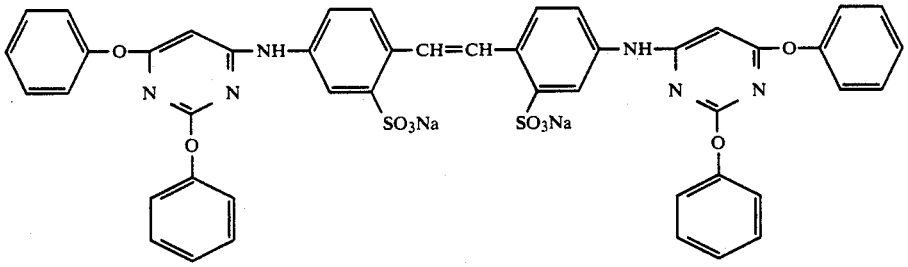
(F-13)
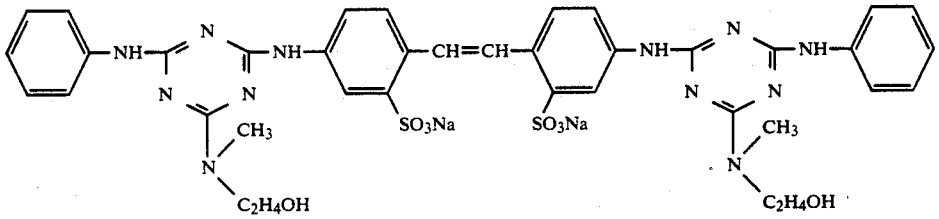
(F-14)
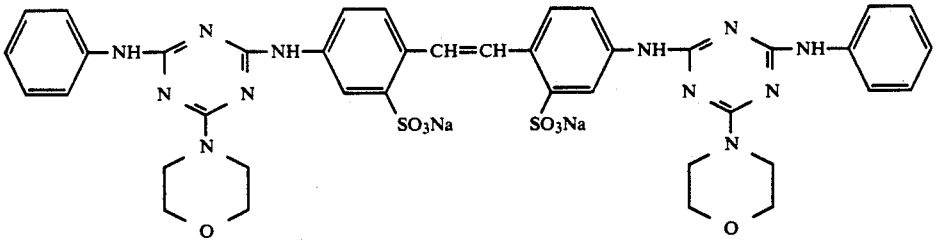
(F-15)
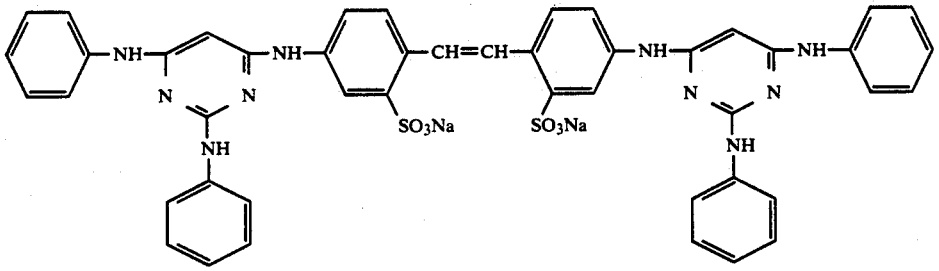

-continued
(F-16)
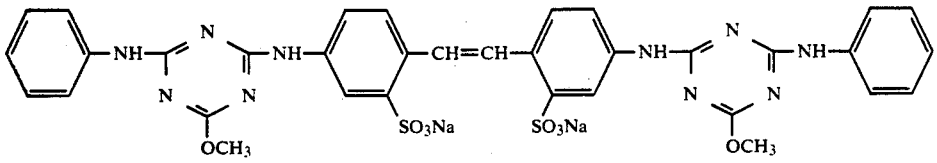
(F-17)
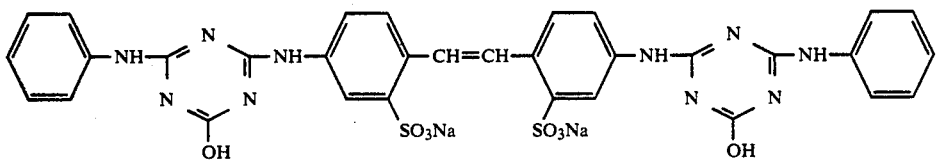
(F-18)
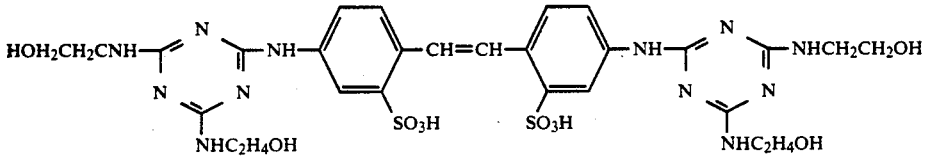
(F-19)
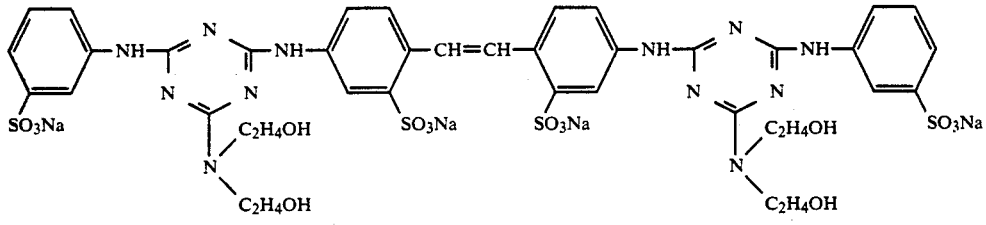
(F-20)
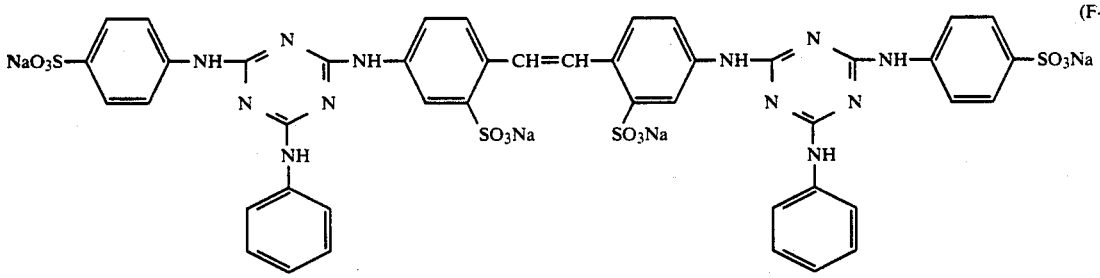
(F-21)
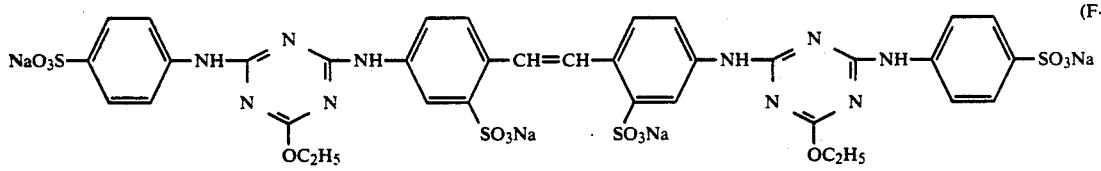
(F-22)
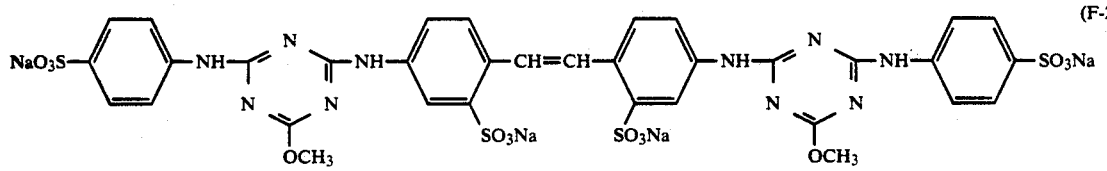
(F-23)
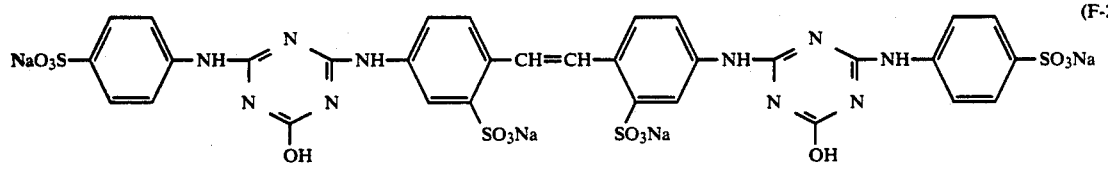

-continued (F-24)

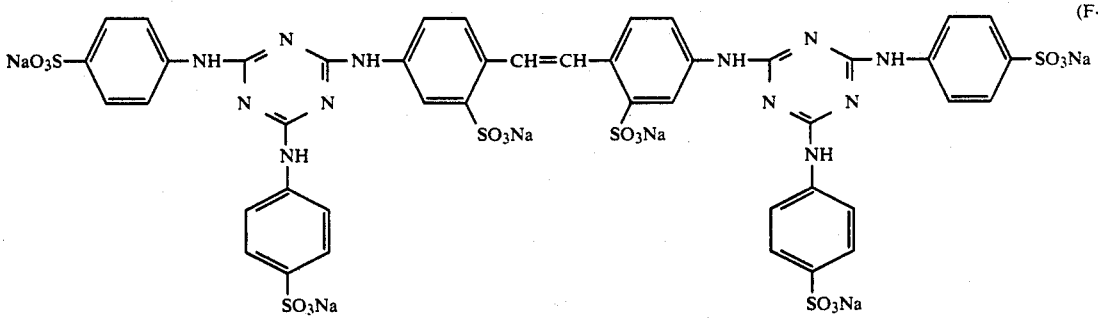

The silver halide emulsion of the present invention may contain the following compounds for the prevention of fogging during the preparation and storage of the photographic materials or during processing, or for the purpose of improving the stability of photographic performance. Namely, these compounds include a first group of heterocyclic mercapto compounds such as mercaptothiadiazoles, mercaptotetrazoles, mercaptobenzimidazoles, mercaptobenzthiazoles, mercaptopyrimidines and mercaptothiazoles; a second group of compounds formed by introducing a water-soluble group such as carboxyl group or sulfo group into the above heterocyclic mercapto compounds; a third group of azoles such as benzthiazolium salts, nitro indazoles, triazoles, benztriazoles and benzimidazoles (particularly nitro-substituted or halogen-substituted derivatives); a fourth group of thioketo compounds such as oxazolidinethione; and a fifth group of azaindenes such as tetraazaindenes (e.g., hydroxyazaindenes, aminoazaindenes, particularly 4-hydroxy-6-methyl-1,3,3a,7-terazaindene). These compounds, in addition to benzenethiosulfinic acid and benzenesulfinic acid are known as anti-fogging agents or stabilizers, and may be added to the silver halide emulsion of the present invention.

Preferred azaindene compounds may be selected among the compounds represented by the following formula (IIIa) or (IIIb).

(IIIa)

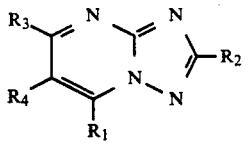

In the above formula, $R_1$, $R_2$ $R_3$ and $R_4$ may be the same or different, and each represents a hydroxyl group, an alkyl group, an alkenyl group, an aryl group, cyano group, a ureido group, a halogen atom or hydrogen atom, with the proviso that at least one of these groups is a hydroxyl group.

The above-noted alkyl, alkenyl, aryl, ureido and amino groups are the same as those set forth in the formula (Ia) defined below. Preferred substituent groups for the alkyl group are an aryl group, an alkoxycarbonyl group, a carbamoyl group, a cyano group, an amino group and a sulfonamido group.

$R_3$ and $R_4$ may be combined together to form a 5-membered or 6-membered saturated or unsaturated ring.

(IIIb)

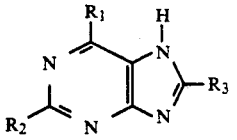

In the above formula, $R_1$, $R_2$ and $R_3$ are as the same as $R_1$ and $R_2$ in the formula (IIIa), but it is not necessary that at least one be a hydroxyl group as in the formula (IIIa).

Preferred nonlimiting examples of the azaindene compounds for use in the present invention include the following.

(III-1)

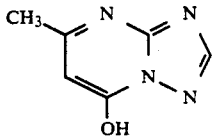

(III-2)

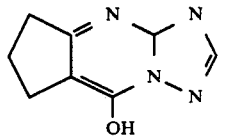

(III-3)

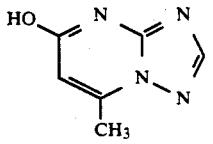

(III-4)

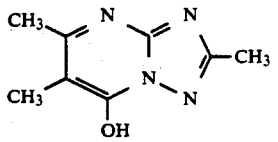

(III-5)

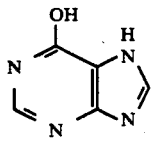

(III-6)

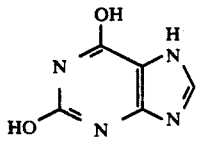

-continued (III-7)

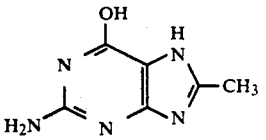

(III-8)

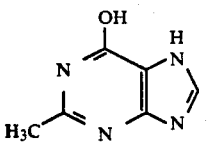

(III-9)

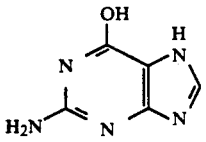

(III-10)

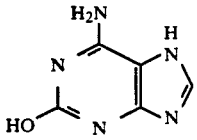

(III-11)

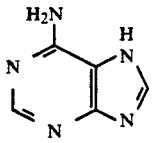

In the present invention, mercaptotetrazole compounds may be added to the silver halide emulsion during or after the formation of the silver halide grains, during or after chemical sensitization, or during the coating of the emulsion to prevent fogging or to reduce variation in photographic characteristics due to a change in processing parameter. Particularly preferred mercaptotetrazole compounds may be selected from among the compounds represented by the following general formula (Ia).

(Ia)

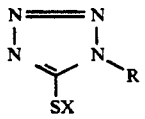

In the formula (Ia), R represents an alkyl group, an alkenyl group or an aryl group; and X represents hydrogen atom, an alkali metal, an ammonium group or a precursor. Examples of the alkali metal include sodium and potassium. Examples of the ammonium group include trimethylammonium chloride group and dimethylbenzylammonium chloride group. The term "precursor" as used herein refers to a group which is converted into X=H or an alkali metal in an alkaline environment. Examples of such groups include acetyl group, cyanoethyl group and methanesulfonylethyl group.

The alkyl group and the alkenyl group represented by R include unsubstituted, substituted and alicyclic alkyl and alkenyl groups. Examples of substituent groups for the substituted alkyl group include halogen, an alkoxy group, an aryl group, an acylamino group, an alkoxycarbonylamino group, a ureido group, a hydroxyl group, an amino group, a heterocyclic group, an acyl group, a sulfamoylo group, a sulfonamido group, a thioureido group, a carbamoyl group, a carboxyl group (including a salt thereof), and a sulfo group (including a salt thereof).

The above-described ureido, thioureido, sulfamoyl, carbamoyl and amino groups include unsubstituted groups, N-alkyl-substituted groups and N-aryl substituted group. Examples of the aryl group include a phenyl group and a substituted phenyl group. Examples of substituent groups for the substituted phenyl group include an alkyl group and those described above for the alkyl group.

Preferred mercaptothiadiazole compounds may be selected from among the compounds represented by the following formula (IIa).

(IIa)

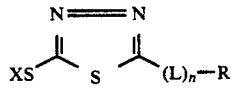

In the formula (IIa), L represents a bivalent bonding group; R represents a hydrogen atom, an alkyl group, an alkenyl group or an aryl group. The alkyl group and the alkenyl group represented by R and X are the same as those set forth in the formula (Ia).

Examples of the bivalent bonding group represented by L include

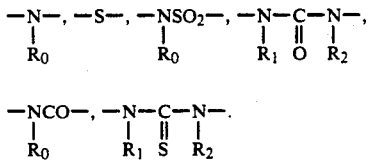

n represents 0 or 1, and $R_0$, $R_1$ and $R_2$ each represent a hydrogen atom, an alkyl group or an aralkyl group.

In addition to the above-described compounds, mercaptobenzimidazoles are preferably used in the present invention.

Preferred nonlimiting examples of marcaptotetrazole compounds for use in the present invention include the following.

(I-1)

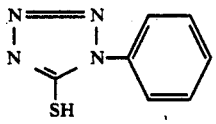

(I-2)

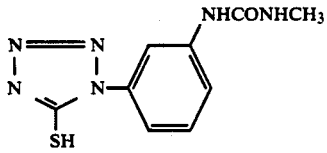

(I-3)

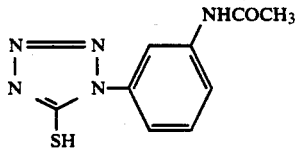

-continued (I-4)

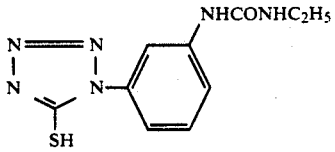

(I-5)

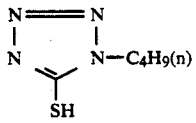

(I-6)

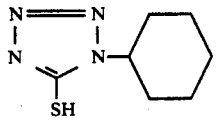

(I-7)

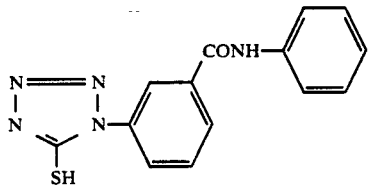

(I-8)

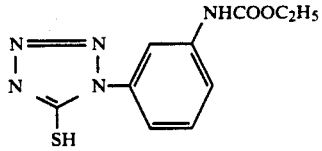

(I-9)

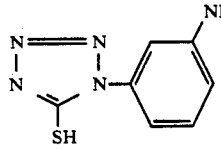

(I-10)

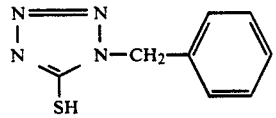

(I-11)

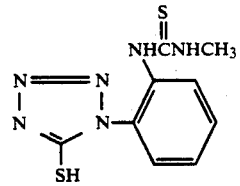

(I-12)

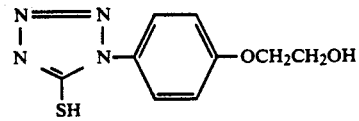

(II-1)

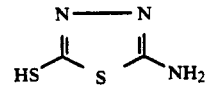

(II-2)

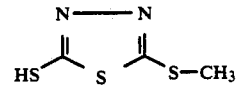

-continued (II-3)

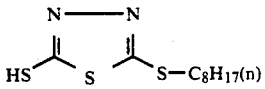

(II-4)

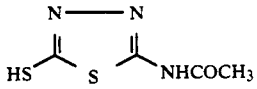

(II-5)

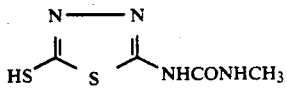

(II-6)

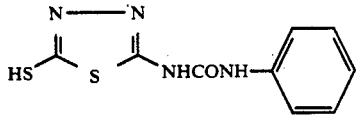

The emulsion layers and other hydrophilic colloid layers of the photographic material of the present invention may contain brightening agents such as stilbene compounds, triazine compounds, oxazole compounds and coumarin compounds. Water-soluble brightening agents may be used, or a water-insoluble brightening agent may be used in the form of a dispersion.

The emulsion layers and hydrophilic colloid layers of the present invention may contain conventional water-soluble dyes (e.g., oxonol dyes, anthraquinone dyes, azo dyes, merocyanine dyes, etc.) as filter dyes or for the prevention of irradiation. Useful examples of these dyes include oxonol dyes having a pyrazolone nucleus or barbituric acid nucleus as described in U.K. Patents 506,305, 1,177,429, 1,311,884, 1,338,799, 1,385,371, 1,467,214, 1,433,102 and 1,553,516, JP-A-48-85130, JP-A-49-114420, JP-A-55-161233, JP-A-59-111640, U.S. Pat. Nos. 3,247,127, 3,469,985 and 4,078,983; the oxonol dyes described in U.S. Pat. Nos. 2,533,472 and 2,279,533 and U.K. Patent 1,278,621; the azo dyes described in U.K. Patents 575,691, 680,631, 599,623, 786,907, 907,125 and 1,045,609, U.S. Pat. No. 4,255,326 and JP-A-59-211043; Azomethine dyes described in JP-A-50-100116, JP-A-54-118247, U.K. Patents 2,014,598 and 750,031; the anthraquinone dyes described in U.S. Pat. No. 2,865,752; and the compounds described in U.S. Pat. Nos. 2,538,009, 2,688,541 and 2,538,008 and U.K. Patents 584,609 and 1,210,252.

Compounds represented by the following general formula (D) are preferably used as the pyrazoloneoxonol dyes in the present invention.

(D)

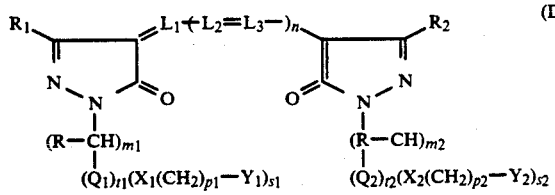

In the above formula, $R_1$ and $R_2$ each represent $-COOR_5$ or $$-\underset{\underset{R_6}{|}}{CON}-R_5;$$

$R_3$ and $R_4$ each represent a hydrogen atom or an unsubstituted or substituted alkyl group (e.g., ethyl, ethyl, butyl, hydroxyethyl); $R_5$ and $R_6$ each represent a hydrogen atom, an unsubstituted or substituted alkyl group (e.g., methyl, ethyl, butyl, hydroxyethyl, phenethyl) or an unsubstituted or substituted aryl group (e.g., phenyl, hydroxyphenyl); $Q_1$ and $Q_2$ each represent an aryl group (e.g., phenyl, naphthyl); $X_1$ and $X_2$ represent each a monovalent or bivalent bonding group; $Y_1$ and $Y_2$ each represent a sulfo group or carboxyl group; $L_1$, $L_2$ and $L_3$ each represent a methine group which may be substituted with a substituent such as an alkyl group (e.g., methyl); $m_1$ and $m_2$ each represent 0, 1 or 2; n represents 0, 1 or 2; $p_1$ and $p_2$ each represent 0, 1, 2, 3 or 4; $s_1$ and $s_2$ each represent 1 or 2; $t_1$ and $t_2$ each represent 0 or 1; with the proviso that $m_1$, $p_1$ and $t_1$ cannot simultaneously be 0 or $m_2$, $p_2$ and $t_2$ cannot simultaneously be 0.

Nonlimiting examples of pyrazoloneoxanol compounds of the present invention include the following.

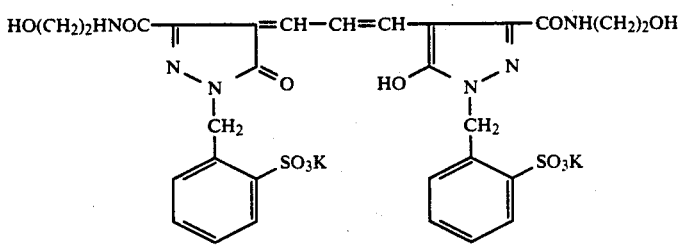

(D-1)

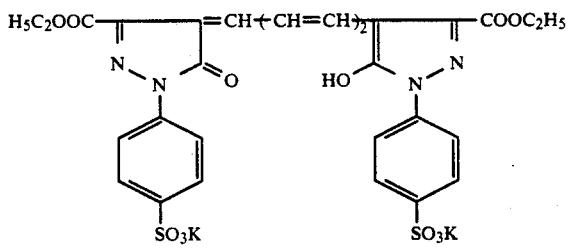

(D-2)

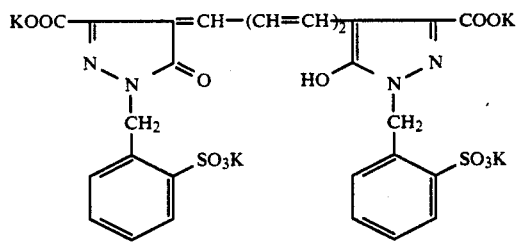

(D-3)

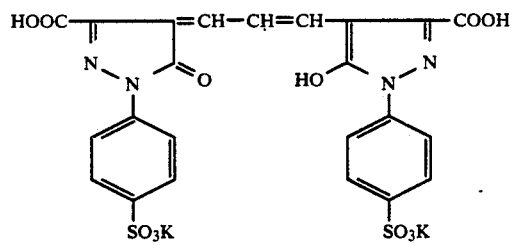

(D-4)

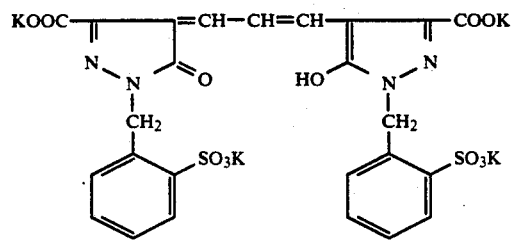

(D-5)

-continued
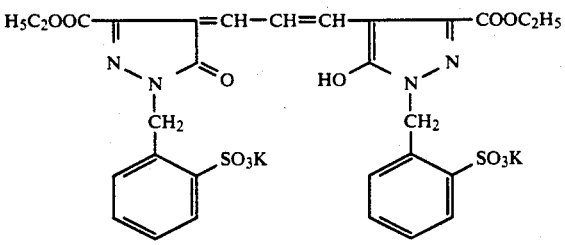
(D-6)
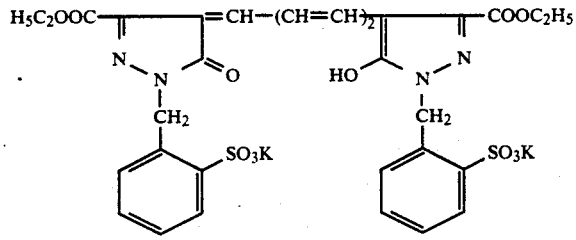
(D-7)
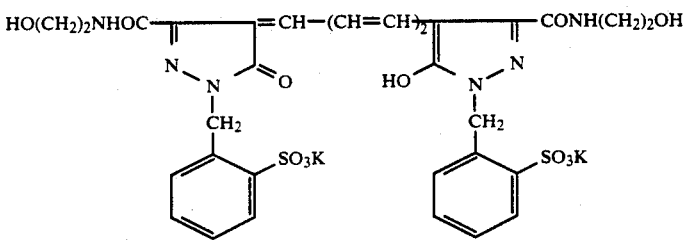
(D-8)
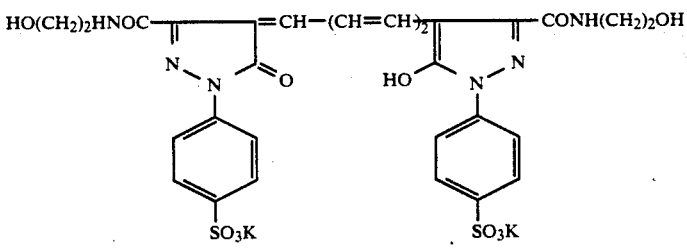
(D-9)
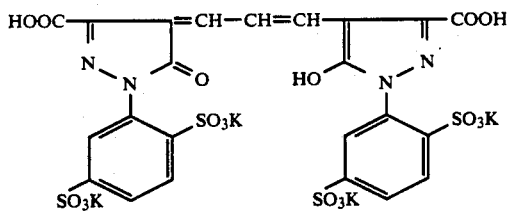
(D-10)
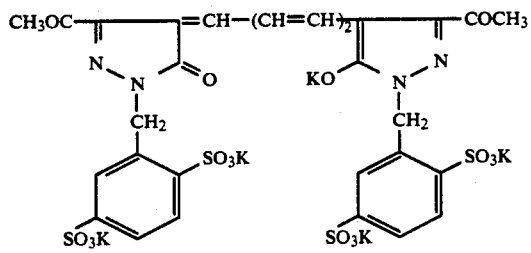
(D-11)

-continued (D-12)

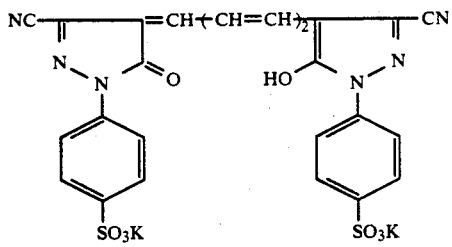

Oil-soluble couplers which are made non-diffusing and are used in the present invention will be illustrated in detail below.

The term "oil-soluble coupler which is made non-diffusing" as used herein refers a coupler which is soluble in high-boiling organic solvents and is made non-diffusing so that the coupler is difficulty diffuse in a photographic material. Methods for rendering couplers non-diffusing include the following.

In a first method, at least one non-diffusing group having a moiety composed of an aliphatic group, an aromatic group or a heterocyclic group having a certain minimun molecular weight is introduced into a coupler molecule. The non-diffusing group preferably has at least 6 carbon atoms, and more preferably at least 12 carbon atoms. Two couplers may be bonded to each other through a non-diffusing group. The non-diffusing couplers preferably have a molecular weight of from 250 to 2000, and more preferably from 300 to 1500 per coupler molecule. In a second method, a coupler is converted into a dimer or polymer to form a polymer coupler, thus increasing the molecular weight of the coupler to thereby render the same non-diffusing.

Couplers preferably used in the present invention are illustrated in detail below.

Cyan couplers preferably used in the present invention are represented by the following general formulae (C1) and (C2).

(C1)

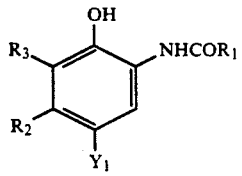

(C2)

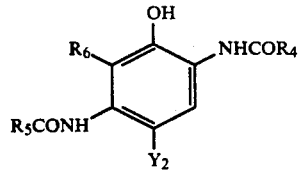

In the above formulae, $R_1$, $R_4$ and $R_5$ each represent an aliphatic group (the aliphatic group is a straight-chain, branched or cyclic hydrocarbon group and includes saturated groups and unsaturated groups such as alkyl group and alkenyl group). The aliphatic group preferably has from 1 to 36 carbon atoms. Examples thereof include n-methyl, n-ethyl, n-butyl, n-pentyl, n-dodecyl, octadecyl, eicosenyl, i-propyl, t-butyl, t-octyl, t-dodecyl, cyclohexyl, cyclopentyl, allyl, vinyl, 2-hexadecenyl, propagyl, etc.), an aromatic group (preferably having from 6 to 36 carbon atoms such as phenyl, naphthyl, etc.), a heterocyclic group (e.g., 3-pyridyl, 2-furyl,etc.) or an aromatic or heterocyclic amino group (e.g., anilino, naphthylamino, 2-benzthiazoylamino, 2-pyridylamino, etc.). These groups may be substituted by one or more substituent groups selected from an alkyl group, an aryl group, a heterocyclic group, an alkoxy group (e.g., methoxy, 2-methoxyethoxy), an aryloxy group (e.g., 2,4-di-t-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, ethylcarbamoyl, dimethylcarbamoyl, methanesulfonamido, butylsulfamoyl), a sulfamido group (e.g., dipropylsulfamoylamino), an imido group (e.g., succinimido, hydantoinyl), an ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), hydroxyl group, cyano group, carboxyl group, nitro group, sulfo group and halogen atom.

$R_2$ represents an aliphatic group having from 1 to 20 carbon groups. The aliphatic group may be substituted by one or more substituent groups selected from those described above in the definition of $R_1$.

$R_3$ and $R_4$ each represent a hydrogen atom, a halogen atom (fluorine, chlorine, bromine), an aliphatic group (preferably having from 1 to 10 carbon atoms), an aliphatic oxy group (preferably having from 1 to 20 carbon atoms) or an acylamino group (preferably having from 1 to 20 carbon atoms such as acetamido, benzamido, tetradecaneamido). These groups may be substituted by one or more substituent groups selected from those described above in the definition of $R_1$.

$R_2$ and $R_3$ may be combined together to form a 5-membered, 6-membered or 7-membered ring such as a condensed ring (e.g., carbostyril or hydroxyindole). $R_5$ and $R_6$ may be combined together to form a 5-membered, 6-membered or 7-membered ring such as a condensed ring (e.g., carbostyril or hydroxyindole).

Furthermore, a dime or a polymer may be formed by any one or more of $R_1$, $R_2$, $R_3$ and $Y_1$, or any one or more of $R_4$, $R_5$, $R_6$ and $Y_2$. When a dimer is formed, these groups are each a monovalent or divalent bonding group (e.g., an alkylene group, an arylene group, an ether group, an ester group, an amido group, etc.). When an oligomer or a polymer is formed, these groups each are a polymer chain, or each is bonded to a polymer chain through a divalent group as described above in the definition of the dimer. Alternatively, when a polymer is formed, a copolymer of the above coupler with at least one other non-color forming ethylenically unsaturated monomer (e.g., acrylic acid, methacrylic acid, methyl acrylate, n-butylacrylamide, β-hydroxymethacrylate, vinyl acetate, acrylnitrile, styrene, crotonic acid, maleic anhydride, N-vinylpyrrolidone, etc.)

may be formed even when a homopolymer of a coupler derivative is formed.

When either of $R_1$ and $R_5$ is a substituted or unsubstituted alkyl or aryl group, an unsubstituted or substituted phenyl group and halogen atom are preferred as the substituent group for the substituted alkyl group. Preferred examples of substituent groups for the substituted phenyl group are an alkyl group, an alkoxy group, halogen atom, a sulfonamido group and a sulfamido group. As the substituted aryl group, a phenyl group substituted by at least one member selected from the group consisting of a halogen atom, an alkyl group, a sulfonamido group or an acylamino group is preferred.

In the formula (C2), $R_4$ is preferably a substituted alkyl group or a substituted or unsubstituted aryl group. A halogen atom-substituted alkyl group is particularly preferred. As the aryl group, a phenyl group and a phenyl group substituted by at least one halogen atom or a sulfonamido group are particularly preferred.

In the formula (C1), $R_2$ is preferably an unsubstituted or substituted alkyl group having from 1 to 20 carbon atoms. Preferred substituent groups for $R_2$ include an alkoxy group, an aryloxy group, an acylamino group, an alkylthio group, an arylthio group, an imido group, a ureido group, an alkylsulfonyl group and an arylsulfonyl group.

In the formula (C1), $R_3$ is preferably a hydrogen atom, a halogen atom (particularly fluorine or chlorine atom) or an acylamino group with a halogen atom being particularly preferred.

In the formula (C2), $R_6$ is preferably hydrogen atom, an alkyl group having from 1 to 20 carbon atoms or an alkenyl group, with a hydrogen atom being particularly preferred.

In the formula (C2), $R_2$ is preferably an alkyl group having from 2 to 4 carbon atoms.

$Y_1$ and $Y_2$ each represent a hydrogen atom or a group which is eliminated after the coupling reaction with the oxidation product of a color developing agent. Examples of elimination groups represented by $Y_1$ and $Y_2$ include a halogen atom (e.g., fluorine, chlorine, bromine), a sulfo group, an alkoxy group, an aryloxy group, a heterocyclic oxy group, an alkylthio group, an arylthio group and a heterocyclic thio group.

Examples of magenta couples for use in the present invention include non-diffusing indazolone and cyanoacetyl couplers, preferably 5-pyrazolone couplers and pyrazoloazole couplers. 5-Pyrazolone couplers having an arylamino group or an acylamino group at the 3-position are preferred from the viewpoint of the hue and color density of color forming dyes. Typical examples thereof are described in U.S. Pat. Nos. 2,311,082, 2,343,703, 2,600,788, 2,908,573, 3,062,653, 3,152,896 and 3,936,015. Nitrogen atom elimination groups described in U.S. Pat. No. 4,310,619 arylthio groups described in U.S. Pat. No. 4,351,897 and W088-4795 are preferred as the elimination group of the two equivalent type 5-pyrazolone couplers. 5-pyrazolone couplers having a ballast group as described in European Patent 73,636 provide high color density.

In the present invention, the use of pyrazoloazole couplers is preferred. Examples of useful pyrazoloazole couplers include the pyrazolobenzimidazoles described in U.S. Pat. No. 2,369,879, preferably the pyrazolo[5,1-c][1,2,4]triazoles described in U.S. Pat. No. 3,725,067 and pyrazolotetrazole or pyrazolopyrazole couplers described in *Research Disclosure* No. 24220 (June 1984) or ibid., No. 24230 (June 1984).

The imidazo[1,2-b]pyrazole couplers described in European Patent 199,741 are preferred, and the pyrazolo[1,5-b][1,2,4]triazole couplers described in U.S. Pat. No. 4,540,654 are most preferred from the viewpoint of forming dyes having excellent spectral absorption characteristics, and imparting light fastness. Moreover, use of the above-noted light and allowing the couplers pronounces the effect of the present invention.

The pyrazoloazole couplers for use in the present invention are represented by the following general formula.

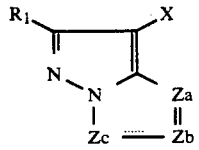

In the above formula, $R_1$ represents hydrogen atom or a substituent group, preferably a substituted or unsubstituted alkyl group (e.g., methyl, ethyl, n-butyl, i-propyl, i-butyl, t-butyl), a substituted or unsubstituted alkoxy group (e.g., methoxy, ethoxy, butoxy, ethoxyethoxy, phenoxyethoxy), a substituted or unsubstituted aryloxy group (e.g., phenoxy, naphthoxy, o-methylphenoxy, o-chlorophenoxy) or a ureido group. Among them, a methyl group, a branched alkyl group (e.g., i-propyl, t-butyl), a substituted or unsubstituted alkoxy group and a substituted or unsubstituted phenoxy group are particularly preferred. X represents a hydrogen atom or a group which is eliminated by the coupling reaction with the oxidation product of an aromatic primary amine developing agent. Examples of the elimination group include a halogen atom (e.g., fluorine, chlorine, bromine), an arylthio group (e.g., 2-butoxy-5-t-octylphenylthio, 2-propoxy-5-t-hexylphenylthio, o-(t-butylcarbonamido)phenylthio), a nitrogen-containing heterocyclic group (e.g., imidazole, 4-chloroimidazole) and an aryloxy group (e.g., p-methylphenoxy, 2,4-dimethylphenoxy, 2,4-di-t-phenoxy). Among them, a halogen atom and an arylthio group are particularly preferred. Za, Zb and Zc each represent a methine group, a substituted methine group, =N— or —NH—. One of the Za to Zb bond and the Zb to Zc bond is a double bond and the other is a single bond. When the Za to Zb bond is a carbon-to-carbon double bond, said bond may be a moiety of an aromatic ring. Furthermore, a dimer or a polymer may be formed by $R_1$ or X. When Za, Zb or Zc is a substituted methine group, a dimer or a polymer which is formed therewith may be included. Preferred substituent groups for the substituted methine group include a substituted alkyl group, particularly a substituted branched alkyl group (e.g., substituted i-propyl, substituted i-butyl).

Typical examples of yellow couplers for use in the present invention include the non-diffusing acylacetamide couplers. Examples thereof are described in U.S. Pat. Nos. 2,407,210, 2,875,057 and 3,265,506. The two equivalent type yellow couplers are preferred for use in the present invention. Typical examples thereof include the oxygen atom elimination type two equivalent type yellow couplers described in U.S. Pat. Nos. 3,408,194, 3,447,928, 3,933,501 and 4,022,620; and the nitrogen atom elimination type two equivalent type yellow couplers described in JP-B-58-10739, U.S. Pat. Nos. 4,401,752 and 4,326,024, RD 18053 (April 1979), U.K. Patent 1,425,020, West German Patent Laid-Open Nos.

2,219,917, 2,261,361, 2,329,587 and 2,433,812. α-Pivaloylacetanilide couplers have excellent dye fastness, particularly fastness to light, and α-benzoylacetanilide couplers provide high color density.

The couplers of the present invention are used in an amount of 0.005 to 4 mol, preferably 0.05 to 2 mol per mol of silver halide in the silver halide emulsion. Alternatively, the couplers are coated in an amount of preferably $2\times10^{-5}$ to $1\times10^{-2}$ mol/m$^2$, and more preferably $4\times10^{-5}$ to $5\times10^{-3}$ mol/m$^2$ by coating weight on a support.

Preferred examples of the couplers for usedin the present invention include the following:

(C-1)

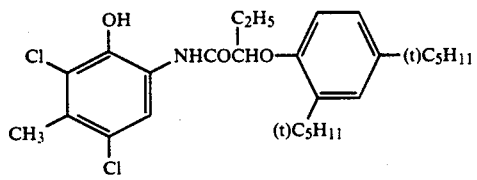

(C-2)

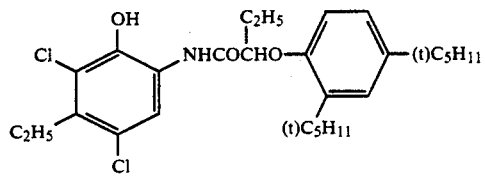

(C-3)

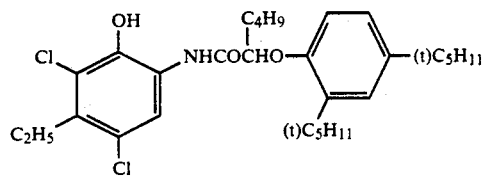

(C-4)

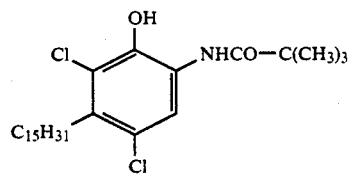

(C-5)

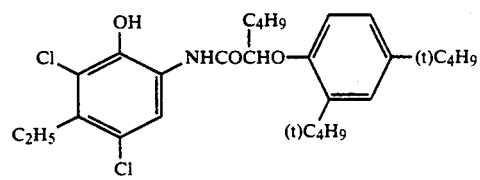

(C-6)

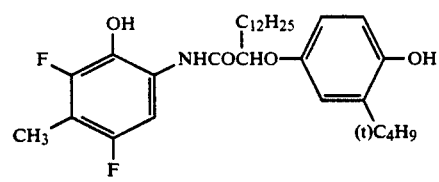

(C-7)

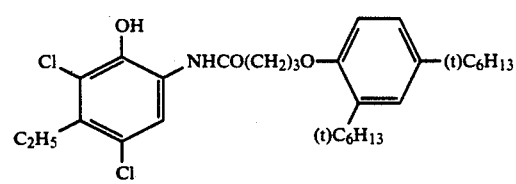

(C-8)

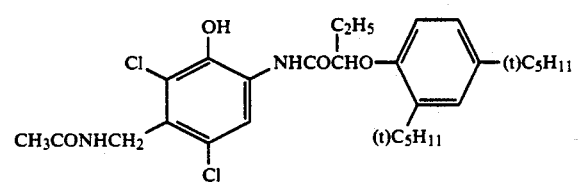

-continued
(C-9)
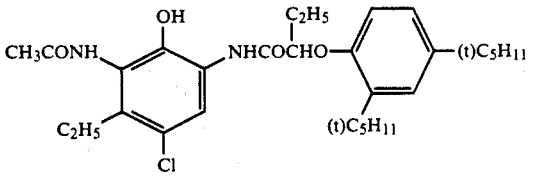
(C-10)
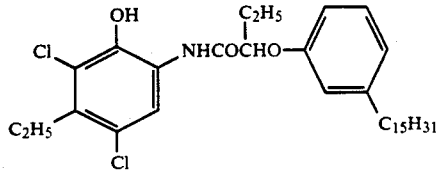
(C-11)
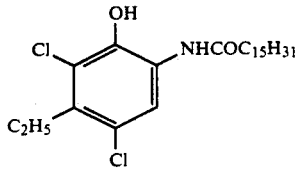
(C-12)
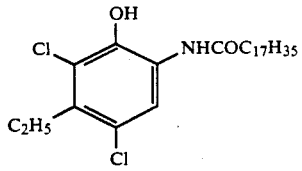
(C-13)
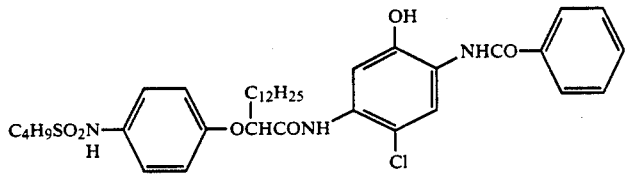
(C-14)
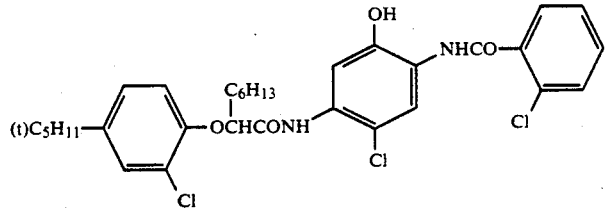
(C-15)
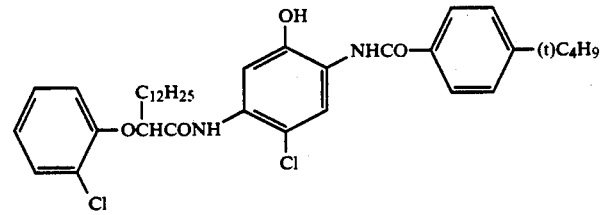
(C-16)
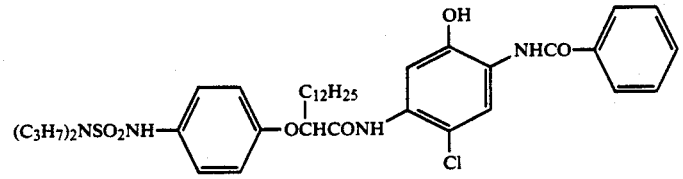

-continued
(C-17)
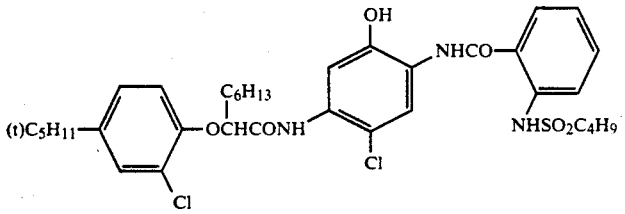
(C-18)
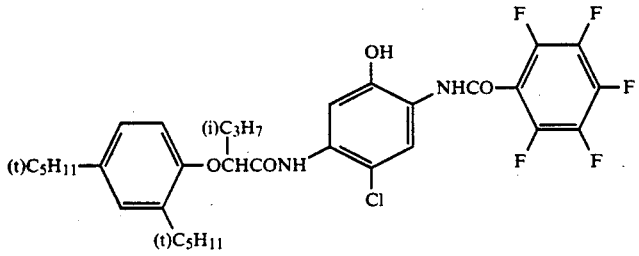
(C-19)
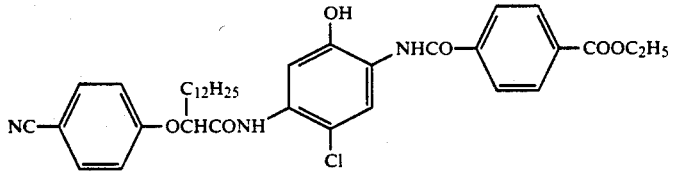
(C-20)
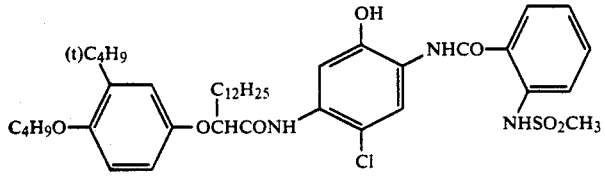
(C-21)
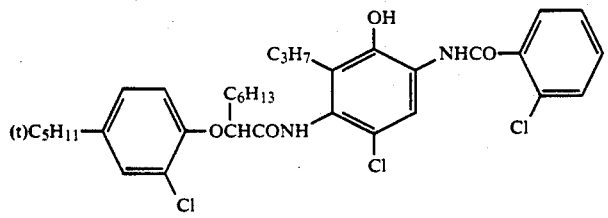
(C-22)
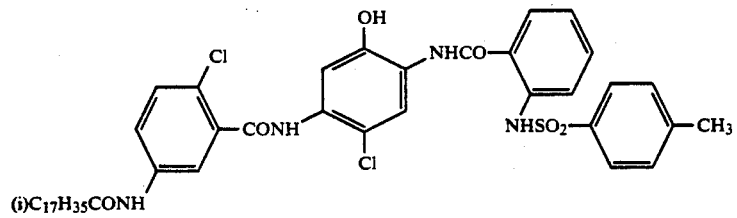
(C-23)
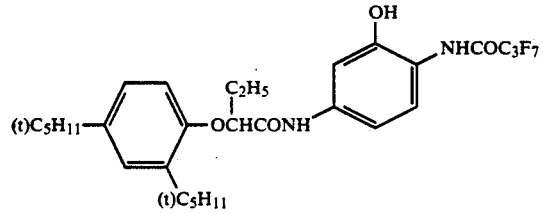

-continued
(C-24)
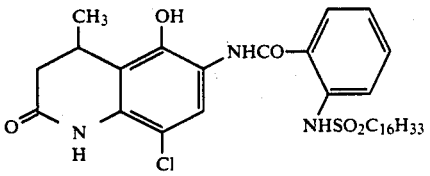
(C-25)
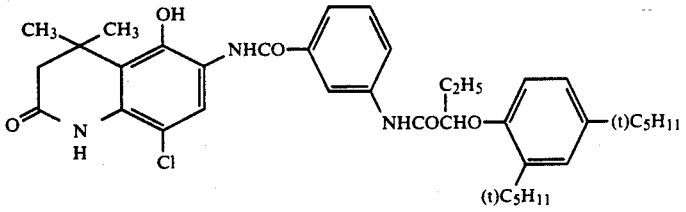
(C-26)
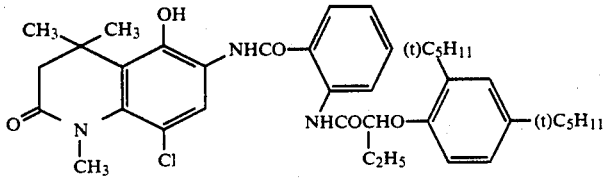
(C-27)
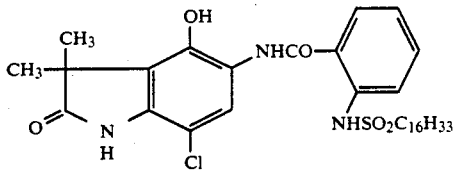
(C-28)
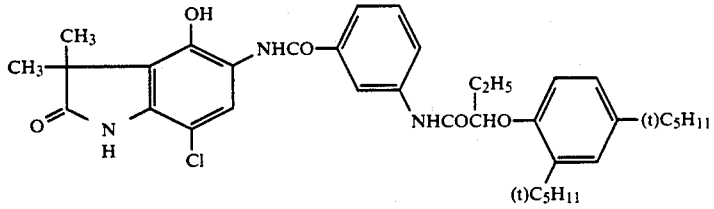
(C-29)
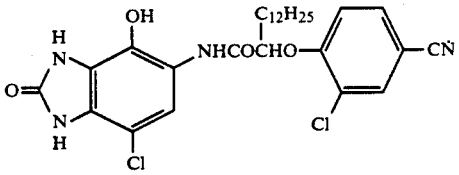
(C-30)
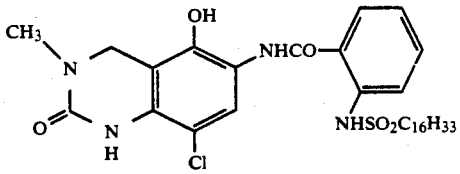
(C-31)
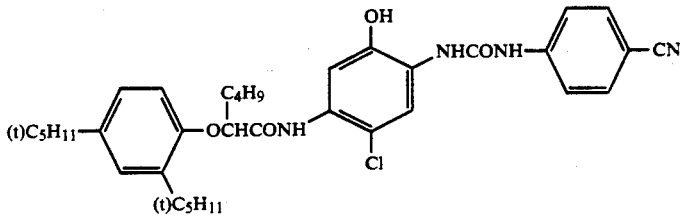

-continued
(C-32)
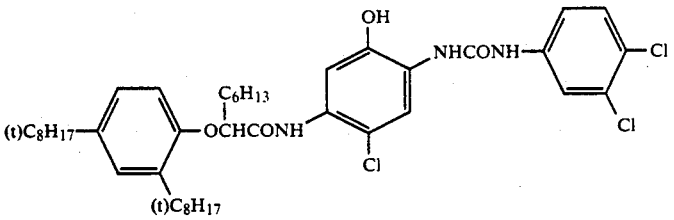
(C-33)
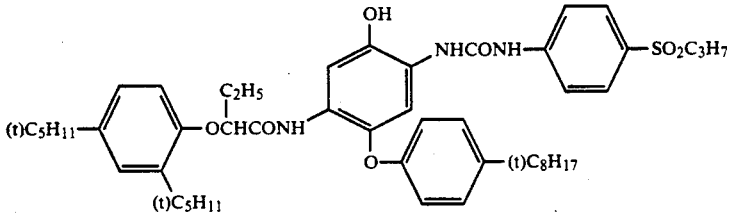
(C-34)
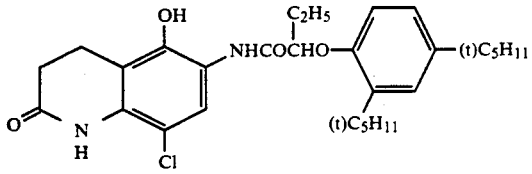
(C-35)
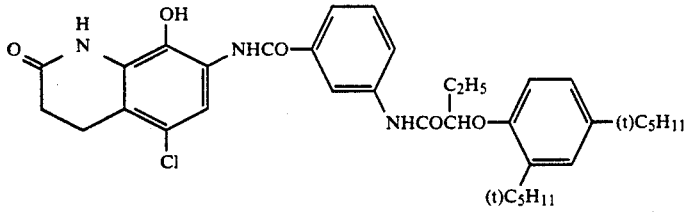
(C-36)
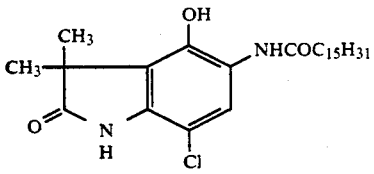
(C-37)
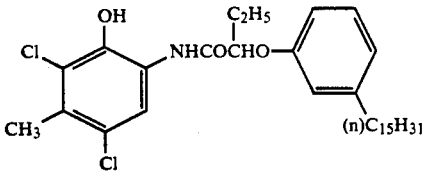
(C-38)
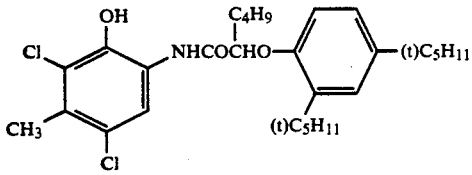
(C-39)
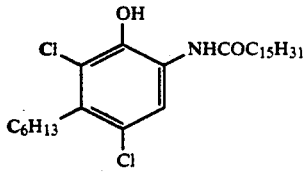
Ratio of x, y, z given by weight -continued
(C-40)
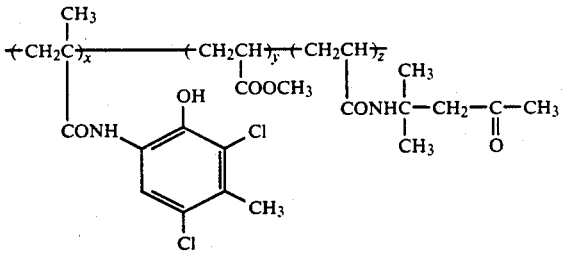
x/y/z = 50/20/30
(C-41)
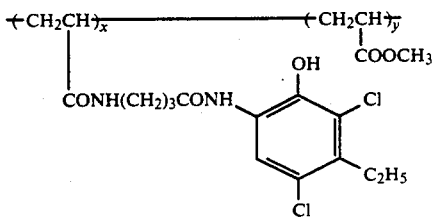
x/y = 55/45
(C-42)
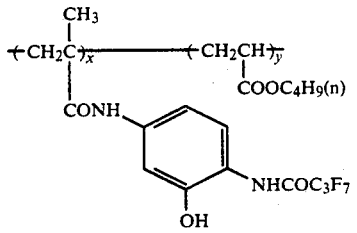
x/y = 60/40
(C-43)
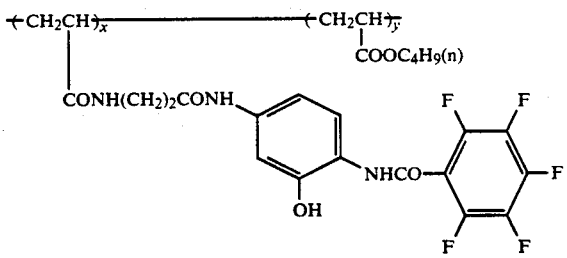
x/y = 50/50
(C-44)
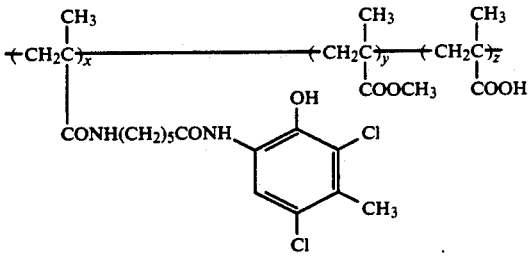
x/y/z = 55/40/5

-continued
(C-45)
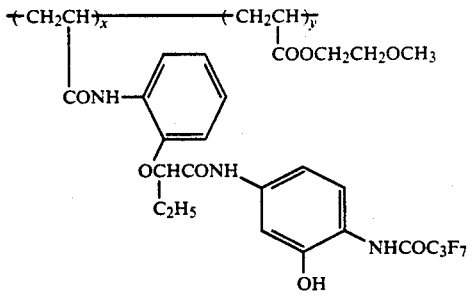
x/y = 60/40
(C-46)
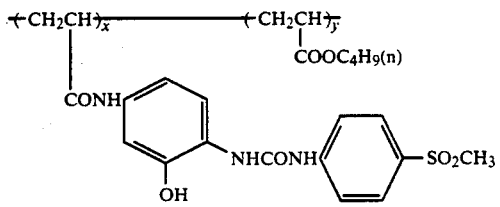
x/y = 50/50
(C-47)
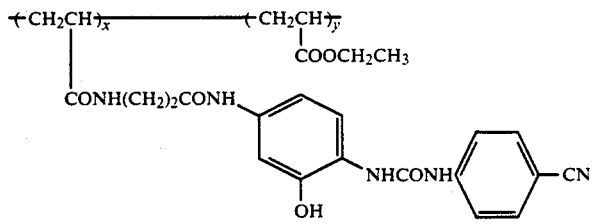
x/y = 45/55
(C-48)
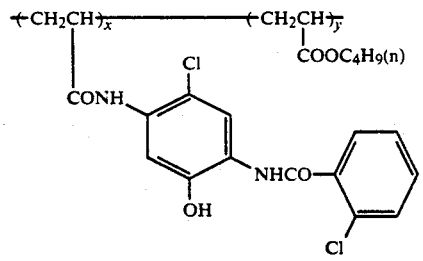
x/y = 50/50
(M-1)
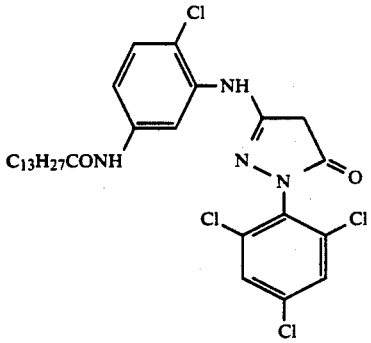

-continued
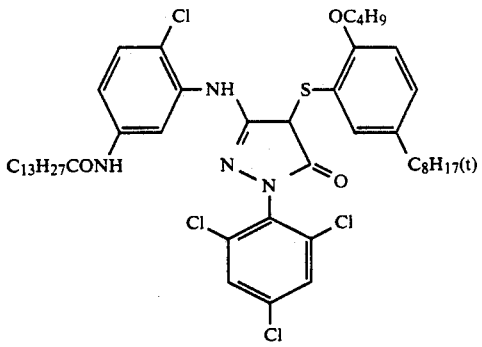
(M-2)
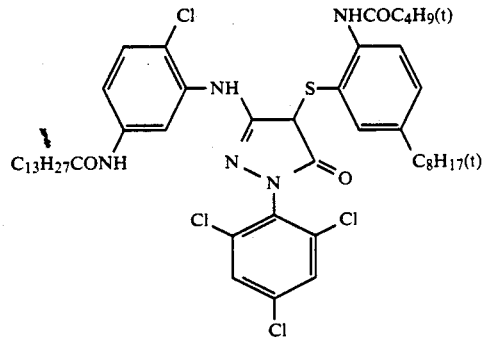
(M-3)
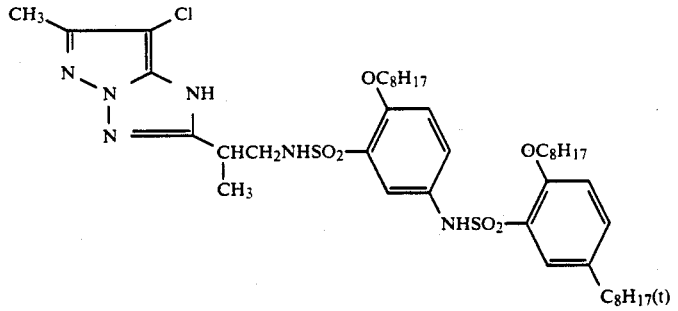
(M-4)
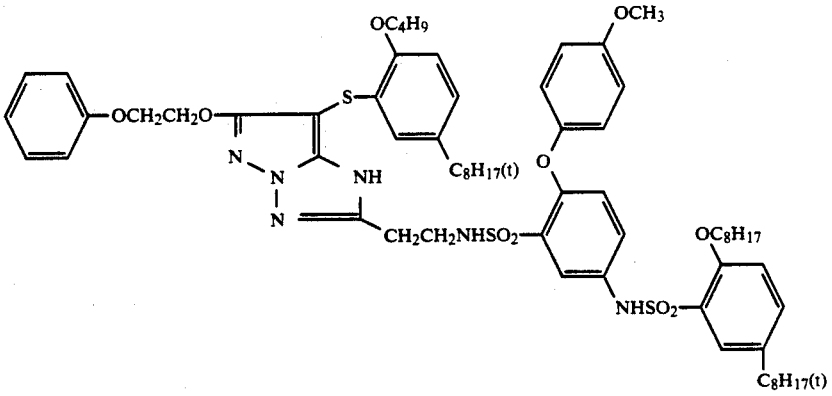
(M-5)

-continued
(M-6)
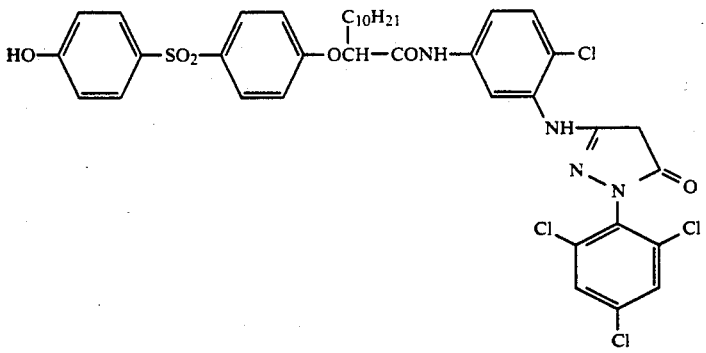
(M-7)
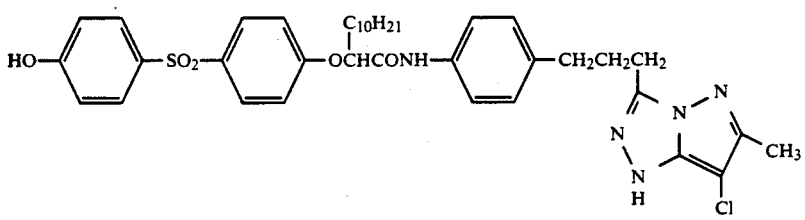
(M-8)
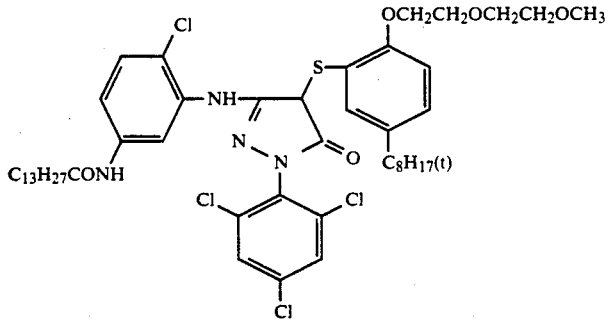
(M-9)
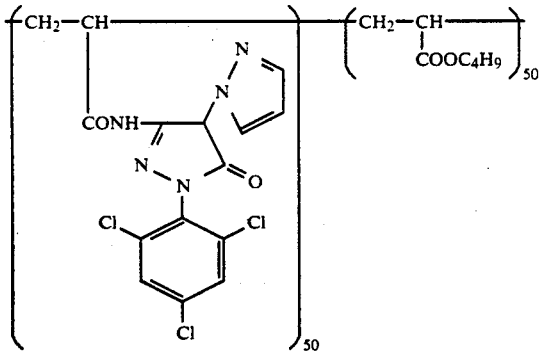
(M-10)
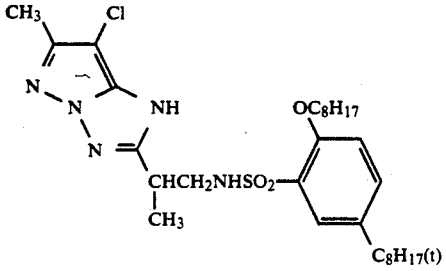

-continued
(M-11)
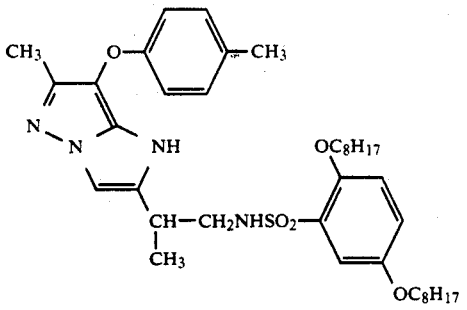
(M-12)
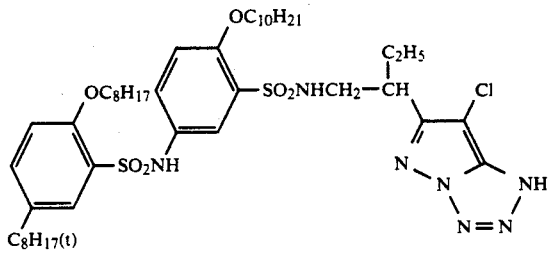
(M-13)
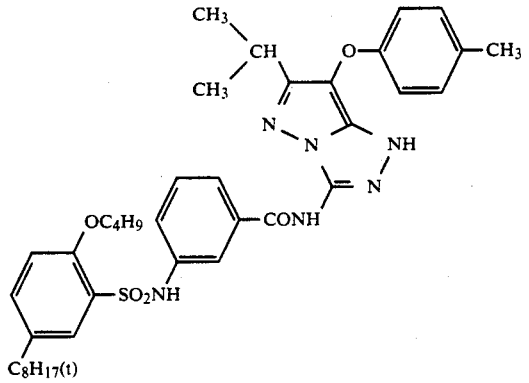
(M-14)
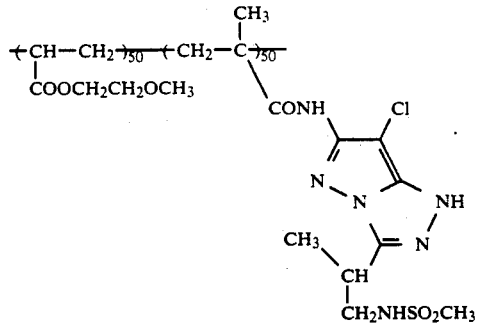
(M-15)
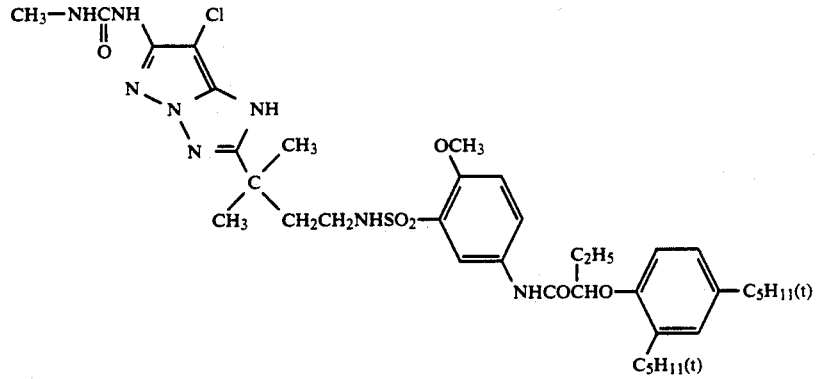

-continued
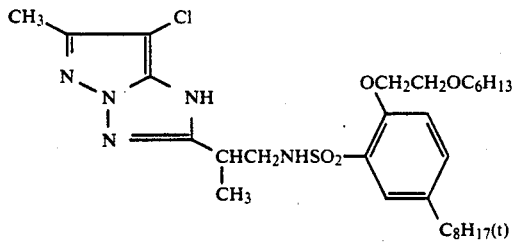
(M-16)
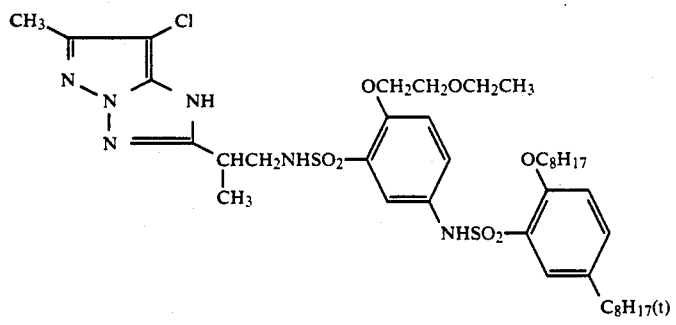
(M-17)
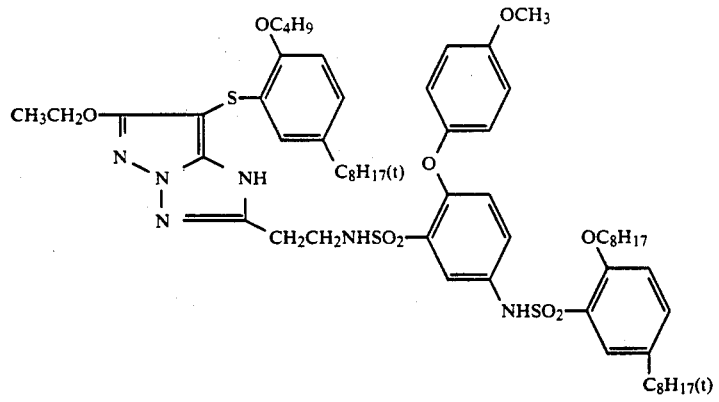
(M-18)
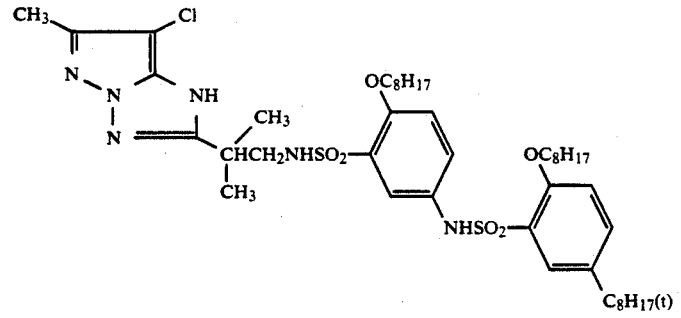
(M-19)

-continued
(M-20)
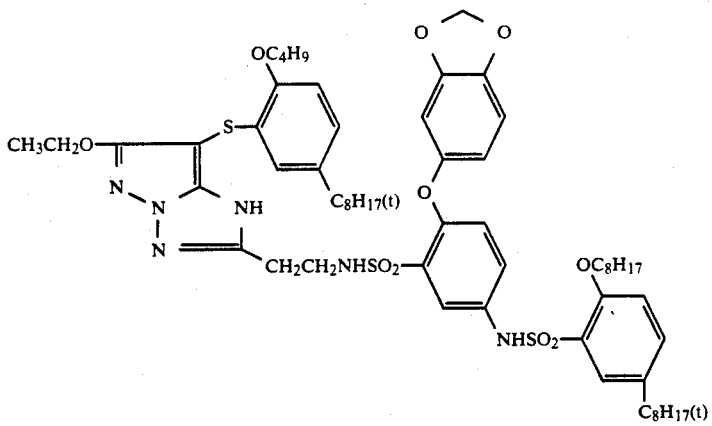
(M-21)
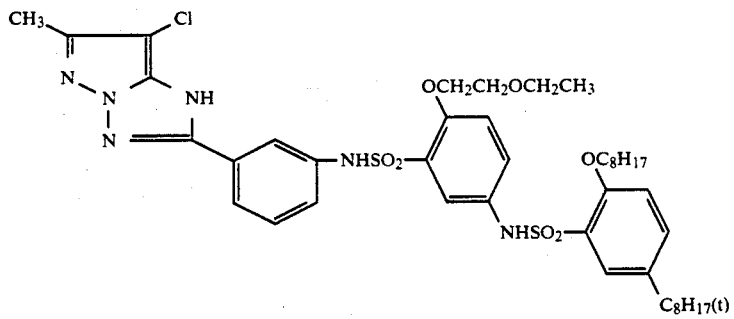
(M-22)
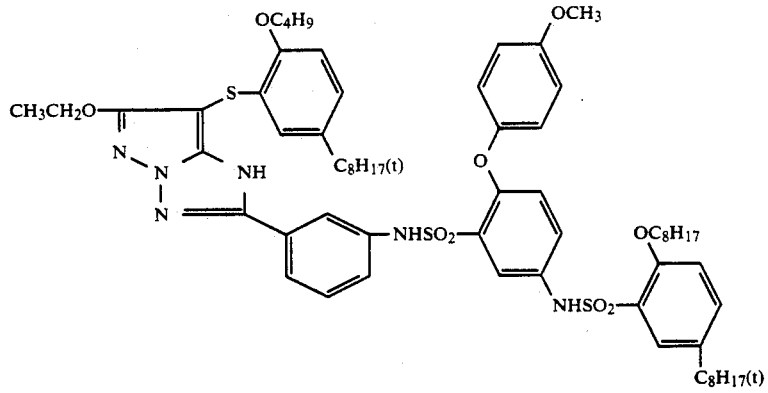
(M-23)
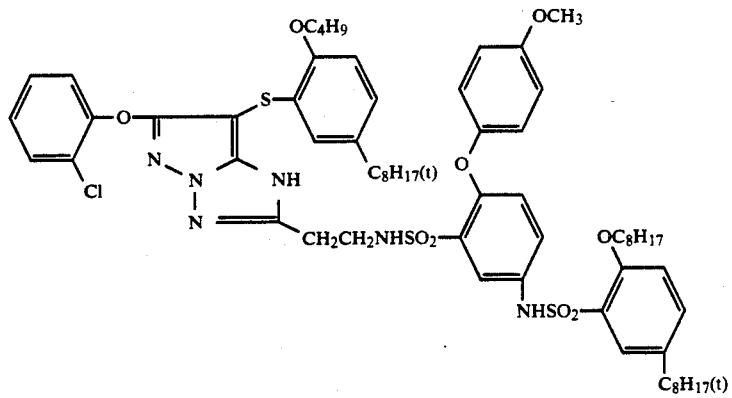

-continued
(M-24)
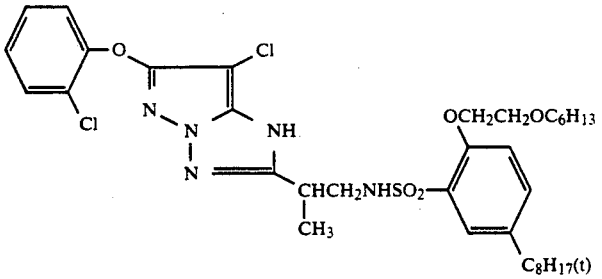
(M-25)
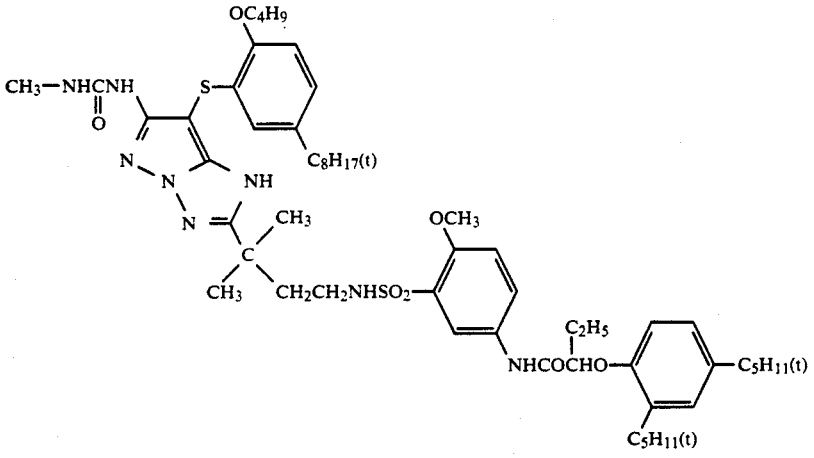
(M-26)
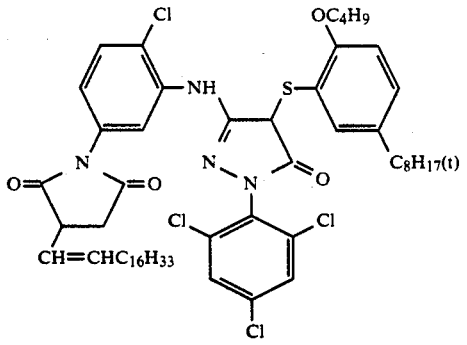
(Y-1)
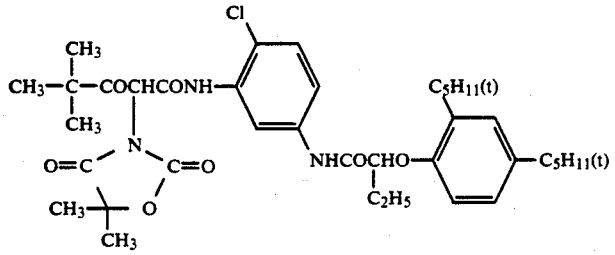

-continued
(Y-2)
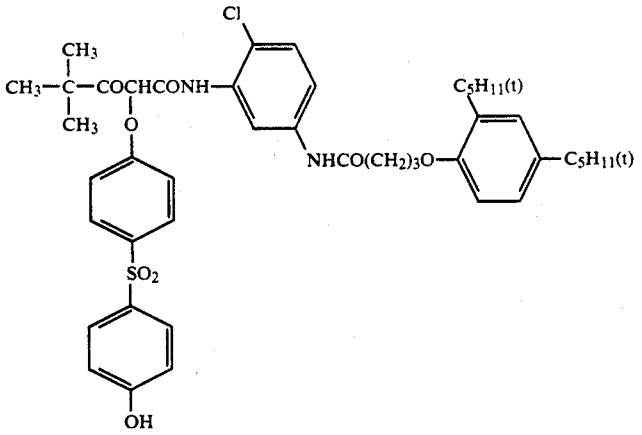
(Y-3)
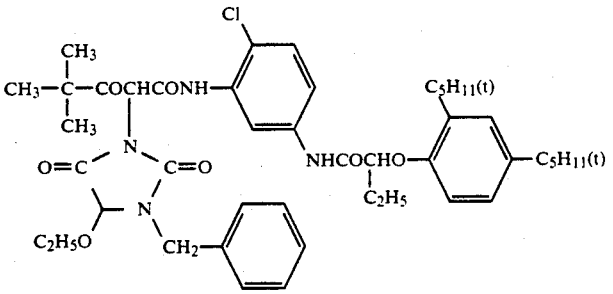
(Y-4)
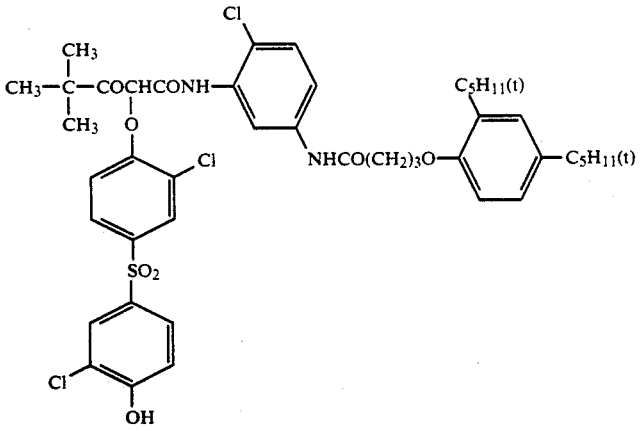
(Y-5)
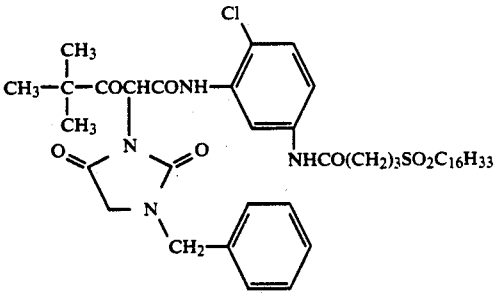

-continued
(Y-6)
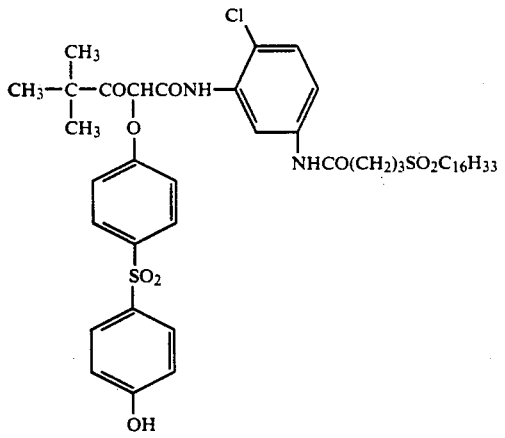
(Y-7)
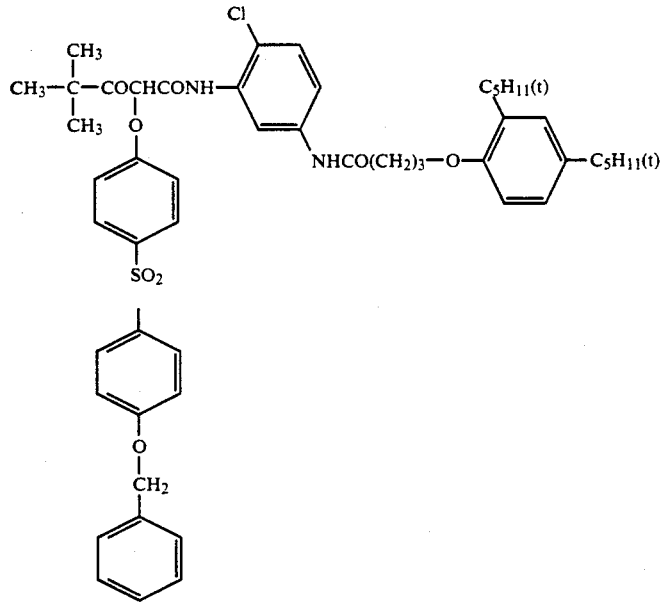
(Y-8)
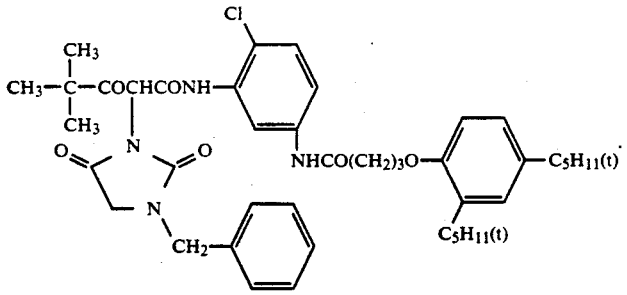
(Y-9)
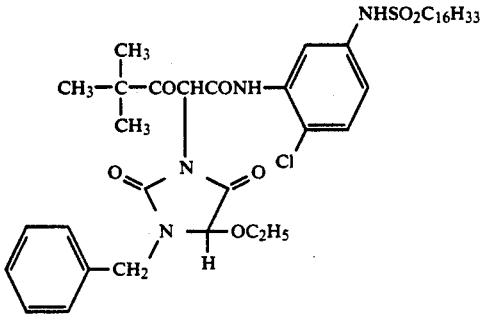

-continued (Y-10)

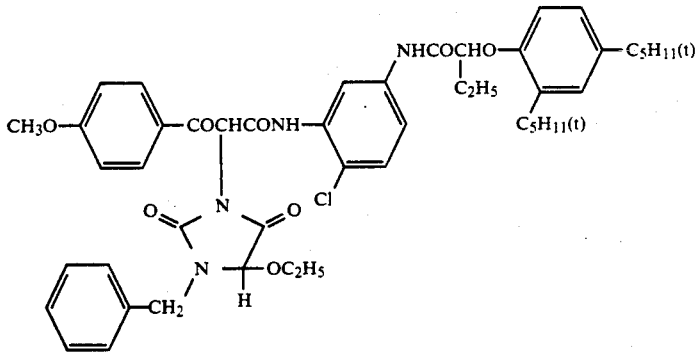

The following compounds can be used together with the above-noted couplers, for example, the pyrazoloazole couplers of the present invention.

Namely, compounds (A) and/or compounds (B) described below, alone or in combination can be used together with the couplers of the present invention, said compounds (A) being chemically bonded to aromatic amine developing agent remaining after color development to form a compound which is chemically inactive and substantially colorless; and said compounds (B) being chemically bonded to the oxidation product of the aromatic amine developing agent remaining after color development to form a compound which is chemically inactive and substantially colorless. For example, when said compounds (A) and/or said compounds (B) are used together with the couplers of the present invention, stain formation is prevented by the reaction of the couplers with the color developing agent or the oxidation product thereof remaining in the layers of the photographic material during storage after processing. Other side reactions may also be prevented.

The compound (A) preferably has a second-order reaction constant $k_2$ (in trioctyl phosphate at 80° C.)(in terms of the reaction with p-anisidine) of from 1.0 to $1\times10^{-5}$ l/mol.sec.

When $k_2$ is larger than the above-defined range, the compound (A) becomes unstable, are reacts with gelatin or water to decompose the same. When $k_2$ is smaller than the above-ddefined range, the reaction of the compounds with the remaining aromatic amine developing agent is retarded, and as a result, the side reaction (e.g. stain formation) of the remaining aromatic amine developing agent occurs.

Among the compounds (A), the following represented by the formulae (AI) or (AII) are preferred.

$$R_1-(A)_n-X \qquad \text{(AI)}$$

$$R_2-\underset{\underset{B}{|}}{C}=Y \qquad \text{(AII)}$$

In the above formulae, $R_1$ and $R_2$ each represent an aliphatic group, an aromatic group or a heterocyclic group; n represents 1 or 0; B represents a hydrogen atom, an aliphatic group, an aromatic group, a heterocyclic group, an acyl group or a sulfonyl group; Y is a group which accelerates the addition of the aromatic amine developing agent to the compound having the formula (AII); and $R_1$ and X, or Y and $R_2$ or B may be combined together to form a ring structure.

Typical examples of the reaction of the compounds (A) with the remaining aromatic amine developing agent to form a chemical bond, include a substitution reaction and addition reaction Each group of the compounds of the formula (AI) and (AII) are illustrated in detail below.

The aliphatic group represented by $R_1$, $R_2$ and B is a straight-chain branched or cyclic alkyl, alkenyl or alkinyl group. These groups may besubstituted. The aromatic group represented by $R_1$, $R_2$ and B is a carbon ring type aromatic group (e.g., phenyl, naphthyl) or a heterocyclic type aromatic group (e.g., furyl, thienyl, pyrazolyl, pyridyl, indolyl). These groups may be a monocyclic type or a condensed ring type (e.g., benzofuryl, phenanthridinyl). The aromatic ring of these groups may be substituted.

The heterocyclic group represented by $R_1$, $R_2$ and B is preferably a group having a 3-membered to 10-membered ring structure composed of carbon, oxygen, nitrogen, sulfur, and hydrogen. The heterocyclic ring itself may be a saturated ring or an unsaturated ring, or may be substituted (e.g., coumanyl, pyrrolidyl, pyrrolinyl, morpholinyl).

The group X of the formula (AI) is a group which is eliminated by the reaction with an aromatic amine developing agent, preferably a group attached to A through an oxygen atom, sulfur atom or nitrogen atom (e.g., 3-pyrazolyloxy group, 3H-1,2,4-oxadiazolin-5-oxy group, aryloxy group, alkoxy group, alkylthio group, arylthio group, substituted N-oxy group, etc.) or a halogen atom.

The group A of the formula (AI) is a group which forms a chemical bond by the reaction with an aromatic amine developing agent, and contains a group having a low electron density such as $$-L-\overset{\overset{Y}{\|}}{C}-,\ -L-\overset{\overset{Y}{\|}}{S}-,\ -L-\underset{\underset{Y}{\|}}{\overset{\overset{Y}{\|}}{S}}-,$$

$$-L-\underset{\underset{Y}{\|}}{\overset{\overset{Y}{\|}}{P}}-,\ -L-\underset{\underset{R''}{|}}{\overset{\overset{R'}{|}}{Si}}-.$$

When X is a halogen atom, n is 0. In the above formulae, L is a single bond, an alkylene group, —O—, $$-\underset{\underset{R'''}{|}}{N}-,\ -L'-\overset{\overset{Y}{\|}}{C}-L'',\ -L'-\overset{\overset{Y}{\|}}{S}-L'',\ \text{or}$$

-continued

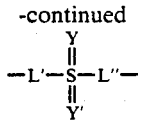

(e.g., carbonyl group, sulfonyl group, sulfinyl group, oxycarbonyl group, phosphonyl group, thiocarbonyl group. aminocarbonyl group, silylcarbonyl group, etc.).

Y has the same meaning as in the formula (AII) and Y' has the same meaning as Y.

R' and R'' may be the same or different groups and each is a group represented by —L'''—$R_0$.

$R_0$ has the same meaning as $R_1$. R''' is hydrogen atom, an aliphatic group (e.g., methyl, isobutyl, t-butyl, vinyl, benzyl, octadecyl, cyclohexyl, etc.), an aromatic group (e.g., phenyl, pyridyl, naphthyl, etc.), a heterocyclic group (e.g., piperidinyl, pyranyl, furanyl, chromanyl, etc.), an acyl group (e.g., acetyl, benzoyl, etc.) or a sulfonyl group (e.g., methanesulfonyl, benzenesulfonyl, etc.).

L', L'' and L''' are each —O—, —S— or

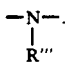

Among the groups represented by A, the divalent groups represented by

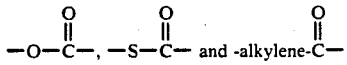

are preferred, where the group —alkylene— is an alkylene group as described above.

Y in the formula (AII) is preferably oxygen, sulfur, =N—$R_4$ or

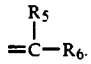

$R^4$, $R^5$ and $R^6$ each represent a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., peperidyl, pyranyl, furanyl, chromanyl), an acyl group (e.g., acetyl, benzoyl) or a sulfonyl group (e.g., methanesulfonyl, benzenesulfonyl). $R_5$ and $R_6$ may be combined together to form a ring structure.

The compounds (B) which are chemically bonded to the oxidation product of the aromatic amine developing agent remaining after color development, are preferably those compounds having a nucleophilic group derived from a nucleophilic group having a Pearson's $^nCH_3I$ value (R. G. Pearson et al., *J. Am. Chem. Soc.*, 90, 319 (1968)) of 5 or above.

Among the compounds (B), the following compounds represented by the following general formula (B') are preferred.

$$R_7—Z·M \qquad (B')$$

In the above formula, $R_7$ represents an aliphatic group, an aromatic group or a heterocyclic group; Z represents a nucleophilic group; M represents a hydrogen atom, a metal cation, ammonium cation or a protective group.

Each group of the compounds represented by the formula (B') is illustrated in detail below.

The aliphatic group represented by $R_7$ is a straight-chain, branched or cyclic alkyl, alkenyl or alkinyl group. These groups may be further substituted. The aromatic group represented by $R_7$ is a carbon ring type aromatic group (e.g., phenyl, naphthyl) or a heteocyclic type aromatic group (e.g., furyl, thienyl, pyrazolyl, pyridyl, indolyl). These groups may be a monocyclic type or a condensed ring type (e.g., benzofuryl, phenanthridinyl). The aromatic ring of these groups may be optionally substituted.

The heterocyclic group represented by $R_7$ is preferably a group having a 3-membered to 10-membered ring structure comprising carbon, oxygen, nitrogen, sulfur, and hydrogen. The heterocyclic ring itself may be a saturated ring and an unsaturated ring, or may be substituted (e.g., coumanyl, pyrrolidyl, pyrrolinyl, morpholinyl).

Z represents a nucleophilic group, for example, a nucleophilic group wherein an atom that which bonds directly to the oxidation product of the aromatic amine developing agent is oxygen, sulfur, or nitrogen atom (e.g., residues of amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carboxy compounds, hydroxamic acid compounds, active methylene compounds, phenolic compounds, nitrogen-containing heterocyclic compounds).

M represents a hydrogen atom, a metal cation, an ammonium cation or a protective group.

The compounds (B') are nucleophically reacted with the oxidation product of the aromatic amine developing agent typically, by a coupling reaction.

Among the compounds having the formula (B'), the following compounds represented by the general formula (B'') are most preferred.

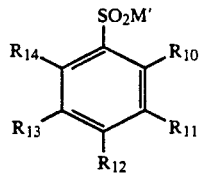

(B'')

In the above formula, M' is an atom which forms an inorganic salt (e.g., Li, Na, K, Ca, Mg, etc.) or an organic salt (e.g., triethylamine, methylamine, ammonia, etc.), an atomic group capable of forming an inorganic or organic salt, or a group of the formula

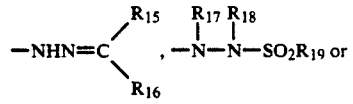

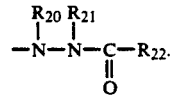

$R_{15}$ and $R_{16}$ may be the same or different, and each is a hydrogen atom, an aliphatic group, an aromatic group or a heterocyclic group (said aliphatic, aromatic and heterocyclic groups being the same as those set forth for $R_1$), or $R_{15}$ and $R_{16}$ may be combined together to form a 5-membered to 7-membered ring; $R_{17}$, $R_{18}$, $R_{20}$ and $R_{21}$ may be the same or different, and each is a hydrogen atom, an aliphatic group, an aromatic group, a heterocyclic group (said aliphatic, aromatic and heterocyclic groups being the same as those set forth for $R_7$), an acyl group, an alkoxycarbonyl group, a sulfonyl group, an ureido group or a urethane group with the proviso that at least one of $R_{17}$ and $R_{18}$, and at least one of $R_{20}$ and $R_{21}$ are hydrogen atoms; and $R_{19}$ and $R_{22}$ are each a hydrogen atom, an aliphatic group, an aromatic group or a heterocyclic group (said aliphatic, aromatic and heterocyclic groups being the same as those set forth for $R_7$), and $R_{22}$ may further be an alkylamino group, an arylamino group, an alkoxy group, an aryloxy group, an acyl group, an alkoxycarbonyl group or an aryloxycarbonyl group. At least two groups of $R_{17}$, $R_{18}$ and $R_{19}$ may be combined together to form a 5-membered to 7-membered ring. At least two groups of $R_{20}$, $R_{21}$ and $R_{22}$ may be combined together to form a 5-membered to 7-membered ring.

$R_{10}$, $R_{11}$, $R_{12}$, $R_{13}$ and $R_{14}$ may be the same or different, and each is a hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), a halogen atom (e.g., chlorine, bromine), $$-SR_8-,\ -OR_8,\ -OR_{26},\ -\underset{\underset{R_9}{|}}{N}-R_8,$$

an acyl group (e.g., acetyl, benzoyl), an alkoxycarbonyl (e.g., methoxycarbonyl, butoxycarbonyl, cyclohexylcarbonyl, octyloxycarbonyl), an aryloxycarbonyl group (e.g., phenyloxycarbonyl, naphthyloxycarbonyl), a sulfonyl group (e.g., methanesulfonyl, benzenesulfonyl), a sulfonamido group (e.g., methanesulfonamido, benzenesulfonamido), a sulfamoyl group, an ureido group, a urethane group, a carbamoyl group, a sulfo group, a carboxyl group, a nitro group, a cyano group, an alkoxyallyl group (e.g., methoxyallyl, isobutoxyallyl, octyloxyallyl, benzoyloxyallyl), an aryloxyallyl group (e.g., phenoxyallyl, naphthoxyallyl), a sulfonyloxy group (e.g., methanesulfonyloxy, benzenesulfonyloxy),$-P(R_8)_3$, $$-\overset{\overset{O}{\|}}{P}(R_8)_2,\ -\overset{\overset{S}{\|}}{P}(R_8)_2,$$

$-P(R_8)_3$ or a formyl group. $R_8$ and $R_9$ are each a hydrogen atom, an aliphatic group, an alkoxy group or an aromatic group. The $-SO_2M'$ groups having a total of Hammett's $\sigma$ values of 5 or more is preferred for enhancing the effect of the present invention.

Typical examples of the above-described compounds (A) and (B) include the following.

In addition to the compounds having the above-described formulae, the compounds described in JP-A 63-158545, JP-A-62-283338, Japanese Patent Application Nos. 62-158342 and 63-18439, European Patent Laid-Open No. 0,255,722, JP-A-62-143048, JP-A-62-229145, Japanese Patent Application Nos. 63-136724 and 62-214681 can also be used. Useful combinations of these compounds are described in European Patent Laid-Open No. 0,277,589.

(A-1)

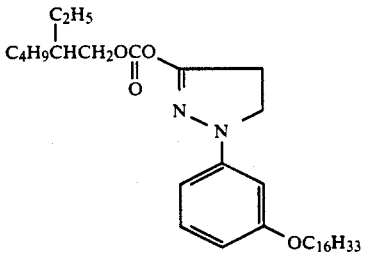

(A-2)

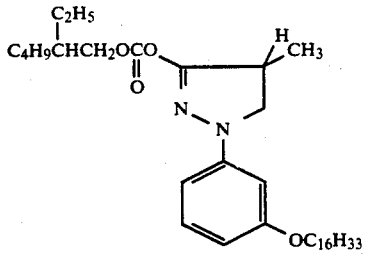

(A-3)

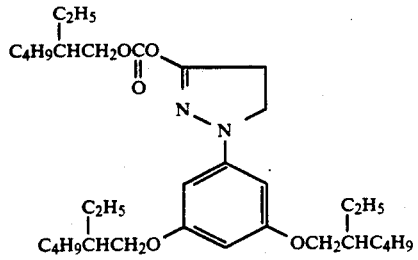

-continued
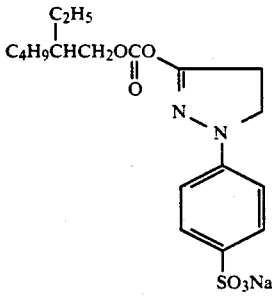
(A-4)
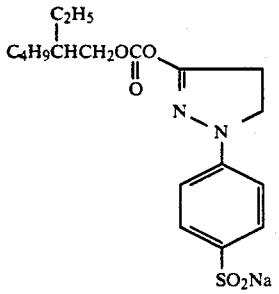
(A-5)
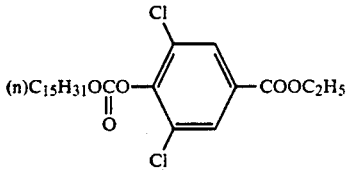
(A-6)
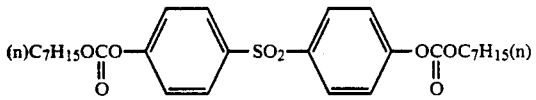
(A-7)
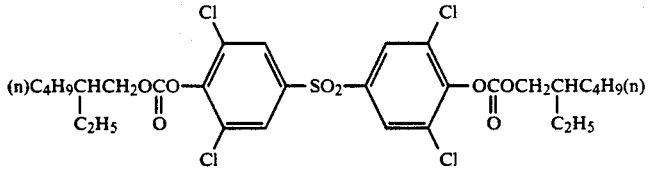
(A-8)
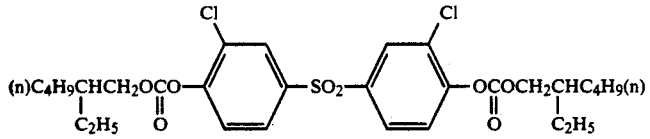
(A-9)
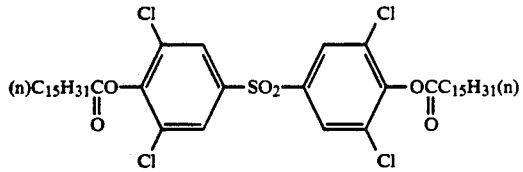
(A-10)
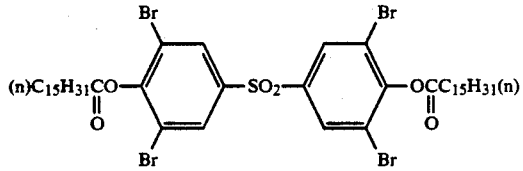
(A-11)

-continued
(A-12)
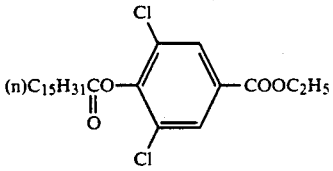
(A-13)
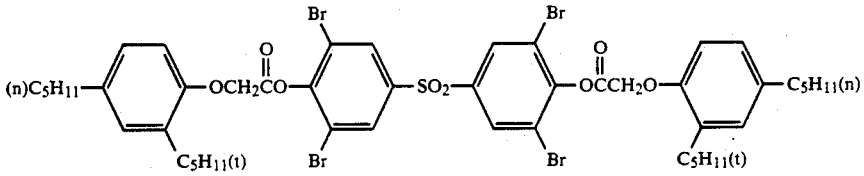
(A-14)
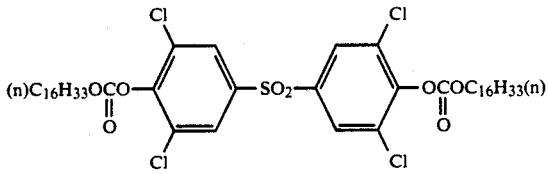
(A-15)
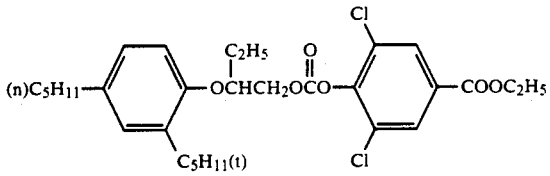
(A-16)
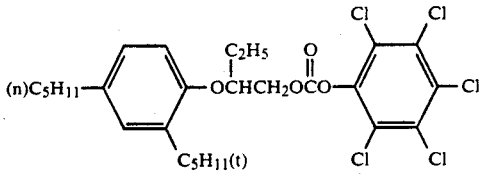
(A-17)
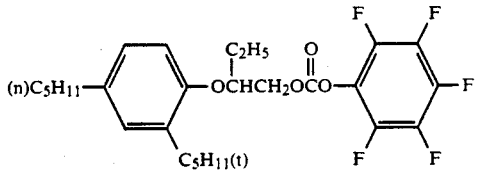
(A-18)
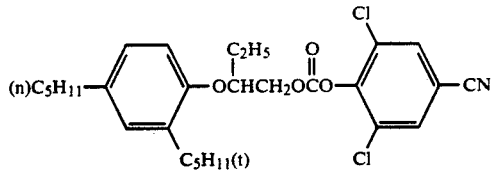
(A-19)
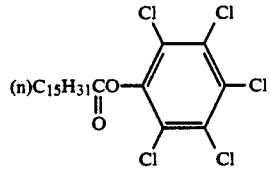
(A-20)
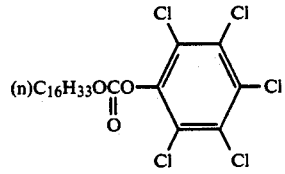

-continued
(A-21)
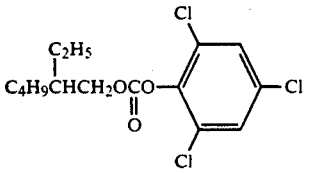
(A-22)
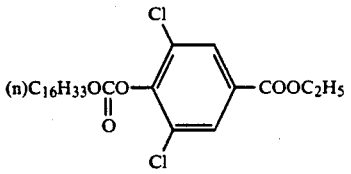
(A-23)
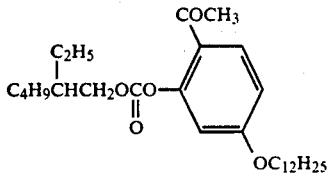
(A-24)
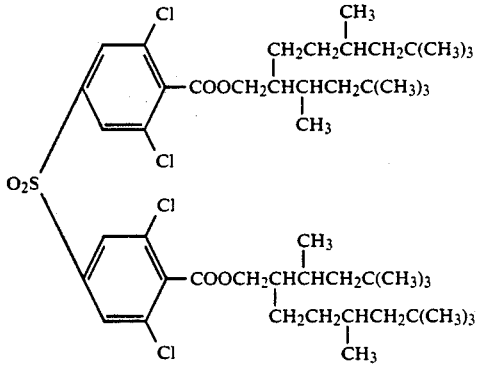
(A-25)
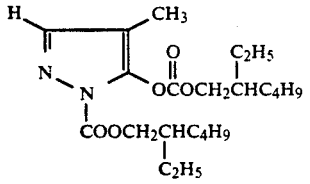
(A-26)
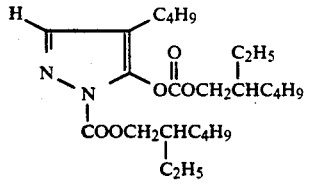
(A-27)
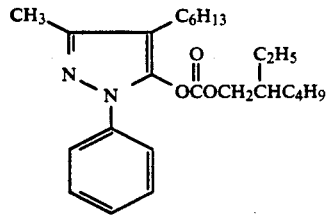
(A-28)
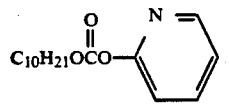

-continued
(A-29)
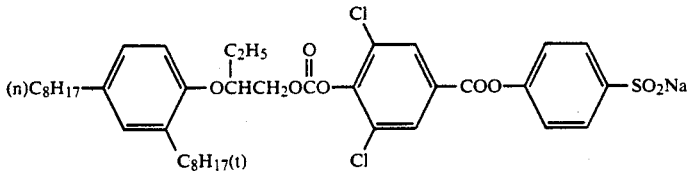
(A-30)
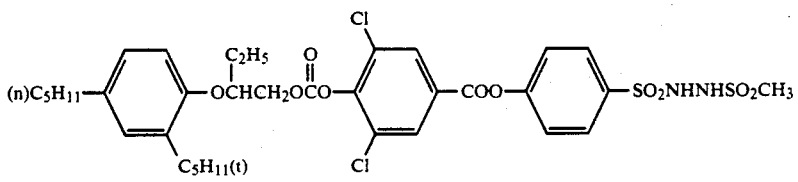
(B-1)
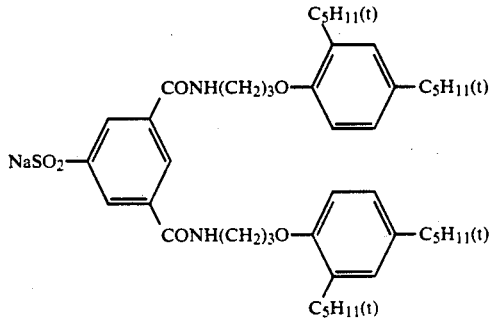
(B-2)
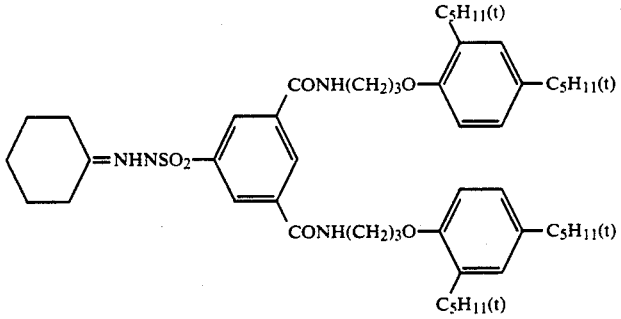
(B-3)
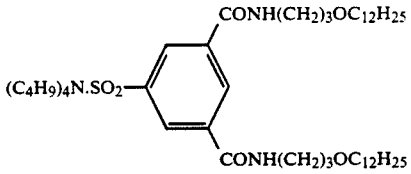
(B-4)
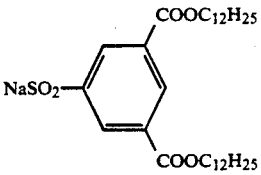
(B-5)
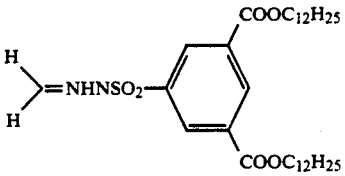

-continued
(B-6)
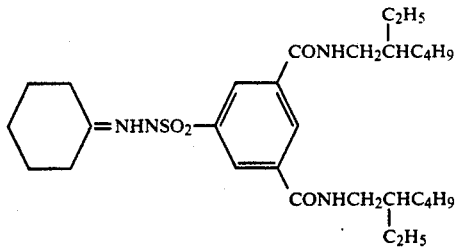
(B-7)
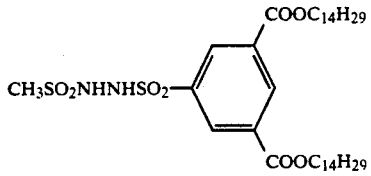
(B-8)
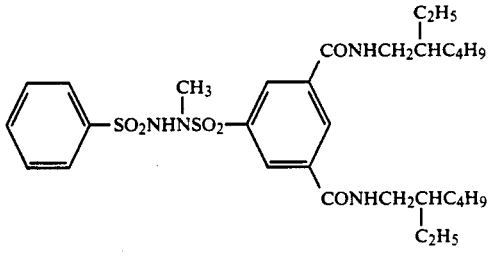
(B-9)
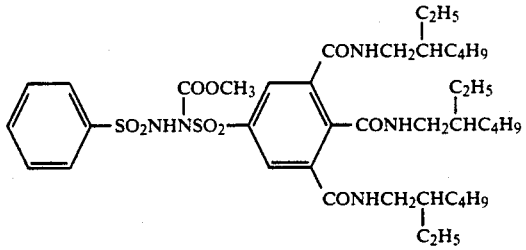
(B-10)
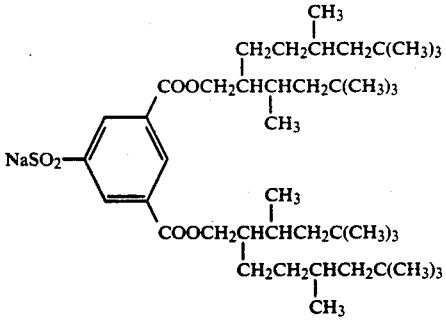
(B-11)
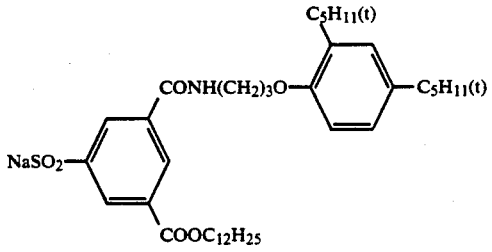

-continued (B-12)

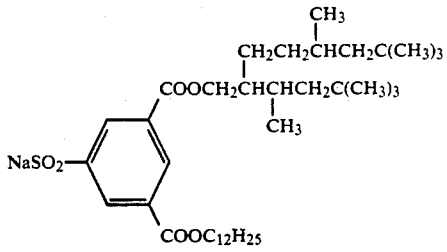

(B-13)

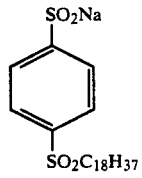

(B-14)

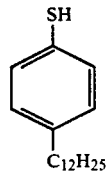

(B-15)

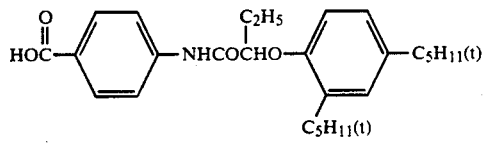

(B-16)

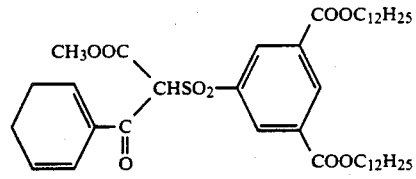

In the present invention, it is preferred that the above-described couplers are emulsified and dispersed together with the following polymers.

Any of water-insoluble, organic solvent-soluble polymers composed of at least one repeating unit and having no acid radical in the main chain thereof or on the side chains thereof, can be used as the polymer of the present invention. Polymers having a repeating unit with a —CO— linkage are preferred from the viewpoint of color formability and dye fastness. For example, when the polymers composed of monomers having an acid radical described in JP-A-55-65236 (at page 24 et seq.) are used, the improvement in dye fastness is greatly reduced, such that the use thereof is often not preferred. However, the polymers having an acid radical can be used in a lesser amount such that the improvement in dye fastness is not lost. Nonlimiting examples of the polymers for use in the present invention are illustrated in detail below.

Vinyl polymers can be used in the present invention. Examples of monomers which form the vinyl polymers include, firstly, acrylic esters such as methyl acrylate, ethyl acrylate, n-propyl acrylate, i-propyl acrylate, n-butyl acrylate, i-butyl acrylate, sec-butyl acrylate, t-butyl acrylate, amyl acrylate, hexyl acrylate, 2-ethylhexyl acrylate, octyl acrylate, t-octyl acrylate, 2-chloroethyl acrylate, 2-bromoethyl acrylate, 4-chlorobutyl acrylate, cyanoethyl acrylate, 2-acetoxyethyl acrylate, dimethylamino acrylate, benzyl acrylate, methoxybenzyl acrylate, cyclohexyl acrylate, 2-chlorocyclohexyl acrylate, furfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-i-propoxy acrylate, 2-butoxyethyl acrylate, 2-(2-methoxy-ethoxy)ethyl acrylate, 2-(2-butoxyethoxy)ethyl acrylate, 2-methoxypolyethylene glycol acrylate (9 mol addition), 1-bromo-2-methoxyethyl acrylate and 1,1-dichloro-2-ethoxyethyl acrylate; secondly, methacrylic esters such as methyl methacrylate, ethyl methacrylate, n-propyl methacrylate, i-propyl methacrylate, n-butyl methacrylate, i-butyl methacrylate, sec-butyl methacrylate, t-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-i-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoy)ethyl methacrylate, 2-methoxypolyethylene glycol methacrylate (addition: 6 mol), allyl methacrylate and dimethylaminoethyl methacrylate chloride salt of methacrylic acid; thirdly, vinyl esters such as vinyl acetate, vinyl propionate, vinyl butyrate, vinyl i-butyrate, vinyl caproate, vinyl chloroacetate, vinylmethoxy acetate, vinylphenyl acetate, vinyl benzoate and vinyl salicylate; fourthly, acrylamides such as acrylamide, methyl acrylamide, ethyl acrylamide, propyl acrylamide, butyl acrylamide, t-butyl acrylamide, cyclohexyl acrylamide, benzyl acrylamide, hydroxymethyl acrylamide, methoxyethyl acrylamide, dimethylaminoethyl acrylamide, phenyl acrylamide, dimethyl acrylamide, diethyl acrylamide, β-ciano-ethyl acrylamide, N-cyanoethyl acrylamide, N-(2-acetoacetoxyethyl)acrylamide and diacetone acrylamide; fifthly, methacrylamides such as methacrylamide, methyl methacrylamide, ethyl methacrylamide, propyl methacrylamide, butyl methacrylamide, t-butyl methacrylamide, cyclohexyl methacrylamide, benzyl methacrylamide, hydroxymethyl methacrylamide, methoxyethyl methacrylamide, dimethylaminoethyl methacrylamide, phenyl methacrylamide, dimethyl methacrylamide, diethyl methacrylamide, β-cyanoethyl methacrylamide and N-(2-acetoacetoxyethyl)methacrylamide; sixthly, olefins such as dicyclopentadiene, ethylene, propylene, 1-butene, 1-pentene, vinyl chloride, vinylidene chloride, isoprene, chloroprene, butadiene and 2,3-dimethylbutadiene; seventhly, styrenes such as styrene, methylstyrene, dimethylstyrene, trimethylstyrene, ethylstyrene, i-propylstyrene, chloromethylstyrene, methoxystyrene, acetoxystyrene, chlorostyrene, dichlorostyrene, bromostyrene and methyl vinylbenzoate; eighthly vinyl ethers such as methyl vinyl ether, butyl vinyl ether, hexyl vinyl ether, methoxyethyl vinyl ether and dimethylaminoethyl vinyl ether; and, in addition, butyl crotonate hexyl crotonate, dimethyl itaconate, dibutyl itaconate, diethyl maleate, dimethyl maleate, dibutyl maleate, diethyl fumarate, methyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylenemalononitrile and vinylidene monomers.

The homopolymers of above-listed monomers, the copolymers of two or more of the monomers and mixtures thereof can be used depending on the intended purpose for example, improving the solubility of the couplers and color forming properties, adjusting the qualities of the coated photographic layers, improving dye fastness, preventing the couplers and other additives in the photographic material layers from being precipitated, etc.

In addition to the copolymers of two or more of the above-described monomers, the copolymers of these monomers with the following monomers having an acid radical as comonomers may be used, as long as the comonomers are used in such an amount that the resulting copolymers are not made water-soluble.

Examples of such monomers include acrylic acid, methacrylic acid, itaconic acid, maleic acid, monoalkyl itaconates (e.g., monomethyl itaconate, monoethyl itaconate, monobutyl itaconate), monoalkyl maleates (e.g., monomethyl maleate, monoethyl maleate, monobutyl maleate), citraconic acid, styrenesulfonic acid, vinylbenzylsulfonic acid, vinylsulfonic acid, acryloyloxyalkylsulfonic acids (e.g., acryloyloxymethylsulfonic acid, acryloyloxypropylsulfonic acid, methacryloyloxyalkylsulfonic acids (e.g., methacryloyloxymethylsulfonic acid, methacryloyloxyethylsulfonic acid, methacryloyloxypropylsulfonic acid), acrylamidoalkylsulfonic acids (e.g., 2-acrylamido-2-methylethanesulfonic acid, 2-acrylamido-2-methylpropanesulfonic acid, 2-acrylamido-2-methylbutanesulfonic acid) and methacrylamidoalkyl sulfonic acids (e.g., 2-methacrylamido-2-methylethanesulfonic acid, 2-methacrylamido-2-methylpropanesulfonic acid, 2-methacrylamido-2-methylbutanesulfonic acid). These acids may be in the form of a salt such as an alkali metal (e.g., Na, K) ion or ammonium ion.

When the above-described hydrophilic monomers, whose homopolymers are water-soluble, are used as the comonomers, there are no particular limitations with regard to the ratio of the vinyl monomers to the comonomer, as long as the resulting copolymers are not made water-soluble. However, the amounts of the comonomers to be used are generally, not more than 40 mol %, preferably not more than 20 mol %, more preferably not more than 10 mol %. When the hydrophilic monomers to be copolymerized have an acid radical, the ratio of the monomer having an acid radical in the copolymer is generally not more than 20 mol %, and preferably not more than 10 mol % with regard to image preservability. The polymer of the present invention most preferably does not contain a component having an acid group.

Preferred polymers for use in the present invention are those derived from methacrylate monomers, acrylamide monomers and methacrylamido monomers. Polymers derived from the acrylamide monomers are particularly preferred.

In addition to the above-described vinyl polymers, polyester resins obtained by condensing a polyhydric alcohol with a polybasic acid can be used.

Glycols having a structure of $HO—R_1—OH$ (wherein $R_1$ is a hydrocarbon chain, and particularly an aliphatic hydrocarbon chain having from 2 to 12 carbon atoms) or polyalkylene glycols can be used as the polyhydric alcohol. Acids having a structure of $HOOC—R_2—COOH$ (wherein $R_2$ is monovalent or a hydrocarbon chain having from 1 to 12 carbon atoms) can be used as the polybasic acid.

Examples of useful polyhydric alcohols include ethylene glycol, diethylene glycol, triethylene glycol, 1,2-propylene glycol, 1,3-propylene glycol, trimethylol propane, 1,4-butanediol, i-butylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,4-diol, glycerine, diglycerol, triglycerol, 1-methylglycerol, erythrite, mannitol and sorbitol.

Examples of useful polybasic acids include oxalic acid, succinic acid, glutaric acid, adipic acid, pimelic acid, cork acid, azelaic acid, sebacic acid, nonanedicarboxylic acid, decanedicarboxylic acid, an decanedicarboxylic acid, dodecanedicarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct and rosin-maleic anhydride adduct.

Other polymers for use in the present invention include polyesters having the following repeating unit obtained by ring opening polymerization.

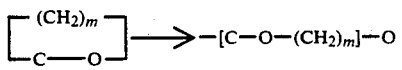

In the above formula, m is an integer of 4 to 7, and the $—CH_2—$ chain may be a branched chain Examples of monomers for use in the preparation of the above-described polyesters include β-propionlactone, ξ-caprolactone and dimethyl propionlactone.

When the polymers used in the present invention have a specified minimum molecular weight or higher molecular weight and a corresponding minimum degree of polymerization or higher, a substantially constant dye image preservability is obtained. However, when the molecular weight of the polymer is too high, it takes a long time to dissolve the polymer in the high-boiling organic solvent or co-solvent, and the resulting polymer solution has a high viscosity. Hence, it is difficult to emulsify the dispersion, and coarse particles are formed to thereby lower the color forming properties. Accordingly, the molecular weight of the polymer for use in the present invention, is preferably not more than 1,000,000, but not less than 2,000, more preferably not more than 400,000, but not less than 5,000, and particularly preferably not more than 150,000, but not less than 10,000.

The ratio of polymer to solvent in the preparation of the emulsified dispersion containing the polymer of the present invention depends on the type and molecular weight of the polymer to be used. The ratio is varied depending on the solubility of the polymer in the co-solvent and the solubility of the couplers. Generally, the co-solvent is used in such an amount to provide an appropriate viscosity such that at least the the coupler, the high-boiling organic solvent and the polymer are dissolved in the co-solvent and the resulting solution is readily dispersed in water or a hydrophilic solution. The viscosity of the solution is increased with an increase in the degree of polymerization of the polymer. Accordingly, it is difficult to generally specify the ratio of the polymer to the co-solvent without further taking into account the type of polymer and coupler or high-boiling organic solvent. However, the weight ratio is typically in the range of from 1:0.2 to 1:50, preferably 1:0.1 to 1:10, and most preferably 1:0.02 to 1:20.

In the present invention, the above-described polymers are preferably used together with the above-described cyan couplers and yellow couplers in particular. Preferable ratio of coupler/polymer is 1/0.05 to 1/20, with being more preferably 1/0.02 to 1/10. The polymers are preferably used together with the pyrazoloazole magenta couplers.

Examples of the polymers for use in the present invention include, but are not limited to, the following polymers.

(P-1) Poly(vinyl acetate)
(P-2) Poly(vinyl propionate)
(P-3) Poly(methyl methacrylate)
(P-4) Poly(ethyl methacrylate)
(P-5) Poly(ethyl acrylate)
(P-6) Poly(heptyl acrylate)
(P-7) Poly(butyl acrylate)
(P-8) Poly(butyl methacrylate)
(P-9) Poly(isobutyl methacrylate)
(P-10) Poly(isopropyl methacrylate)
(P-11) Poly(octyl acrylate)
(P-12) Poly(hexadecyl acrylate)
(P-13) Poly(hexyl acrylate)
(P-14) Poly(isobutyl acrylate)
(P-15) Poly(isopropyl acrylate)
(P-16) Poly(3-methoxybutyl acrylate)
(P-17) Poly(2-methoxycarbonylphenyl acrylate)
(P-18) Poly(3-methoxycarbonylphenyl acrylate)
(P-19) Poly(4-methoxycarbonylphenyl acrylate)
(P-20) Poly(2-methoxyethyl acrylate)
(P-21) Poly(4-methoxyphenyl acrylate)
(P-22) Poly(3-methoxypropyl acrylate)
(P-23) Poly(methyl acrylate)
(P-24) Poly(3,5-dimethyladamantyl acrylate)
(P-25) Poly(3-dimethylaminophenyl acrylate)
(P-26) Poly(2-cyanomethylphenyl methacrylate)
(P-27) Poly(4-cyanophenyl methacrylate)
(P-28) Poly(decyl methacrylate)
(P-29) Poly(dodecyl methacrylate)
(P-30) Poly(diethylaminoethyl methacrylate)
(P-31) Poly(ethyl methacrylate)
(P-32) Poly(2-ethylsulfinylethyl methacrylate)
(P-33) Poly(hexadecyl methacrylate)
(P-34) Poly(hexyl methacrylate)
(P-35) Poly(2-hydroxypropyl methacrylate)
(P-36) Poly(4-methoxycarbonylphenyl methacrylate)
(P-37) Poly(3,5-dimethyladamantyl methacrylate)
(P-38) Poly(dimethylaminoethyl methacrylate)
(P-39) Poly(3,3-dimethylbutyl methacrylate)
(P-40) Poly(3,3-dimethyl-2-butyl methacrylate)
(P-41) Poly(3,5,5-trimethylhexyl methacrylate)
(P-42) Poly(octadecyl methacrylate)
(P-43) Poly(tetradecyl methacrylate)
(P-44) Poly(pentyl acrylate)
(P-45) Poly(4-butoxycarbonylphenyl methacrylamide)
(P-46) Poly(pentyl methacrylate)
(P-47) Poly(4-carboxyphenyl methacrylamide)
(P-48) Poly(4-ethoxycarbonylphenyl methacrylamide)
(P-49) Poly(4-methoxycarbonylphenyl methacrylamide)
(P-50) Poly(butylbutoxycarbonyl methacrylate)
(P-51) Poly(butyl chloroacrylate)
(P-52) Poly(butyl cyanoacrylate)
(P-53) Poly(cyclohexyl chloroacrylate)
(P-54) Poly(ethyl chloroacrylate)
(P-55) Poly(ethylethoxycarbonyl methacrylate)
(P-56) Poly(N-sec-butyl acrylamide)
(P-57) Poly(N-tert-butyl acrylamide)
(P-58) Poly(ethyl ethacrylate)
(P-59) Poly(cyclohexyl methacrylate)
(P-60) Poly(ethyl fluoromethacrylate)
(P-61) Poly(hexylhexyloxycarbonyl methacrylate)
(P-62) Poly(t-butyl methacrylate)
(P-63) Poly(isobutyl chloroacrylate)
(P-64) Poly(N-tert-butyl methacrylamide)
(P-65) Poly(isopropyl chloroacrylate)
(P-66) Poly(methyl chloroacrylate)
(P-67) Poly(methyl fluoroacrylate)
(P-68) Poly(methyl fluoromethacrylate)
(P-69) Poly(methyl phenylacrylate)
(P-70) Poly(benzyl acrylate)
(P-71) Poly(4-biphenyl acrylate)
(P-72) Poly(4-butoxycarbonylphenyl acrylate)
(P-73) Poly(sec-butyl acrylate)
(P-74) Poly(t-butyl acrylate)
(P-75) Poly(2-t-butylphenyl acrylate)
(P-76) Poly(4-t-butylphenyl acrylate)

(P-77) Poly[3-chloro-2,2-bis(chloromethyl)propyl acrylate]
(P-78) Poly(2-chlorophenyl acrylate)
(P-79) Poly(4-chlorophenyl acrylate)
(P-80) Poly(pentachlorophenyl acrylate)
(P-81) Poly(4-cyanobenzyl acrylate)
(P-82) Poly(cyanoethyl acrylate)
(P-83) Poly(4-cyanophenyl acrylate)
(P-84) Poly(4-cyano-3-butyl acrylate)
(P-85) Poly(cyclohexyl acrylate)
(P-86) Poly(2-ethoxycarbonylphenyl acrylate)
(P-87) Poly(3-ethoxycarbonylphenyl acrylate)
(P-88) Poly(4-ethoxycarbonylphenyl acrylate)
(P-89) Poly(2-ethoxyethyl acrylate)
(P-90) Poly(3-ethoxypropyl acrylate)
(P-91) Poly(1H,1H,5H-octafluoropentyl acrylate)
(P-92) Poly(propyl chloroacrylate)
(P-93) Poly(2-methylbutyl acrylate)
(P-94) Poly(3-methylbutyl acrylate)
(P-95) Poly(1,3-dimethylbutyl acrylate)
(P-96) Poly(2-methylpentyl acrylate)
(P-97) Poly(2-naphthyl acrylate)
(P-98) Poly(phenyl acrylate)
(P-99) Poly(propyl acrylate)
(P-101) Poly(o-tolyl acrylate)
(P-102) Poly(p-tolyl acrylate)
(P-103) Poly(N-butyl acrylamide)
(P-104) Poly(N,N-dibutyl acrylamide)
(P-105) Poly(N-isohexyl acrylamide)
(P-106) Poly(N-isooctyl acrylamide)
(P-107) Poly(N-methyl-N-phenyl acrylamide)
(P-108) Poly(adamantyl methacrylate)
(P-109) Poly(benzyl methacrylate)
(P-110) Poly(2-bromoethyl methacrylate)
(P-111) Poly(2-N-t-butylaminoethyl methacrylate)
(P-112) Poly(sec-butyl methacrylate)
(P-113) Poly(2-chloroethyl methacrylate)
(P-114) Poly(2-cyanoethyl methacrylate)
(P-115) 1,4-Butanediol-adipic acid polyester
(P-116) Ethylene glycol-sebacic acid polyester
(P-117) Polycaprolactone
(P-118) Polypropiolactone
(P-119) Polydimethylpropiolactone
(P-120) Vinyl acetate-vinyl alcohol copolymer (95:5)
(P-121) Butyl acrylate-acrylamide copolymer (95:5)
(P-122) Stearyl methacrylate-acrylic acid copolymer (90:10)
(P-123 Butyl methacrylate-N-vinyl-2-pyrrolidone copolymer (90:10)
(P-124) Methyl methacrylate-vinyl chloride copolymer (70:30)
(P-125) Methyl methacrylate-styrene copolymer (90:10)
(P-126) Methyl methacrylate-ethyl acrylate copolyjmer (50:50)
(P-127) Butyl methacrylate-methyl methacrylate-styrene copolymer (50:30:20)
(P-128) Vinyl acetate-acrylamide copolymer (85:15)
(P-129) Vinyl chloride-vinyl acetate copolymer (65:35)
(P-130) Methyl methacrylate-acrylonitrile copolymer (65:35)
(P-131) Diacetone acrylamide-methyl methacrylate copolymer (50:50)
(P-132) Methyl vinyl ketone-isobutyl methacrylate copolymer (55:45)
(P-133) Ethyl methacrylate-butyl acrylate copolymer (70:30)
(P-134) Diacetone acrylamide-butyl acrylate copolymer (60:40)
(P-135) Methyl methacrylate-styrene methylmethacrylate-diacetone acrylamide copolymer (40:40:20)
(P-136) Butyl acrylate-styrene methacrylate-diacetone acrylamide copolymer (70:20:10)
(P-137) Stearyl methacrylate-methyl methacrylate-acrylic acid copolymer (50:40:10)
(P-138) Methyl methacrylate-styrene-vinyl sulfonamide copolymer (70:20:10)
(P-139) Methyl methacrylate-phenyl vinyl ketone copolymer (70:30)
(P-140) Butyl acrylate-methyl methacrylate-butyl methacrylate copolymer (35:35:30)
(P-141) Butyl methacrylate-pentyl methacrylate-N vinyl-2-pyrrolidone copolymer (38:38:24)
(P-142) Methyl methacrylate-butyl methacrylate-isobutyl methacrylate-acrylic acid copolymer (37:29:25:9)
(P-144) Methyl methacrylate-acrylic acid copolymer (95:5)
(P-145) Benzyl methacrylate-acrylic acid copolymer (90:10)
(P-146) Butyl methacrylate-methyl methacrylate-benzyl methacrylate-acrylic acid copolymer (35:35:25:5)
(P-147) Butyl methacrylate-methyl methacrylate-benzyl methacrylate copolymer (35:30:35)
(P-148) Cyclohexyl methacrylate-methyl methacrylate-propyl methacrylate copolymer (37:29:34)
(P-149) Methyl methacrylate-butyl methacrylate copolymer (65:35)
(P-150) Vinyl acetate-vinyl propionate copolymer (75:25)
(P-151) Butyl methacrylate-sodium-3-acryloxybutane-1-sulfonate copolymer (97:3)
(P-152) Butyl methacrylate-methyl methacrylate-acrylamide copolymer (35:35:30)
(P-153) Butyl methacrylate-methyl methacrylate-vinyl chloride copolymer (37:36:27)
(P-154) Butyl methacrylate-styrene copolymer (90:10)
(P-155) Methyl methacrylate-N-vinyl-2-pyrrolidone copolymer (90:10)
(P-156) Butyl methacrylate-vinyl chloride copolymer (90:10)
(P-157) Butyl methacrylate-styrene copolymer (70:30)
(P-158) Diacetone acrylamide-methyl methacrylate copolymer (62:38)
(P-159) N-t-butyl acrylamide-methyl methacrylate copolymer (40:60)
(P-160) t-Butyl methacrylate-methyl methacrylate copolymer (70:30)
(P-161) N-t-Butyl acrylamide-methyl phenylmethacrylate copolymer (60:40)
(P-162) Methyl methcarylate-acrylonitrile copolymer (70:30)
(P-163) Methyl methacrylate-methyl vinyl ketone copolymer (38:72)
(P-164) Methyl methacrylate-styrene copolymer (75:25)
(P-165) Methyl methacrylate-hexyl methacrylate copolymer (70:30)
(P-166) N-Methyl-N-benzyl acrylamide-butyl acrylate-dibutyl fumarate copolymer (55:35:10)
(P-167) Poly[N-(1,1-dimethyl-3-oxobutyl acrylamide]
(P-168) Poly(N-octyl methacrylamide)
(P-169) N,N-Diethyl acrylamide-butyl acrylate copolymer (40:60)
(P-170) N,N-Diethylacrylamide-2-butoxyethyl acrylate copolymer (65:35)
(P-171) N-t-Butyl acrylamide-butyl acrylate copolymer (60:40)

(P-172) N-t-Octyl acrylamide-2-ethylhexyl acrylate copolymer (65:35)
(P-173) N,N-Dibutyl acrylamide-dibutyl maleate copolymer (75:25)
(P-174) N-(1,1-Dimethyl-3-oxobutyl)acrylamide-butyl acrylate copolymer (55:45)
(P-175) N-(1,1-Dimethyl-3-oxobutyl)acrylamide-butyl acrylate copolymer (70:30)
(P-176) N-t-Butyl acrylamide-butyl acrylate copolymer (45:55)
(P-177) N-Octyl-N-ethylacrylamide-ethyl acrylate copolymer (45:55)
(P-178) N-Butyl methacrylamide-2-ethylhexyl acrylate copolymer (90:10)
(P-179) N,N-Dibutyl acrylamide-propyl acrylate copolymer (80:20)
(P-180) N-(2-Phenylethyl)acrylamide-butyl acrylate copolymer (25:75)
(P-181) N-Acryloylmorpholine-2-ethoxyethyl acrylate copolymer (40:60)
(P-182) N-Methyl-N'-acryloylpiperazine butyl acrylate copolymer (15:85)
(P-183) N-Acryloylpiperidine-2-butoxyethyl acrylate copolymer (40:60)
(P-184) N-(1,1-Dimethyl-3-hydroxybutyl)acrylamide-2-ethylhexyl methacrylate copolymer (75:25)
(P-185) N Acryloylpiperidine-butyl acrylate copolymer (50:50)
(P-186) N-(p-Hydroxyphenyl)acrylamide butyl acrylate copolymer (25:75)
(P-187) N-[3-(Dimethylamino)propyl]acrylamide-butyl acrylate copolymer (35:65)
(P-188) N-Methyl-N'-methacryloylpiperazine 2-ethoxyethyl acrylate copolymer (40:60)
(P-189) 2,6-Dimethyl-4-methacryloylmorpholine-butyl acrylate copolymer (55:45)
(P-190) N-t-Butylacrylamide-butyl acrylate-2-ethoxyethyl acrylate copolymer (55:25:20)
(P-191) N-(1,1-Dimethyl-3-oxobutyl)acrylamide-butyl acrylate-N,N diethyl acrylamide copolymer (30:50:20)
(P-192) N-Methyl-N'-methacryloylpiperazine 2-ethoxybutyl acrylate-ethyl acrylate copolymer (30:40:30)
(P-193) 1,6-Hexanediol-ascorbic acid-sebacic acid polyester
(P-194) Diethylene glycol-adipic acid polyester
(P-195) Trimethylol propane-adipic acid-phthalic acid polyester
(P-196) Diethylene glycol-trimethylol propane-adipic acid polyester
(P-197) Ethylene glycol adipic acid polyester
(P-198) Ethylene glycol-1,4-butanediol-adipic acid polyester
(P-199) 1,4-Bis[β-hydroxyethoxy)benzene-sebacic acid polyester
(P-200) Ethylene glycol-azelaic acid polyester The ratio in parentesis disclosed in copolymers is by weight.

The above-described couplers and polymers and other additives are dissolved in the high-boiling organic solvent, and are used in the form of an emulsified dispersion. Useful high-boiling organic solvents are described below.

The high-boiling organic solvents for use in the present invention are compounds which have a melting point preferably not higher than 100° C. and a boiling point preferably not lower than 140° C., and are immiscible with water and solvents for the couplers and the polymers. More preferably, the high-boiling organic solvents have a melting point of not higher than 80° C. and a boiling point of not lower than 160° C. When the melting point is too high, there is a possibility that the couplers tend to have lower solubility and color forming properties, whereas when the boiling point is too low, the high-boiling organic solvent tends to be easily evaporated from the coated photographic material or photographic filmsafter processing, and hence the desired effect is not obtained.

When the high-boiling organic solvent is miscible with water, the solubility of the non-diffusing couplers of the present invention is reduced. Furhtermore, upon processing of the photographic material, the high-boiling organic solvent diffuses to adjacent photographic layers or is dissolved into the processing solutions, or the solvent is separated from the couplers or formed dye in the photographic film and precipitates such that the desired effect is not obtained.

The preferred amount of the high-boiling organic solvent for use in the present invention depends on the type and amount of the couplers, the polymers and other additives used therewith, and cannot be generally specified. However, the weight ratio of the high-boiling organic solvent to the coupler is typically from 0 to 20, more preferably 0.01 to 10.

The high-boiling organic solvents is selected by taking various factors into consideration such as color formability, the hue of formed dyes, dye image fastness, ease of leuco dye formation, interaction between the solvent and the silver halide emulsion or the sensitizing dye, rinsing of various processing reagents, film strength and optical characteristics, in addition to the solubility of the coupler. If desired, the high-boiling organic solvent may be used as a combination of two or more thereof.

In addition to be above-described factors, it is important to select the high-boiling organic solvent by taking properties such as dielectric constant and refractive index into consideration.

Generally, it is preferred from the viewpoint of color formation that high-boiling organic solvents have a relatively high dielectric constant, for example, a dielectric constant of 6.0 or above are used higher. However, the high-boiling organic solvent is not always selected from the viewpoint of dye image fastness alone. On the other hand, it is preferred from the viewpoint of rapid processing that high-boiling organic solvent have a dielectric constant of 6.0 or less.

Nonlimiting examples of high-boiling organic solvents preferably used in the present invention include the following=8.

$$O{=}P(OC_4H_{9\text{-}n})_3 \quad \text{(S-1)}$$

$$O{=}P(OCH_2CH_2\underset{\underset{CH_3}{|}}{C}H_3)_3 \quad \text{(S-2)}$$

$$O{=}P(OC_6H_{13\text{-}\underline{n}})_3 \quad \text{(S-3)}$$

(S-4)

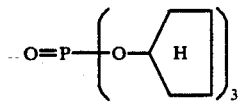

-continued
(S-5)
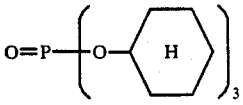
(S-6)
$O{=}P{+}OC_8H_{17}\text{-}\underline{n})_3$
(S-7)
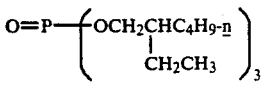
(S-8)
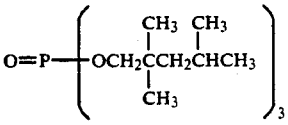
(S-9)
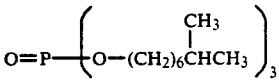
(S-10)
$O{=}P{+}OC_9H_{19}\text{-}\underline{n})_3$
(S-11)
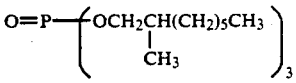
(S-12)
$O{=}P{+}OC_{10}H_{21}\text{-}\underline{n})_3$
(S-13)
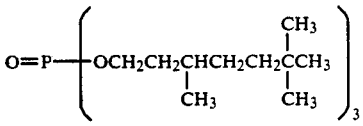
(S-14)
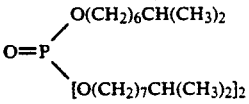
(S-15)
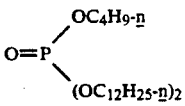
(S-16)
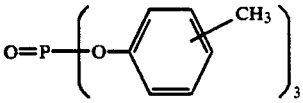
(S-17)
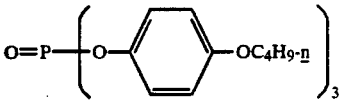
(S-18)
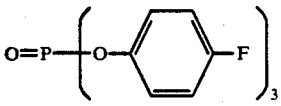
-continued
(S-19)
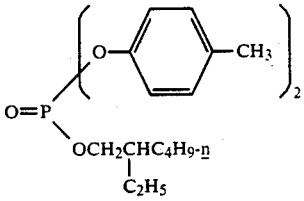
(S-20)
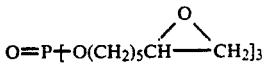
(S-21)
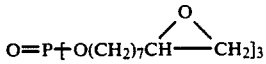
(S-22)
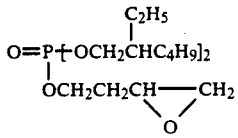
(S-23)
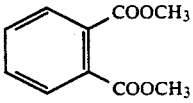
(S-24)
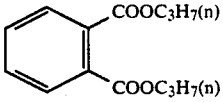
(S-25)
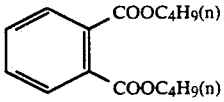
(S-26)
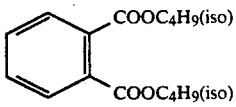
(S-27)
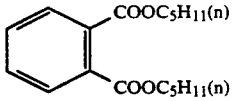
(S-28)
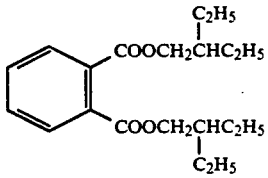
(S-29)
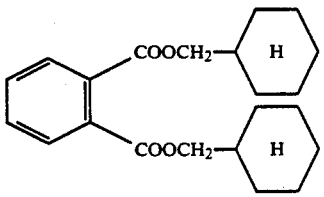

-continued
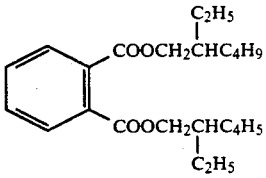
(S-30)
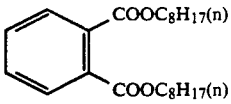
(S-31)
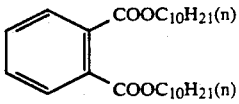
(S-32)
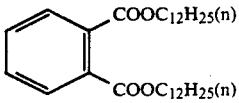
(S-33)
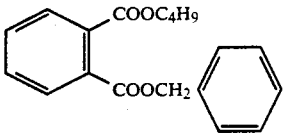
(S-34)
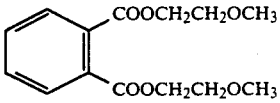
(S-35)
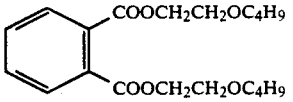
(S-36)
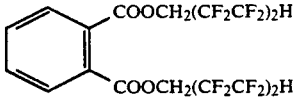
(S-37)
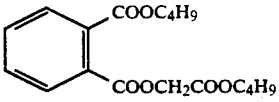
(S-38)
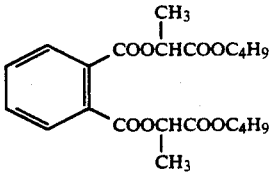
(S-39)
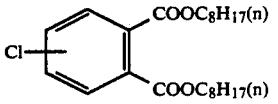
(S-40)
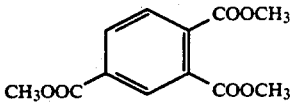
(S-41)
-continued
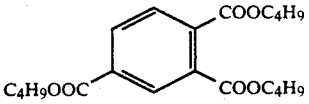
(S-42)
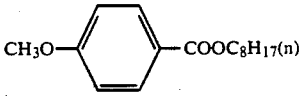
(S-43)
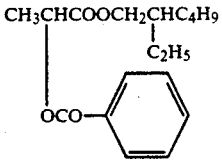
(S-44)
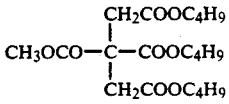
(S-46)
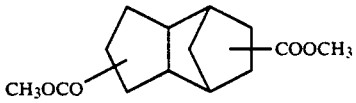
(S-47)
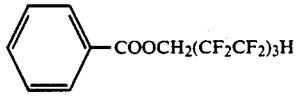
(S-48)
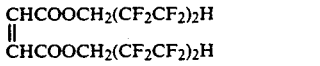
(S-49)
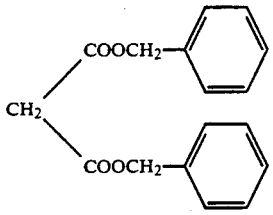
(S-50)
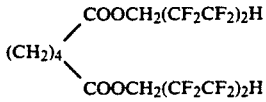
(S-51)
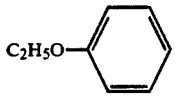
(S-52)
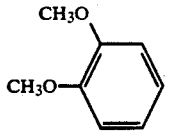
(S-53)
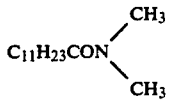
(S-54)
$C_{12}H_{25}OH$ (S-55)
$C_{16}H_{33}OH$ (S-56)
$C_{18}H_{37}OH$ (S-57)
$C_{10}H_{21}O(CH_2)_5O(CH_2)_2OH$ (S-58)

-continued (S-59)

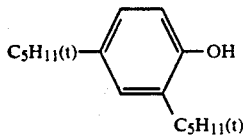

(S-60)

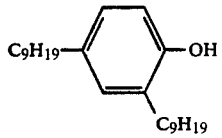

(S-61) $CH_3(CH_2)_{17}Cl$ (S-62) $CH_3(CH_2)_{15}Br$ (S-63)

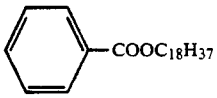

(S-64)

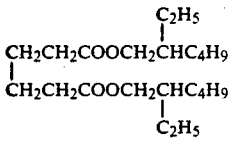

(S-65)

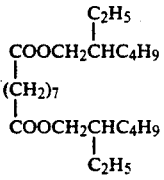

(S-66)

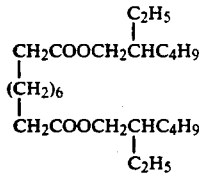

(S-67)

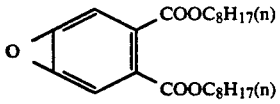

(S-68)

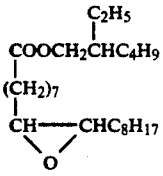

(S-69)

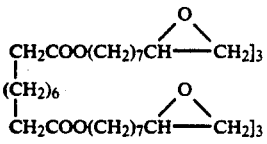

-continued (S-70)

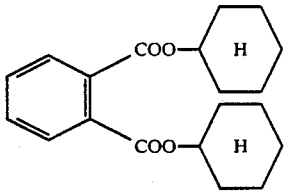

The emulsified dispersion of lipophilic fine particles containing the coupler, the high-boiling organic solvent and the polymer according to the present invention may be prepared in the following manner.

The polymer of the present invention, which is an not crosslinked, and namely, a linear polymer prepared by solution polymerization, emulsion polymerization or suspension polymerization, the high-boiling organic solvent and the coupler are dissolved in an organic co-solvent. The resulting solution is dispersed in the form of fine particle in water, preferably a hydrophilic colloid solution, and more preferably an aqueous gelatin solution in the presence of a dispersant, by means of an ultrasonic dispersion method, colloid mill or other mechanical dispersion method. Alternatively, water or an aqueous solution of a hydrophilic colloid such as gelatin is added to an organic co-solvent containing a dispersion aid such as a surfactant, the polymer of the present invention, the high-boiling organic solvent and the coupler. Phase reversal is then conducted to obtain an oil-in-water dispersion. The organic co-solvent may be removed from the dispersion by distillation, noodle washing or ultrafiltration. The term "organic co-solvent" as used herein refers to a low-boiling organic solvent which is useful in carrying out emulsifying dispersion, and which can be substantially removed from the finally prepared photographic material by, for example, evaporation or rinsing. Useful examples of the organic co-solvent include acetates such as ethyl acetate and butyl acetate, butylcarbitol acetate, ethyl propionate, sec-butyl alcohol, methyl ethyl ketone, methyl isobutyl ketone, $\beta$-ethoxyethyl acetate, methyl cellosolve acetate and cyclohexanone.

Furthermore, part of the organic co-solvent may be replaced by an organic solvent which is completely miscible with water, such as methyl alcohol, ethyl alcohol, acetone or tetrahydrofuran.

The organic co-solvent may be used either alone or as a combination of two or more thereof. The thus-obtained liophilic fine particles have an average particle diameter of preferably not less than 0.03 $\mu$, but not more than 2 $\mu$, more preferably not smaller than 0.05 $\mu$, but not more than 0.4 $\mu$. The particle diameter of the lipophilic fine particles can be measured by using a device such as Nano-Sizer (manufactured by Coulter).

Photographically useful materials can be incorporated into the lipophilic fine particles of the organic co-solvent. Examples of such photographically useful materials include a colored coupler, non-color forming coupler, developing agent, developing agent precursor, restrainer precursor, ultraviolet light absorber, development accelerator, hydroquinone, quinone, dye, dye-releasing agent, antioxidant, fluorescent brightener, anti-fading agent color forming accelerator, etc. These components may be advantageously used in combination.

As the photographically useful materials to be incorporated in the lipophilic fine particles comprising the coupler, the high-boiling organic solvent and the polymer of the present invention, the compounds represented by the following general formulae (A) to (C) are particularly useful for improving dye image fastness or color formation.

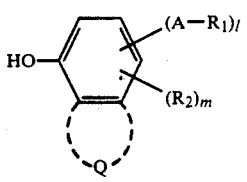

(A)

In the formula (A), A represents a divalent electron attractive group; $R_1$ represents a substituted or unsubstituted alkyl group, a substituted or unsubstituted aryl group, a substituted or unsubstituted alkoxy group, a substituted or unsubstituted aryloxy group, a substituted or unsubstituted alkylamino group, a substituted or unsubstituted anilino group or a substituted or unsubstituted heterocyclic group; l represents an integer of 1 or 2; $R_2$ represents a substituted or unsubstituted alkyl group, a substituted or unsubstituted alkoxy group, a hydroxy group or a halogen atom; m represents an integer of from 0 to 4; and Q represents a heterocyclic ring or benzene ring condensed with the phenol ring.

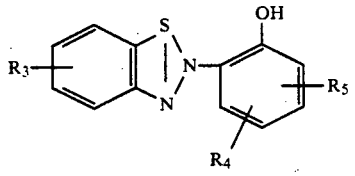

(B)

In the formula (B), $R_3$, $R_4$ and $R_5$ each represent a hydrogen atom, a halogen atom, a nitro group, a hydroxyl group, a substituted or unsubstituted alkyl group, a substituted or unsubstituted alkoxy group, a substituted or unsubstituted aryl group, a substituted or unsubstituted aryloxy group or a substituted or unsubstituted acylamino group.

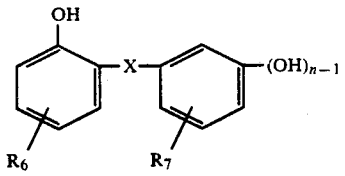

(C)

In the formula (C), $R_6$ and $R_7$ each represent hydrogen atoms, a substituted or unsubstituted alkyl group, a substituted or unsubstituted alkoxy group, a substituted or unsubstituted acyl group; X represents —CO— or —COO—; and n represents an integer of from 1 to 4.

Useful examples of the compounds having the formulae (A) to (C) include, but are not limited to, the following.

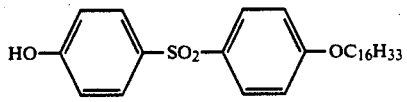

(X-1)

-continued

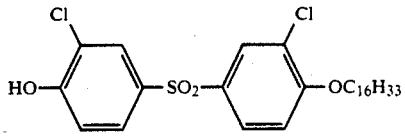

(X-2)

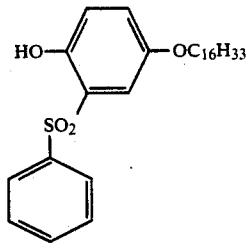

(X-3)

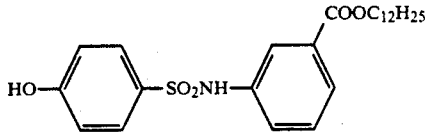

(X-4)

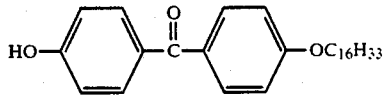

(X-5)

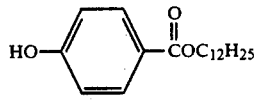

(X-6)

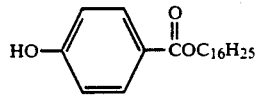

(X-7)

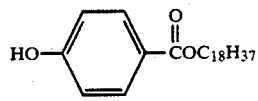

(X-8)

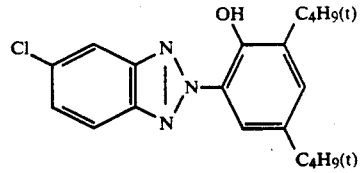

(X-9)

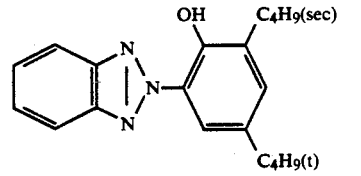

(X-10)

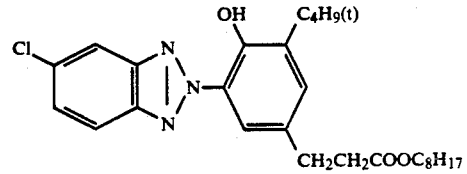

(X-11)

-continued (X-12)

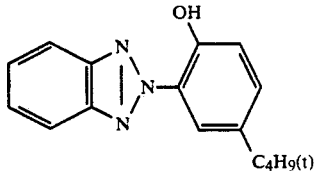

(X-13)

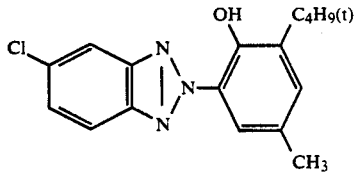

(X-14)

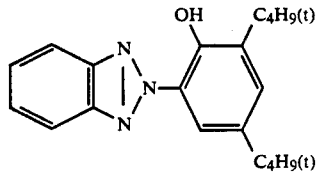

(X-15)

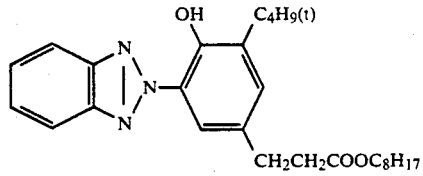

(X-16)

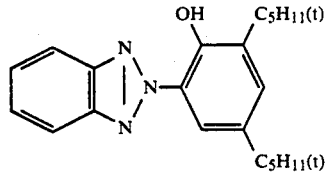

(X-17)

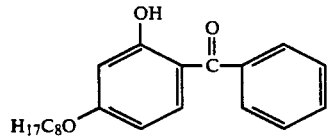

(X-18)

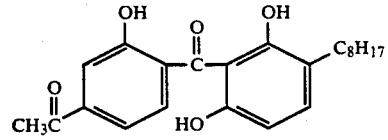

(X-19)

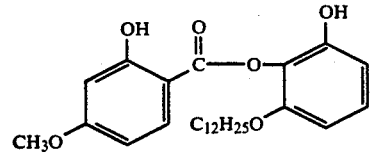

Any of conventional processing solutions described in *Research Disclosure* No. 176, pages 28–30 (RD-17643) can be used to process the photographic materials of the present invention. The photographic processing may include the forming of a silver image is formed, as long as a color image is finally obtained, or the photographic processing may directly form a color image. Processing temperature is preferably from 18° to 50° C. However, a temperature lower than 18° C. or higher than 50° C. can be used.

Various processing methods for color photographs can be used without particular limitation. Typical examples thereof include a method wherein after exposure, color development and a bleaching-fixing treatment are carried out, and if desired, further rinsing or stabilizing treatment is carried out; a method wherein after exposure and color development, bleaching and fixing are separately carried out and if desired, further rinsing or stabilizing treatment is conducted; a method wherein after exposure, development is carried out by using a developing solution containing a black-and-white developing agent followed by uniform exposure, and then color development and a bleaching-fixing treatment are carried out, and if desired, further rinsing or stabilizing treatment is conducted; and a method wherein after exposure, development is conducted by first using a developing solution containing a black-and-white developing agent and then a color developing solution containing a fogging agent (e.g., sodium boron hydride). A bleaching-fixing treatment is then conducted, and a rinsing or stabilizing treatment is optionally conducted.

Conventional aromatic primary amine color developing agents widely used in color photographic processes can be used for the color developing solutions of the present invention. These developing agents include aminophenol derivatives and p-phenylenediamine derivatives. Among them, the p-phenylenediamine derivatives are preferred. Typical examples thereof include, but are not limited to, the following compounds.

Z-1 N,N-Diethyl-p-phenylenediamine
Z-2 2-Amino-5-diethylaminotoluene
Z-3 2-Amino-5-(N-ethyl-N-laurylamino)toluene
Z-4 4-[N-Ethyl-N-(β-hydroxyethylamino]aniline
Z-5 2-Methyl-4-[N-ethyl-N-β-hydroxyethyl)amino]aniline
Z-6 N-Ethyl-N-(β-methanesulfonamidoethyl)-3-methyl-4-aminoaniline
Z-7 N-(2-Amino-5-diethylaminophenylethyl)methanesulfonamide
Z-8 N,N-Dimethyl-p-phenylenediamine
Z-9 4-Amino-3-methyl-N-ethyl-N-methoxyethylaniline
Z-10 4-Amino-3-methyl-N-ethyl-N-β-eethoxyethylaniline
Z-11 4-Amino-3-methyl-N-ethyl-N-β-butoxyethylaniline These p-phenylenediamine derivatives may be in the form of a salt such as sulfate, hydrochloride, sulfite or p-toluenesulfonate. The above compounds are described in U.S. Pat. Nos. 2,193,015, 2,552,241, 2,566,271, 2,592,364, 3,656,950 and 3,698,525. These aromatic primary amine color developing agents are used in an amount of from about 0.1 to 20 g, and preferably from about 0.5 to 10 g per liter of the developing solution.

The developing solutions of the present invention may contain hydroxylamines. The hydroxylamines may be used in the free form or in the form of a water-soluble salt. Examples of such salts include sulfates, oxalates, chlorides, phosphates, carbonates and acetates. Any of substituted and unsubstituted hydroxylamines can be used. Substituted hydroxylamines where alkyl groups as substituent groups are attached to the nitrogen atom (e.g., N,N-di-methylhydroxylamine) are preferred in the present invention in which silver halide emulsions having a high silver chloride content are used.

The hydroxylamines are used in an amount of not more than 10 g, and preferably not more than 5 g per liter of the color developing solution. A lesser amount is desirable when the stability of the color developing solution is to be maintained.

The color developing solution may contain preservatives such as sulfites (e.g., sodium sulfite, potassium sulfite, sodium bisulfite, potassium bisulfite, sodium metabisulfite, potassium metasulfite) and carbonyl sulfite adducts. When the color developing solution contains the above described preservatives, improved, and furthermore, color mixing in processing is reduced. The preservatives are used in an amount of preferably not more than 20 g, and more preferably not more than 5 g per liter of the color developing solution. A lesser amount is desirable when the stability of the color developing solution is to be maintained, especially for the developing of high silver chloride content emulsions.

Other examples of useful preservatives include the aromatic polyhydroxy compounds described in JP-A-52-49828, JP-A-56-47038, JP-A-56-32140, JP-A-59-160142 and U.S. Pat. No. 3,746,544; the hydroxyacetones described in U.S. Pat. No. 3,615,503 and U.K. Patent 1,306,176; the α-aminocarbonyl compounds described in JP-A-52-14302 and JP-A-53-89425; the metal described in JP-A-57-44148 and JP-A-57-53749; the saccharide described in JP-A-52-102727; the hydroxamic acids described in JP-A-52-27638; the α,α'-dicarbonyl compounds described in JP-A-59-160141; the salicylic acids described in JP-A-59-180588; the alkanolamines described in JP-A-54-3532; the poly(alkyleneimine) compounds described in JP-A-56-94349; the gluconic acid derivatives described in JP-A-56-75647; and the triethylenediamines described in JP-A-63-239447. These preservatives may be used either alone or in combination thereof. Particularly, 4,5-dihydroxy-m-benzenedisulfonic acid, poly(ethyleneimine), 1,4-azabicyclo[2,2,2]octane and triethanolamine are preferred.

The pH of the color developing solutions of the present invention is preferably in the range of from 9 to 12, more preferably from 9 to 11. The color developing solution may contain conventional additives.

Preferably, the color developing solutions contain pH buffering agents to maintain the pH in the above-specified range. Useful buffering agents include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Particularly, carbonates, phosphates, tetraborates and hydroxybenzoates are advantageous in that they are excellent in solubility and buffering performance in a high pH zone, are inexpensive and do not have an adverse effect on photographic processing performance even when added to the color developing solution. Accordingly, the use of these buffering agents is preferred.

Examples of useful buffering agents include sodium carbonate, potassium carbonate, sodium bicarbonate, potassium bicarbonate, sodium tertiary phosphate, potassium tertiary phosphate, disodium hydrogen phosphate, dipotassium hydrogenphosphate, sodium borate, potassium borate, sodium tetraborate (borax), potassium tetraborate, sodium o-hydroxybenzoate (sodium salidylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffering agents which can be used in the color developing solution of the present invention are not limited to the above-described compounds.

The buffering agents are used in an amount of preferably not less than 0.1 mol, and particularly preferably 0.1 to 0.4 mol per liter of the color developing solution.

It is preferred that the color developing solutions contain chelating agents as suspending agents for calcium and magnesium, or to improve the stability of the color developing solutions.

Organic acid compounds are preferred as the chelating agents, and useful example include the polyaminocarboxylic acids described in JP-B-48-30496 and JP-B-44-30232; the organic phosphonic acids described in JP-A-56-97347, JP-B-56-39359 and West German Patent 2,227,639; the phosphonocarboxylic acids described in JP-A-52-102726, JP-A-53-42730, JP-A-54-121127, JP-A-55-126241 and JP-A-55-65956; and the compounds described in JP-A-58-195843, JP-A-58-203440 and JP-B-53-40900.

Useful specific examples of the chelating agents include, but are not limited to, the following compounds.

Nitrilotriacetic acid
Diethyleneaminopentaacetic acid
Ethylenediaminetetraacetic acid
Triethylenetetraminehexaacetic acid
N,N,N-Trimethylenephosphonic acid
Ethylenediamine-N,N,N',N'-tetramethylenephosphonic acid
1,3-Diamino-2-propanol-tetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminotetraacetic acid
Hydroxyethylenediaminetriacetic acid
Ethylenediamine-o-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'-diacetic acid These chelating agents may be used either alone or in combination. The chelating agents are used in an amount sufficient to sequester metal ions in the color developing solution. For example, the agents are used in an amount of from 0.1 to 10 g/l.

In addition thereto, it is particularly preferred to use the hydrazine derivatives (e.g., N,N-di(carboxymethyl)hydrazine) described in JP-A-63-146041, JP-A-63-146042, JP-A-63-146043 and JP-A-63-170642 as compounds which improve the preservation of the color developing solution for use in processing the high silver chloride content photographic material of the present invention. The above-describe hydrozine compounds also provide high color forming properties and stable photographic characteristics even when the make-up composition of the color developing solution fluctvates.

If desired, the color developing solutions may contain development accelerators.

Benzyl alcohol is known as a typical color developing accelerator, and can be used in the present invention. However, it is preferred that benzyl alcohol not be substantially used in the present invention. The color developing solution for .use in processing the present invention preferably contains benzyl alcohol in an amount not more than 2 cc/l, and more preferably not more than 0.5 cc/l. It is particularly preferred that the color developing solution be completely free from benzyl alcohol.

Other examples of useful development accelerators include the thioether compounds described in JP-B-37-16088, JP-B-37-5987, JP-B-38-7826, JP-B 44-12380, JP-B-45-9019 and U.S. Pat. No. 3,813,247; the p-phenylenediamine compounds described in JP-A 52-49829 and JP-A-50-15554; the quaternary ammonium salts described in JP-A-50-137726,JP-B-44-30074, JP-A-56-156826 and JP-A-52-43429; the p-aminophenols described in U.S. Pat. Nos. 2,610,122 and 4,119,462; the amine compounds described in U.S. Pat. Nos. 2,494,903, 3,128,182, 4,230,796 and 3,253,919, JP-B-41-11431, U.S. Pat. Nos. 2,482,546, 2,596,926 and 3,852,346; the polyalkylene oxides described in JP-B-37-16088, JP-B-42-25201, U.S. Pat. No. 3,128,183, JP-B-41-11431, JP-B-42-23883 and U.S. Pat. No. 3,582,501; and 1-phenyl-3-pyrazolidones, hydrazines, meso ion type compounds, thione type compounds and imidazoles. Thioether compounds and 1-phenyl-3-pyrazolidones are preferred.

If desired, the color developing solution of the present invention may contain anti-fogging agents. Alkali metal halides such as potassium bromide, sodium bromide and potassium iodide and organic anti-fogging agents can be used as the anti-fogging agents. It is preferred that the concentration of bromide ion be as low as possible to effect rapid processing, because the photographic material of the present invention has a high silver chloride content.

Useful examples of the organic anti-fogging agents include nitrogen-containing heterocyclic compounds such as benztriazole, 6-nitrobenzimidazole, 5-nitroindazole, 5-methylbenztriazole, 5-nitrobenztriazole, 5-chlorobenztriazole, 2-thiazolylbenzimidazole, 2-thiazolylmethyl-benzimidazole and hydroxuyazaindolizine; mercapto-substituted heterocyclic compounds such as 1-phenyl-5-mercaptotetrazole, 2-mercaptobenzimidazole and 2-mercaptobenzthiazole; and adenine and mercapto-substituted aromatic compounds such as thiosalicylic acid. The anti-fogging agents may be dissolved out from the silver halide color photographic materials during processing to become accumulated in the color developing solution without critically impairing the same. However, it is preferred from the viewpoint of reducing the amount to be discharged that the accumulated amount be as small as possible.

It is desirable that the color developing solution contain fluorescent brighteners. 4,4'-Diamino-2,2'-disulfostilbene compounds are preferred as the fluorescent brighteners. The fluorescent brightener is used in an amount of from 0 to 5 g/l, preferably 0.1 to 1 g/l of the color developing solution.

If desired, surfactants such as alkylphosphonic acids, arylphosphonic acids, aliphatic carboxylic acids and aromatic carboxylic acids may be added to the color developing solution.

The processing temperature of the color developing solutions for use in the present invention is preferably from 30° to 50° C., and more preferably from 33° to 42° C. The replenishment rate thereof is 30 to 15 cc, preferably 30 to 600 cc, and more preferably 30 to 300 cc per $m^2$ of the photographic material. The replenishment rate is preferably made as small as possible in order to reduce the amount of waste solution.

Ferric ion complex salts are generally used as bleaching agents in the bleaching solution or bleaching-fixing solution of the present invention. Complexes of ferric ion with a chelating agent such as an aminopolycarboxylic acid, an aminopolyphosphonic acid or a salt thereof are preferred as the ferric ion complex salts. The alkali metal, ammonium and water-soluble amine salts of aminopolycarboxylic acids or aminopolyphosphonic acids are preferred as aminopolycarboxylates or aminopolyphosphonates. Examples of alkali metals include sodium, potassium and lithium. Examples of water-soluble amines include alkylamines such as methylamine, diethylamine, triethylamine and butylamine; alicyclic amines such as cyclohexylamine; arylamines such as aniline and m-toluidine; and heterocyclic amines such as pyridine, morpholine and piperidine.

Useful chelating agents include the polyaminocarboxylic acids, aminopolyphosphonic acids and salts thereof, and examples thereof include, but are not limited to, the following compounds.

Ethylenediaminetetraacetic acid
Disodium ethylenediaminetetraacetate
Diammonium ethylenediaminetetraacetate
Tetra(trimethylammonium) ethylenediaminetetraacetate
Tetrapotassium ethylenediaminetetraacetate
Tetrasodium ethylenediaminetetraacetate
Trisodium ethylene diaminetetraacetate
Diethylenetriaminepentaacetic acid
Pentasodium diethylene triaminepentaacetate
Ethylenediamine-N-(β-oxyethyl)-N,N'N-triacetic acid
Trisodium ethylenediamine-N-(β-oxy-ethyl)-N,N',N'-triacetate
Triammonium ethylenediamine-N-(β-oxy-ethyl)-N,N',N'-triacetate
Propylenediaminetetraacetic acid
Disodium propylenediaminetetraacetate
Nitrilotriacetic acid
Trisodium nitrilotriacetate
Cyclohexanediaminetetraacetic acid
Disodium cyclohexanediaminetetraacetate
Iminodiacetic acid
Dihydroxyethylglycine
Ethyl ether diaminetetraacetic acid
Glycol ether diaminetetraacetic acid
Ethylenediaminetetrapropionic acid
Phenylenediaminetetraacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid The ferric ion salts may be used in the form of a complex salt. Alternatively, ferric salts such as ferric sulfate, ferric chloride, ammonium ferric sulfate or ferric phosphate and chelating agents such as an aminopolycarboxylic acid, an aminopolyphosphonic acid or a phosphonocarboxylic acid may be used to form a ferric ion complex salt in the solution. When the ferric ion complex salts are used in the form of a complex salt, these complex salts may be used either alone or in a combination. When the ferric salts and the chelating agents are used to form a complex salt in the solution, one or more of the ferric salts and one or more of the chelating agents may be used. In any case, excess amounts of the ferric salt and the chelating agent may be used. Among the complex salts, the complexes of the aminopolycarboxylic acids with the ferric salt are preferred. The complex salts are used in an amount of from 0.01 to 1.0 mol/l, and preferably from 0.05 to 0.50 mol/l.

If desired, the bleaching solution and bleaching-fixing solution for use in the present invention may contain bleaching accelerators. Examples of useful bleaching accelerators include compounds having a mercapto group or disulfide group as described in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives as described in JP-A-50-140129; thiourea derivatives as described in JP-B-45-8506, JP-A-52-20832, JP-A-53-32735 and U.S. Pat. No. 3,706,61; iodides as described in West German Patent 1,127,715 and JP-A-58-16235; polyoxyethylene oxides as described in West German Patents 996,410 and 2,748,430; polyamine compounds as described in JP-B-45-8836; compounds described in JP-A-49-42434, JP-A-49-59644, JP-A-53-94927, JP-A-54-35727, JP-A-55-26506 and JP-A-58-163940; and bromide ion. Among them, the compounds having a mercapto group or disulfide group are preferred for providing a high accelerating effect. Particularly, the compounds described in U.S. Pat. No. 3,893,858, West German Patent 1,290,812 and JP-A-53-95630 are preferred.

The bleaching solution or bleaching-fixing solution of the present invention preferably contains rehalogenating agents such as bromides (e.g., potassium bromide, sodium bromide, ammonium bromide), chlorides (e.g., potassium chloride, sodium chloride, ammonium chloride) or iodides (e.g., ammonium iodide). If desired, one or more inorganic or organic acids having a pH buffering capability, or an alkali metal or ammonium salts thereof such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc. and corrosion inhibitors such as ammonium nitrate, guanidine, etc. may be added.

Conventional fixing agents can be used in the bleaching-fixing solutions or fixing solution of the present invention. Useful fixing agents include thiosulfates such as sodium thiosulfate and ammonium thiosulfate; thiocyanates such as sodium thiocyanate and ammonium thiocyanate; and water-soluble solvent for silver halide, such as ethylenebisthioglycolic acid, thioether compounds (e.g., 3,6-dithia-1,8-octanediol) and thioureas. These compounds may be used either alone or in combination. Furthermore, a bleaching-fixing solution comprising a combination of a fixing agent and a large amount of a halide such as potassium iodide, as described in JP-A-55-155354, can be used. In the present invention, thiosulfates, and particularly ammonium thiosulfate, are preferred.

The fixing agents are preferably used in an amount of from 0.3 to 2 mol/l, and more preferably from 0.5 to 1.0 mol/l.

The pH of the bleaching-fixing solutions or fixing solution of the present invention is preferably in the range of from 3 to 10, and particularly preferably 4 to 9. When the pH value is lower than the range defined above, the preservability of the solutions is deteriorated, and cyandye leuco formation during processing is accelerated, although desilverization is improved. On the other hand, when the pH value is higher than the range defined above, desilverization is retarded and stain is liable to be formed.

If desired, hydrochloric acid, sulfuric acid, nitric acid, acetic acid (glacial acetic acid), bicarbonates, ammonia, potassium hydroxide, sodium hydroxide, sodium carbonate or potassium carbonate may be added to the bleach-fixing or fixing solutions to adjust pH.

The bleaching-fixing solution of the present invention may contain fluorescent brighteners, antifoaming agents, surfactants and organic solvents such as methanol and polyvinyl pyrrolidone.

The bleaching-fixing solution or fixing solution of the present invention may contain sulfite ion-releasing compounds such as sulfites (sodium sulfite, potassium sulfite, ammonium sulfite), bisulfites (such as ammonium bisulfite, sodium bisulfite, potassium bisulfite) and metabisulfites (e.g., potassium metabisulfite, sodium metabisulfite, ammonium metabisulfite) as preservatives. These compounds are preferably used in an amount of from about 0.02 to 0.50 ml/l, and more preferably 0.04 to 0.40 mol/l in terms of sulfite ion.

The sulfites are generally used as the preservatives. In addition thereto, ascorbic acid, carbonyl bisulfite adducts and carbonyl compounds may be used.

Furthermore, buffering agents, fluorescent brighteners, chelating agents, antifungal agents, etc. may be optionally added to the bleaching fixing and fixing solutions of the present invention.

The rinsing stage for processing the photographic material of the present invention is illustrated in detail below.

In the present invention, a simple treatment method may be employed wherein a stabilizing treatment is carried out in place of a conventional rinsing treatment without substantially providing a rinsing stage. The term "rinsing treatment" as used herein to includes both a conventional rinsing treatment and a stabilizing treatment.

The amount of rinsing water for use in processing the photographic material of the present invention varies depending on the number of baths in a multi-stage countercurrent rinsing system and the amount of rinsing water carried over from the previous bath, such that it is difficult to define generally the amount of rinsing water. In the present invention, however, the concentration of the component of the previous bath having an ability of effecting bleaching and fixing in the final rinsing bath is preferably not higher than $5\times10^{-2}$ mol/l, and more preferably not higher than $2\times10^{-2}$ mol/l. For example, for a three tank countercurrent rinsing system, not less than about 1000 cc of rinsing water per $m^2$ of photographic material is preferably used. When rinsing is to be conducted in a water saving manner, not more than 1000 cc of rinsing water per mz of photographic material is preferably used.

The water washing step is carried out at a temperature of from 15° to 45° C., and preferably from 20° to 40° C.

Conventional additives may be added to the rinsing treatment stage for the purposes of preventing precipitation, and for stabilizing the rinsing water. For example, inorganic phosphoric acid, chelating agents such as aminopolycarboxylic acids and organic phosphonic acids, germicides or anti-fungal agents for preventing bacteria, waterweeds or molds from forming, the compounds described in *J. Antibact. Antifungal Agents,* Vol. 11, No. 5, pages 207–233 (1983), the compounds described in *Chemistry of Germicidal Antifungal Agents,* written by Hiroshi Horiguchi, metal salts such as magnesium salt and aluminum salt, alkali metals, ammonium salts or surfactants for preventing drying load or unevenness, may be added. The compounds described in *Phot. Sci. Eng.*, Vol. 6, pages 344–359 (1965) may be added. A method using rinsing water containing calcium and magnesium in reduced amounts is preferably employed in the present invention.

The present invention is particularly effective when the chelating agent, the germicide or the antifungal agent is added to rinsing water, and the amount of rinsing water is greatly reduced by using a multi-stage countercurrent rinsing system having two or more tanks. The present invention is also effective when a multi-stage countercurrent stabilizing treatment stage (namely, stabilizing treatment) as described in JP-A-57-8543 is carried out in place of a conventional rinsing stage. When the above-described stabilizing treatment is employed, the concentration of the bleaching-fixing component in the final bath may be not more than $5\times10^{-2}$ mol/l, and preferably not more than $1\times10^{-2}$ mol/l.

Various compounds may be added to the stabilizing bath to stabilize the image. Examples thereof include buffering agents for adjusting the pH of the film, for example, to a pH of from 3 to 8 (using, e.g., borates metaborates, borax, phosphates, carbonates, potassium hydroxide, sodium hydroxide, ammonia water, monocarboxylic acids, dicarboxylic acids, polycarboxylic acids and combinations thereof), and aldehydes such as formalin. Furthermore, chelating agents (e.g., inorganic phosphoric acid, aminopolycarboxylic acids, organic phosphonic acids, aminopolyphosphonic acids, phosphonocarboxylic acids), germicides (e.g., thiazoles, isothiazoles, halogenated phenols, sulfanylamides, benztriazoles), surfactants, fluorescent brighteners, hardening agents, etc. may be used. These compounds may be used either alone or in combination for single or multiple purposes.

In order to improve the preservability of the image, ammonium salts such as ammonium chloride, ammonium nitrate, ammonium sulfate, ammonium phosphate, ammonium sulfite and ammonium thiosulfate are preferably added as pH adjustors for films after processing.

When the amount of rinsing water is greatly reduced using a countercurrent rinsing system, and in order to reduce the amount of waste water, a portion or all of the rinse water overflow overflow may be introduced into the bleaching-fixing bath or the fixing bath (i.e., the previous bath).

When continuous processing is carried out, a replenisher for each processing solution is used to prevent a change in the composition of each processing solution, to thereby finish the photographic materials without variation in photographic properties. In order to reduce cost, the amount of replenisher is minimized as long as good photographic characteristics are obtained by the processing conditions selected, such as the composition and temperature of the processing solution, processing time, stirring, etc.

If desired, a heater, a temperature sensor, a liquid level sensor, a circulating pump, a filter, various floating covers, various squeezers, a nitrogen stirrer, an air stirrer, etc. may be provided within each processing bath.

The silver halide photographic material of the present invention is preferably provided with auxiliary layers such as a protective layer, an intermediate layer, an antihalation layer, a filter layer, a backing layer, etc. in addition to the silver halide emulsion layers.

As in the layer structure of a conventional color photographic material, protective layers may be provided on the uppermost emulsion layer of the photographic material of the present invention. The uppermost protective layer may contain a matting agent having an appropriate particle size, a slip agent and a dispersion of a high-boiling organic solvent or a homopolymer or a copolymer of polyvinyl alcohol for controlling the physical and mechanical characteristics of the coated layer. The lower protective layer preferably contains an ultraviolet light absorber [particularly, 2-(2'-hydroxyphenyl)benztriazoles], a mordant and the polymer or the high-boiling organic solvent described above.

The emulsion layer containing the silver halide emulsion of the present invention may be composed of one or two, or more layers. A mixture consisting of the silver halide emulsions of the present invention may be used, or the silver halide emulsion of the present invention may be mixed with an other silver halide emulsion. The emulsion may be divided into two or more layers each having a different photographic sensitivity and/or spectral sensitivity. The divided layers may then be coated in the desired order.

An intermediate layer containing a color mixing inhibitor is preferably provided between emulsion layers having a different spectral sensitivity. Examples of color mixing inhibitors for use in the present invention include reducing agents such as hydroquinones. Typical examples thereof are the alkylhydroquinones described in U.S. Pat. Nos. 2,360,290, 2,419,613, 2,728,659, 2,732,300, 3,960,570 and 3,700,453.

Examples of supports for use in the present invention include baryta paper, resin-coated paper, triacetate film, polyethylene terephthalate film, vinylchloride film, other plastic films, synthetic paper composed of polypropylene film, glass sheet, metal sheet and metal-laminated sheet.

The present invention is illustrated below in greater detail by reference to the following examples which, however, are not to be construed as limiting the invention in any way. All parts are given by weight, unless otherwise indicated.

EXAMPLE 1

Emulsions for the sensitive silver halide emulsion layer containing a cyan coupler were prepared in the following manner.

30 g of lime-processed gelatin was added to 1000 ml of distilled water and dissolved at 40° C. The pH of the solution was adjusted to 3.8 using sulfuric acid. 5.5 g of sodium chloride and 0.02 g of N,N'-dimethylimidazolidine-2-thione were added thereto. The temperature of the solution was elevated to 52.5° C. A solution of 62.5 g of silver nitrate in 750 ml of distilled water and a solution of 21.5 g of sodium chloride in 500 ml of distilled water were added to the above solution over a period of 40 minutes, while keeping the temperature constant at 52.5° C. Furthermore, a solution of 62.5 g of silver nitrate in 500 ml of distilled water and a solution of 21.5 g of sodium chloride in 300 ml of distilled water were added thereto over a period of 20 minutes while keeping the temperature constant at 52.5° C.

The resulting emulsion was examined with an electron microscope and was found to be composed of cubic grains having an average side length of about 0.46 $\mu$ and a grain size distribution of 0.09 in terms of a coefficient of variation.

The emulsion was desalted and washed with water. 0.2 g of nucleic acid, $1\times10^{-4}$ mol (per mol of Ag) of the exemplified compound (V-6) and 0.6 mol % (in terms of silver halide) of a monodisperse silver bromide emulsion (containing $2\times10^{-5}$ mol of dipotassium iridium hexachloride per mol of Ag) having a mean grain size of 0.05 μ were added thereto. About $2\times10^{-6}$ mol of triethylthiourea per mol of Ag was added thereto to chemically sensitize the emulsion. Additionally, $7\times10^{-4}$ mol of the exemplified compound (I-2) per mol of Ag was added to the emulsiono. The resulting emulsion was referred to as emulsion Em-1.

30 g of lime-processed gelatin were added to 1000 ml of distilled water and dissolved at 40° C. The pH of the solution was adjusted to 3.8 using sulfuric acid. 5.5 g of sodium chloride and 0.02 g of N,N'-dimethylimidazolidine-2-thione was added thereto. The temperature of the solution was elevated to 56.5° C. A solution of 62.5 g of silver nitrate in 750 ml of distilled water and a solution of 18.3 g of sodium chloride and 6.6 g of potassium bromide in 500 ml of distilled water were added to the above solution over a period of 40 minutes while keeping the temperature constant at 56.5° C. Furthermore, a solution of 62.5 g of silver nitrate in 500 ml of distilled water and a solution of 18.3 g of sodium chloride and 6.6 g of potassium bromide in 300 ml of distilled water were added thereto at 56.5° C. over a period of 20 minutes.

The resulting emulsion was examined with an electron microscope and was found to be composed of cubic grains having an average side length of about 0.47 μ and a grain size distribution of 0.09 in terms of a coefficient of variation.

The emulsion was desalted and washed with water. 0.2 g of nucleic acid, $1\times10^{-4}$ mol (per mol of Ag) of the exemplified compound (V-6) and 0.6 mol % (in terms of silver halide) of a monodisperse silver bromide emulsion (containing $2\times10^{-5}$ mol of dipotassium iridium hexachloride per mol of Ag) having a mean grain size of 0.05 μ were added thereto. About $3\times10^{-6}$ mol of triethylthiourea per mol of Ag was added to chemically sensitize the emulsion. Additionally, $7\times10^{-4}$ mol of the exemplified compound (I-2) per mol of Ag was added to the emulsion. The resulting emulsion was referred to as emulsion Em-2.

30 g of lime-processed gelatin were added to 1000 ml of distilled water and dissolved at 40° C. The pH of the solution was adjusted to 3.8 using sulfuric acid. 5.5 g of sodium chloride and 0.02 g of N,N'-dimethylimidazolidine-2-thione were added thereto. The temperature of the solution was elevated to 58.5° C. A solution of 62.5 g of silver nitrate in 750 ml of distilled water and a solution of 16.1 g of sodium chloride and 10.9 g of potassium bromide in 500 ml of distilled water were added to the above solution over a period of 40 minutes while keeping the temperature constant at 58.5° C. Furthermore, a solution of 62.5 g of silver nitrate in 500 ml of distilled water and a solution of 16.1 g of sodium chloride and 10.9 g of potassium bromide in 300 ml of distilled water were added thereto over a period of 20 minutes while keeping the temperature constant at 58.5° C.

The resulting emulsion was examined with an electron microscope and was found to be composed of cubic grains having an average side length of about 0.46 μ and a grain size distribution of 0.10 in terms of a coefficient of variation.

The emulsion was desalted and washed with water 0.2 g of nucleic acid, $1\times10^{-4}$ mol (per mol of Ag) of the compound (V-6) and 0.6 mol % (in terms of silver halide) of a monodisperse silver bromide emulsion (containing $2\times10^{-5}$ mol of dipotassium iridium hexachloride per mol of Ag) having a mean grain size of 0.05 μ were added to the emulsion. The emulsion was chemically sensitized with about $3\times10^{-6}$ mol (per mol of Ag) of triethylthiourea. Additionally, $7\times10^{-4}$ mol of the compound (I-2) was added to the emulsion. The resulting emulsion was referred to as emulsion Em-3.

30 g of lime-processed gelatin were added to 1000 ml of distilled water and dissolved at 40° C. The pH of the solution was adjusted with sulfuric acid to 3.8. 5.5 g of sodium chloride and 0.02 g of N,N'-dimethylimidazolidine-2-thione were added thereto. The temperature of the solution was elevated to 70° C. To this solution were added a solution of 62.5 g of silver nitrate in 750 ml of distilled water and a solution of 6.5 g of sodium chloride and 30.6 g of potassium bromide in 500 ml of distilled water over a period of 40 minutes while keeping the temperature constant at 70° C. Furthermore, a solution of 62.5 g of silver nitrate in 500 ml of distilled water and a solution of 6.5 g of sodium chloride and 30.6 g of potassium bromide in 300 ml of distilled water were added thereto over a period of 20 minutes while keeping the temperature constant at 70° C.

The resulting emulsion was examined with an electron microscope and was found to be composed of cubic grains having an average side length of about 0.46 μ and a grain size distribution of 0.11 in terms of a coefficient of variation.

The emulsion was desalted and washed with water. 0.2 g of nucleic acid, $1\times10^{-4}$ mol (per mol of Ag) of the compound (V-6) and 0.6 mol % (in terms of silver halide) of a monodisperse silver bromide emulsion (containing $2\times10^{-5}$ mol of dipotassium iridium hexachloride per mol of Ag) having a mean grain size of 0.05 μ were added to the emulsion. The emulsion was chemically sensitized with about $4\times10^{-6}$ mol (per mol of Ag) of triethylthiourea. Additionally, $7\times10^{-4}$ mol of the compound (I-2) per mol of Ag was added to the emulsion. The resulting emulsion was referred to as emulsion Em-4.

$2.5\times10^{-4}$ mol (per mol of Ag) of the exemplified compound (V-36) was added to each of the emulsions Em-1 to Em-4 to prepare each of the emulsions Em-5 to Em-8, respectively.

Similarly, $1.5\times10^{-4}$ mol (per mol of Ag) of the exemplified compound (V-41) was added to each of the emulsions Em-1 to Em-4 to prepare each of emulsions Em-9 to Em-12, respectively.

The halogen composition and distribution of the silver halide grains of each of the emulsions Em-1 to Em-4 were examined by X-ray diffractometry.

Em-1 had a main peak corresponding to 100 mol % silver chloride and slightly a broad subpeak having its center in the vicinity of 70 mol % silver chloride and its foot extending to the region of 60 mol % silver chloride. Em-2 had a main peak corresponding to 85 mol % silver chloride and slightly a broad bulge having its foot extending to the region of 60 mol % silver chloride, on the side extending toward the lower silver chloride content. Em-3 had a main peak corresponding to 75 mol % silver chloride and slightly a broad subpeak on the side extending toward the low silver chloride content. Em-4 had a main peak corresponding to 30 mol % silver chloride, and there was little or no indication of any halide composition distribution.

Em-5 to Em-8 and Em-9 to Em-12 were examined by X-ray difractometry. The results corresponded to those obtained for emulsions Em-1 to Em-4, respectively.

An emulsion for the green-sensitive silver halide emulsion layer containing the magenta coupler was prepared in the following manner.

30 g of lime-processed gelatin were added to 1000 ml of distilled water and dissolved at 40° C. 5.5 g of sodium chloride and 0.02 g of N,N'-dimethylimidazolidine-2-thione were added thereto. The temperature of the solution was elevated to 50° C. To this solution, there were added a solution of 62.5 g of silver nitrate in 750 cc of distilled water and a solution of 21.5 g of sodium chloride in 500 ml of distilled water over a period of 40 minutes, while keeping the temperature constant at 50° C. Furthermore, a solution of 62.5 g of silver nitrate in 500 ml of distilled water, and a solution of 21.5 g of sodium chloride in 300 ml of distilled water were added thereto over a period of 20 minutes while keeping the temperature constant at 50° C.

The resulting emulsion was examined with an electron microscope and was to be composed of cubic grains having an average side length of about 0.44 μ and a grain size distribution of 0.08 in terms of a coefficient of variation.

The emulsion was desalted and washed with water. 0.2 g of nucleic acid, $5\times10^{-4}$ mol (per mol of Ag) of the exemplified compound (V-41), $7\times10^{-5}$ mol (per mol of Ag) of the exemplified compound (V-26) and 0.4 mol % (in terms of silver halide) of a monodisperse silver bromide emulsion (containing $2.5\times10^{-5}$ mol of dipotassium iridium hexachloride per mol of Ag) having a mean grain size of 0.05 μ were added to the emulsion. The emulsion was chemically sensitized with about $2.5\times10^{-6}$ mol (per mol of Ag) of triethylthiourea. Additionally, $1.1\times10^{-3}$ mol of the exemplified compound (I-2) per mol of Ag was added thereto to obtain the emulsion for the green-sensitive layer.

An emulsion for the blue-sensitive silver halide emulsion layer containing the yellow coupler was prepared in the following manner.

30 g of lime-processed gelatin were added to 1000 ml of distilled water and dissolved at 40° C. The pH of the solution was adjusted to 3.8 using sulfuric acid. 5.5 g of sodium chloride and 0.03 g of N,N'-dimethylimidazolidine-2-thione was added thereto. The temperature of the solution was elevated to 75° C. To this solution were added a solution of 12.5 g of silver nitrate in 150 ml of distilled water and a solution of 4.3 g of sodium chloride in 100 ml of distilled water over a period of 30 minutes while keeping the temperature constant at 75° C. Furthermore, a solution of 112.5 g of silver nitrate in 1100 ml of distilled water and a solution of 38.7 g of sodium chloride in 650 ml of distilled water were added thereto over a period of 40 minutes while keeping the temperature constant at 75° C.

The resulting emulsion was examined with an electron microscope and was found to be composed of cubic grains having an average side length of about 0.82 μ and a grain size distribution of 0.11 in terms of a coefficient of variation.

The emulsion was desalted and washed with water. 0.2 g of nucleic acid, $2\times10^{-3}$ mol (per mol of Ag) of the exemplified compound (V-34), $2\times10^{-3}$ mol (per mol of Ag) of the exemplified compound (V-36) and 0.3 mol % (in terms of silver halide) of a monodisperse silver bromide emulsion (containing $1\times10^{-5}$ mol of dipotassium iridium hexachloride per mol of Ag) having a mean grain size of 0.05 μ were added to the emulsion. The emulsion was chemically sensitized with about $1.2\times10^{-6}$ mol (per mol of Ag) of triethylthiourea. Additionally, $9\times10^{-4}$ mol of the exemplified compound (I-2) per mol of Ag was added thereto to obtain an emulsion for the blue-sensitive layer.

The halogen composition and distribution of each of the silver halide grains for the green-sensitive layer and the silver halide emulsion for the blue-sensitive layer were examined by X-ray diffractometry. For each emulsion, a main peak was observed corresponding to 100 mol % silver chloride in addition to a slightly broad subpeak having it center in the vicinity of 70 to 65 mol % silver chloride, its foot extending to the region of 60 mol % silver chloride.

An emulsified dispersion containing cyan couplers was prepared in the following manner.

15 g of the exemplified compound (P-57) having an average molecular weight of about 60,000 according to the present invention, 2.0 g of the compound (C-1), 3.3 g of the compound (C-5), 2.7 g of the compound (C-11), 2.1 g of the compound (C-38), 1.0 g of the compound (X-9), 1.5 g of the compound (X-10), 1.5 g of the compound (X-12) 0.2 g of the compound (A-22), 0.14 g of the compound (B-1), 3.0 g of the compound (S-68), 3.0 g of the compound (S-70), 0.2 g of the compound (a) and 1.0 g of the compound (b) described below, were mixed with 30 ml of ethyl acetate and dissolved at 50° C. The resulting solution was added to 190 ml of a 10% aqueous gelatin solution containing 12 ml of 10% sodium dodecylbenzenesulfonate. The mixture was stirred at high speed using a homogenizer to obtain an emulsified dispersion.

An emulsified dispersion containing magenta couplers and an emulsified dispersion containing yellow couplers were prepared in the same way as the emulsified dispersion containing cyan couplers.

The above-described silver halide emulsions and emulsified dispersions were used to prepare samples having the layer structure and the coating weights of the compounds given in Tables 1 and 2. Emulsified dispersions for the ultraviolet absorbing layer and the color mixing inhibiting layer were prepared in the same way as the emulsified dispersion containing cyan couplers.

In order to improve the sharpness of the resulting image by preventing irradiation, the prepared samples were coated with the exemplified compounds (D-1), (D-2), (D-4) and (D-8) in an amount to provide coating weights of 0.006 g/m², 0.007 g/m², 0.003 g/m² and 0.012 g/m², respectively.

The following three compounds in a molar ratio of 3:2:1 were used as hardening agents for the gelatin.

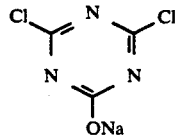

$CH_2NHCOCH_2SO_2CH{=}CH_2$
|
$CH_2NHCOCH_2SO_2CH{=}CH_2$

-continued $$\begin{array}{l} OCH_2SO_2CH{=}CH_2 \\ | \\ CH_2SO_2CH{=}CH_2 \end{array}$$

The hardening agents may be diffused into all hydrophilic emulsion layers on the support, even if the agents are added into the protective layer either during or after adding thereof.

To examine the spectral sensitivity distribution of the prepared samples, the samples were exposed for 0.1 to 2 seconds using a spectral sensitivity sensitometer, and processed in the following stages.

| Processing Stage | Temperature | Time |
|---|---|---|
| Color development | 38° C. | 45 sec. |
| Bleaching-fixing | 30–36° C. | 45 sec. |
| Rinse 1 | 30–37° C. | 30 sec. |
| Rinse 2 | 30–37° C. | 30 sec. |
| Rinse 3 | 30–37° C. | 30 sec. |
| Drying | 70–80° C. | 60 sec. |

| Color Developing Solution | |
|---|---|
| Ethylenediamine-N,N,N',N'-tetramethylenephosphonic acid | 3.0 g |
| N,N-Di(carboxymethyl)hydrazine | 4.5 g |
| N,N-Diethylhydroxylamine oxalate | 2.0 g |
| Triethanolamine | 8.5 g |
| Sodium sulfite | 0.14 g |
| Potassium chloride | 1.6 g |
| Potassium bromide | 0.01 g |
| Potassium carbonate | 25.0 g |
| N-Ethyl-N (β-methanesulfonamidoethyl)-3-methyl-4-aminoaniline sulfate | 5.0 g |
| WHITEX 4 (a product of Sumitomo Chemical Co., Ltd.) | 1.4 g |
| Water to make | 1000 ml |
| pH | adjusted to 10.05 |
| **Bleaching-fixing Solution** | |
| Ammonium thiosulfate (55 wt %) | 100 ml |
| Sodium sulfite | 17.0 g |
| Ethylenediaminetetraacetic acid iron(III) ammonium | 55.0 g |
| Disodium ethylenediaminetetraacetate | 5.0 g |
| Ammonium bromide | 40.0 g |
| Glacial acetic acid | 9.0 g |
| Water to make | 1000 ml |
| pH | adjusted to 5.80 |

Rinsing Water

Ion-exchange processed water (concentration of calcium ion being reduced to 3 ppm or less and that of magnesium ion being reduced to 2 ppm or less) was used in the rinsing steps.

Figure 2:
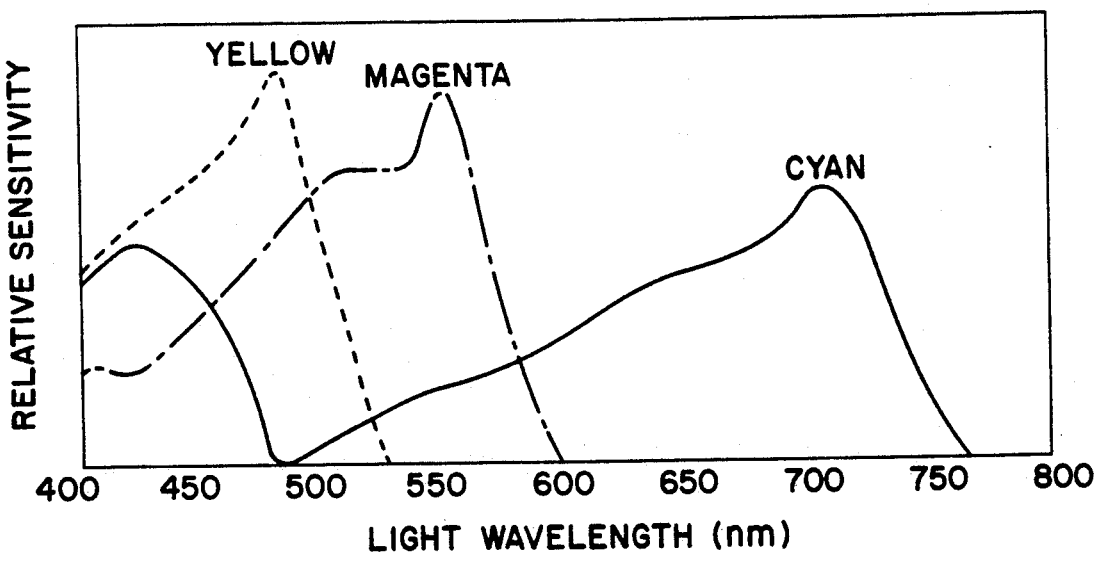
Figure 3:
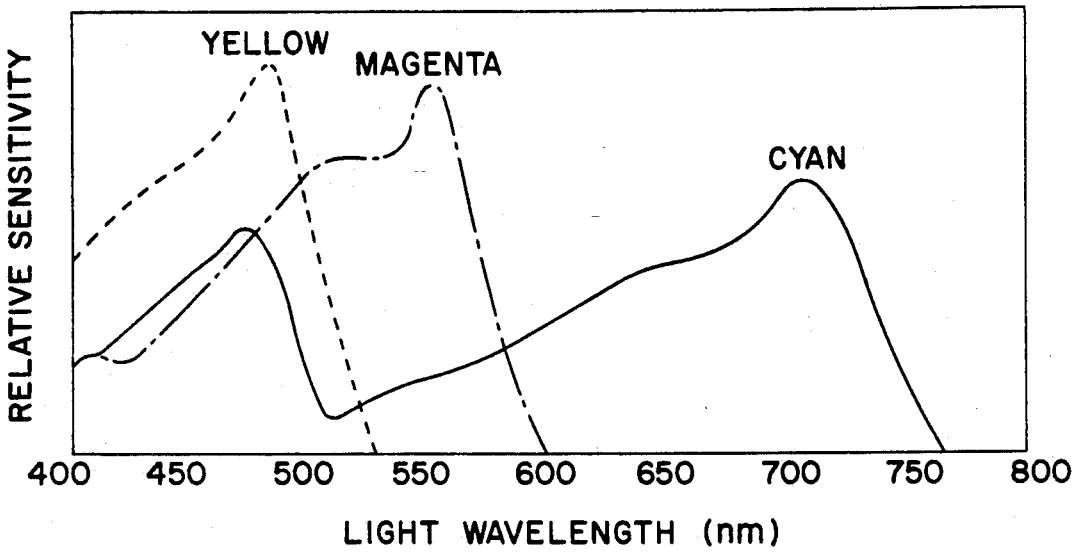
Figure 4:
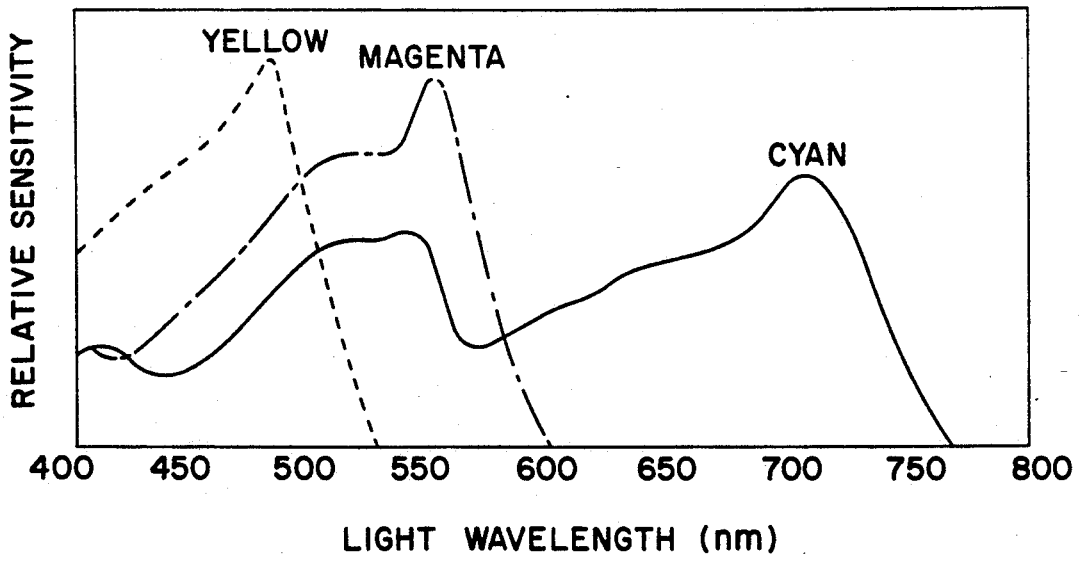

FIGS. 1 to 4 show typical examples of the spectral sensitivity of the samples thus prepared, exposed and processed.

It is clear from FIG. 1 to 4 that in the samples of the present invention, the cyan color forming layer has spectral sensitivity in the region of red light as well as spectral sensitivity due to the spectral sensitizing dyes present therein in the region of green light or blue light, said spectral sensitivity in the region of green light or blue light being similar to that of the green-sensitive layer or the blue-sensitive layer.

Coarse-woven bright red clothing (a woolen seater) was loosely rolled out on a table. Lighting was set above and at an angle. The sweater was photographed using Fuji color negative super HR100 film. The film was subjected to a Fuji-designated processing CN-16 development. Prints were made of the processed negative film with the proposed samples using a Fuji C450 printer. Development was carried out in the same way as that described above to prepare color prints.

The resulting color prints was classified into three ranks by organoleptic evaluation from the viewpoint of color gradation reproducibility, using the following evaluation criteria. The results obtained are indicated below.

| | |
|---|---|
| Rank C: | Red color was reproduced with high chroma, but the reproduced texture was poor stereoscopicly and shadow was difficultly visible. (Samples 1 and 2) |
| Rank B: | Red color was reproduced with high chroma, but the texture was slightly poor stereoscopicly and shadow was somewhat difficultly visible. (Samples 3 and 4) |
| Rank A: | Red color was reproduced with high chroma, the reproduced texture had good stereoscopic effect, and shadow was visible. (Samples 5 to 12) |

The samples 5, 6 9 and 10 of the present invention were classified as Rank A, which was the highest ranking.

Although the comparative samples 7, 8, 11 and 12 were also classified as rank A, the subject samples had a relatively high silver bromide content such that the development rate was retarded. Furthermore, when these comparative samples were subjected to a running test, bromide ion accumulated in the color developing solution to unacceptable levels, and as a result, development rate was further retarded, and the sensitivity was reduced. The processing of samples 5 and 9 of the present invention did not result in such disadvantages. The processing of samples 6 and 10 of the present invention did not result in sone, but caused such neghgible retarding of the developing rate and reduction of sensitivity. The samples of the present invention were superior as a whole.

TABLE 1

| Layer | Coated Material | Coating Weight |
|---|---|---|
| Seventh Layer (Protective Layer) | Gelatin | 1.30 g/m² |
| | Acrylic-modified polymer of polyvinyl alcohol (degree of modification: 17%) | 0.15 g/m² |
| | Liquid paraffin | 0.05 g/m² |
| Sixth Layer (UV Light Absorbing Layer) | Gelatin | 0.65 g/m² |
| | Ultraviolet light absorber (X-9) | 0.02 g/m² |
| | Ultraviolet light absorber (X-10) | 0.09 g/m² |
| | Ultraviolet light absorber (X-16) | 0.10 g/m² |
| | Color mixing inhibitor (C) | 0.02 g/m² |
| | Solvent (S-66) | 0.11 g/m² |
| Fifth Layer (Red Sensitive Layer) | Emulsion (any one of Em-1 to 12) in terms of Ag | 0.24 g/m² |
| | Gelatin | 1.76 g/m² |
| | Polymer (P-57) | 0.53 g/m² |
| | Cyan coupler (C-1) | 0.07 g/m² |
| | Cyan coupler (C-5) | 0.12 g/m² |
| | Cyan coupler (C-11) | 0.09 g/m² |
| | Cyan coupler (C-38) | 0.07 g/m² |
| | Dye image stabilizer (X-9) | 0.04 g/m² |
| | Dye image stabilizer (X-10) | 0.05 g/m² |
| | Dye image stabilizer (X-12) | 0.05 g/m² |
| | Dye image stabilizer (A-22) | 0.01 g/m² |
| | Dye image stabilizer (B-1) | 0.01 g/m² |
| | Dye image stabilizer (a) | 0.01 g/m² |
| | Dye image stabilizer (b) | 0.04 g/m² |
| | Solvent (S-68) | 0.11 g/m² |
| | Solvent (S-70) | 0.11 g/m² |
| Fourth Layer (UV Light Absorbing Layer) | Gelatin | 1.60 g/m² |
| | Ultraviolet light absorber (X-9) | 0.06 g/m² |
| | Ultraviolet light absorber (X-10) | 0.27 g/m² |
| | Ultraviolet light absorber (X-16) | 0.29 g/m² |
| | Color mixing inhibitor (C) | 0.06 g/m² |

TABLE 1-continued

| Layer | Coated Material | Coating Weight |
|---|---|---|
| | Solvent (S-66) | 0.26 g/m$^2$ |
| Third Layer (Green Sensitive Layer) | Emulsion (for said green-sensitive layer) in terms of Ag | 0.15 g/m$^2$ |
| | Gelatin | 1.60 g/m$^2$ |
| | Magenta coupler (M-17) | 0.22 g/m$^2$ |
| | Magenta coupler (M-16) | 0.09 g/m$^2$ |
| | Dye image stabilizer (d) | 0.10 g/m$^2$ |
| | Dye image stabilizer (A-22) | 0.08 g/m$^2$ |
| | Dye image stabilizer (B-1) | 0.03 g/m$^2$ |
| | Dye image stabilizer (e) | 0.01 g/m$^2$ |
| | Solvent (S-7) | 0.44 g/m$^2$ |
| | Solvent (S-16) | 0.22 g/m$^2$ |
| Second Layer (Color Mixing Inhibiting Layer) | Gelatin | 1.30 g/m$^2$ |
| | Color mixing inhibitor (c) | 0.06 g/m$^2$ |
| | Solvent (S-16) | 0.12 g/m$^2$ |
| | Solvent (S-25) | 0.12 g/m$^2$ |
| First Layer (Blue Sensitive Layer) | Emulsion (for said blue-sensitive layer) in terms of Ag | 0.27 g/m$^2$ |
| | Gelatin | 1.66 g/m$^2$ |
| | Polymer (P-57) | 0.16 g/m$^2$ |
| | Yellow coupler (Y-1) | 0.14 g/m$^2$ |
| | Yellow coupler (Y-2) | 0.18 g/m$^2$ |
| | Yellow coupler (Y-3) | 0.35 g/m$^2$ |
| | Dye image stabilizer (a) | 0.01 g/m$^2$ |
| | Solvent (S-13) | 0.15 g/m$^2$ |
| | Solvent (S-68) | 0.14 g/m$^2$ |
| Support | Polyethylene-laminated paper (PE contained 3 g of $TiO_2$ per m$^2$) | |

TABLE 2

| Sample No. | Emulsion for Red-sensitive Layer | Remarks |
|---|---|---|
| 1 | Em-1 | Comp. Ex. |
| 2 | Em-2 | Comp. Ex. |
| 3 | Em-3 | Comp. Ex. |
| 4 | Em-4 | Comp. Ex. |
| 5 | Em-5 | Invention |
| 6 | Em-6 | Invention |
| 7 | Em-7 | Comp. Ex. |
| 8 | Em-8 | Comp. Ex. |
| 9 | Em-9 | Invention |
| 10 | Em-10 | Invention |
| 11 | Em-11 | Comp. Ex. |
| 12 | Em-12 | Comp. Ex. |

(a)

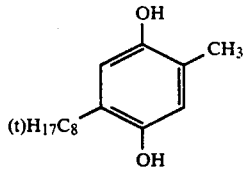

(b)

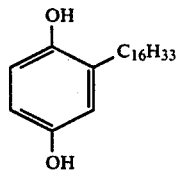

(c)

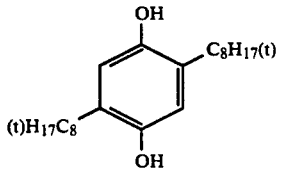

TABLE 2-continued (d)

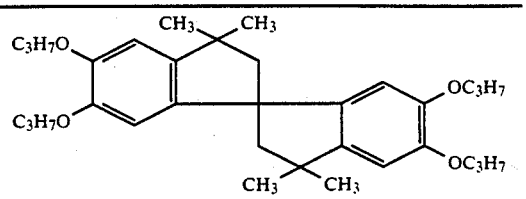

(e)

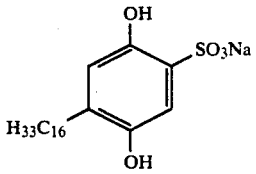

EXAMPLE 2

The procedure of Example 1 was repeated except that an emulsion Em-13 was used in place of the emulsion Em-5 in the sample 5 to prepare sample 13, the Em-13 being obtained by reducing the amount of the compound (V-36) used in Em-5 (sample 5) to the extent that the sensitivity of the sample 13, on printing, was 1/12 of the sensitivity of the blue-sensitive layer of the sample 5.

Similarly, sample 14 was prepared by using an emulsion Em-14 in place of Em-5, the emulsion Em-14 being obtained by increasing the amount of the compound (V-36) to the extent that the sensitivity of the sample 14, onprinting, was 1/2,5 of the sensitivity of the blue-sensitive layer of the sample 5.

The procedure of Example 1 was repeated except that an emulsion Em-15 was used in place of the emulsion Em-9 of sample 9 to prepare sample 15, the emulsion Em-15 being obtained by reducing the amount of the compound (V-41) used in Em-9 to the extent that the sensitivity of sample 15, on printing, was 1/16 of the sensitivity of the green-sensitive layer of the sample 5.

Similarly, sample 16 was prepared by using an emulsion Em-16 in place of Em-9, the emulsion Em-16 being obtained by increasing the amount of the said compound (V-41) used in Em-9 to the extent that the sensitivity of sample 16, on printing, was became ½ of the sensitivity of the blue-sensitive layer of the In the same way as in Example 1, prints were prepared from color negative film by using the samples 13 to 16 and the samples 1, 5 and 9. The color negative film, used to make the color prints was exposed by photographing together a bright yellow woolen ball, a magenta color corduroy cloth, and the red sweater used in Example 1.

The resulting color prints were organoleptically evaluated from the viewpoint of color gradation reproducibility. The results are shown in the following Table.

| Sample No. | Evaluation Result | Remarks |
|---|---|---|
| 1 | All of red, yellow and magenta were reproduced with high chroma, but shadow was difficultly visible and particularly red and yellow texture were poor in stereoscopic effect. | Comp. Ex. |
| 13 | All of red, yellow and magenta were reproduced with high chroma, shadow was slightly visible as compared with sample 1, and the | Invention |

-continued

| Sample No. | Evaluation Result | Remarks |
|---|---|---|
| | red and yellow texture were stereoscopically observed. | |
| 5 | All of red, yellow and magenta were reproduced with high chroma, shadow was clearly visible as compared with sample 1, and particularly red and yellow texture were stereoscopically observed. | Invention |
| 14 | Red and yellow were inferior in chroma, shadow was clearly visible and the sample provided the greatest stereoscopic effect. | Invention |
| 15 | All of red, yellow and magenta were reproduced with high chroma, shadow was slightly visible as compared with sample 1, and red and magenta texture were stereoscopically observed. | Invention |
| 9 | All of red, yellow and magenta were reproduced with high chroma, shadow was clearly visible as compared with sample 1, and particularly the red and magenta texture were stereoscopic. | Invention |
| 16 | Red and yellow were inferior in chroma, but shadow was clearly visible and the sample was superior in stereoscopic effect. | Invention |

It is clear from the above Table that the results of the present invention are affected by the setting of sensitivity in achieving the objects of the present invention. The setting of sensitivity can be carried out by varying an amount of the spectral sensitizing agents to be added.

When color reproducibility and color gradation reproducibility are judged on the whole, the samples 5 and 9 of the present invention were considered to be the best. The samples 13 and 15 of the present invention follow them and then the samples 14 and 16 were considered to be not quite as good as the samples 13 and 15. The comparative sample 1 was the most inferior one.

EXAMPLE 3

The procedure of Example 1 was repeated except that the compound (M-1) was used as the magenta coupler for the green-sensitive layer and the coating weight of the green-sensitive layer was 0.33 g/m$^2$ in terms of silver, to obtain samples 17 to 28. Comparative testing was conducted.

When the samples were compared with the samples (using the compounds (M-16) and (M-17)) of Example 1, similar results to those of Example 1 were obtained with respect to the improvement of the color gradation reproducibility according to the present invention. However, the chroma of the red color reproducibility was slightly lowered, and a small improvement in red color gradation reproducibility in particular was originally expected. With regard to color reproducibility, color gradation reproducibility, rapid processing and running processing, the samples 21 and 25 of the present invention were best considering all factors, and the samples 22 and 26 of the present invention were next best.

EXAMPLE 4

In Example 1, the exemplified compound (V-36) or (V-41) were used as the blue-sensitive sensitizing dye and green-sensitive sensitizing dye, respectively, added to the sensitive silver halide emulsion layer containing the cyan couplers. In this Example, experiments were made by using other exemplified compound (V-34), (V-43) or the like or the merocyanine sensitizing dye below having the formula (f), which was previously not exemplified. Similar results were obtained when the appropriate sensitivity was set by using those samples having a peak wavelength of spectral sensitivity in the range of 390 to 590 nm.

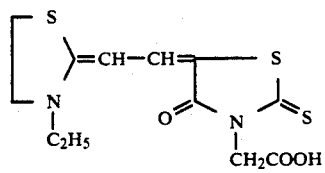

(f)

According to the present invention, a silver halide color photographic material is obtained which is rapidly processed and has excellent color reproducibility and color tone reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one blue-sensitive silver halide emulsion layer containing a yellow coupler, at least one green-sensitive silver halide emulsion layer containing a magenta coupler and at least one sensitive silver halide layer containing a cyan coupler, wherein the sensitive silver halide emulsion layer containing a cyan coupler comprises a silver chlorobromide or silver chlorobromoiodide emulsion having a silver chloride content of at least 80 mol % and a silver iodide content of no greater than 1 mol % and said sensitive silver halide emulsion is spectrally sensitized with a red-sensitive sensitizing dye and at least one or both of a blue-sensitive sensitizing dye and a green-sensitive sensitizing dye.

2. A silver halide color photographic material as in claim 1, wherein each of the silver halide emulsions constituting the blue-sensitive silver halide emulsion layer containing a yellow coupler, the green-sensitive silver halide emulsion layer containing magenta coupler and the sensitive silver halide emulsion layer containing a cyan coupler comprises a silver halide emulsion having a silver chloride content of at least 80 mol % and a silver bromide content of not greater than 20 mol %.

3. A silver halide color photographic material as in claim 1, wherein each of silver halide emulsions constituing the blue-sensitive silver halide emulsion layer containing a yellow coupler, the green-sensitive silver halide emulsion layer containing magenta coupler and the sensitive silver halide emulsion layer containing a cyan coupler comprises a silver halide emulsion having a silver chloride content of at least 95 mol % and a silver bromide content of not greater than 5 mol %.

4. A silver halide color photographic material as in claim 1, wherein the at least one or both of the blue light sensitivity and green light sensitivity of the sensitive silver halide emulsion layer containing a cyan coupler is from 1/12 to ⅓ that of each of the blue light sensitivity of the blue-sensitive silver halide emulsion layer containing a yellow coupler and the green light sensitivity of the green-sensitive silver halide emulsion layer containing a magenta coupler, respectively.

5. A silver halide color photographic material as in claim 2, wherein the at least one or both of the blue light sensitivity and green light sensitivity of the sensitive silver halide emulsion layer containing a cyan coupler is from 1/12 to ⅓ that of each of the blue light sensitivity of the blue-sensitive silver halide emulsion layer containing a yellow coupler and the green light sensitivity of the green-sensitive silver halide emulsion layer containing a magenta coupler, respectively.

6. A silver halide color photographic material as in claim 3, wherein the at least one or both of the blue light sensitivity and green light sensitivity of the sensitive silver halide emulsion layer containing a cyan coupler is from 1/12 to ⅓ that of each of the blue light sensitivity of the blue-sensitive silver halide emulsion layer containing a yellow coupler and the green light sensitivity of the green-sensitive silver halide emulsion layer containing a magenta coupler, respectively.

7. A silver halide color photographic material as in claim 1, wherein said magenta coupler is a pyrazoloazole coupler.

8. A silver halide color photographic material as in claim 2, wherein said magenta coupler is a pyrazoloazole coupler.

9. A silver halide color photographic material as in claim 3, wherein said magenta coupler is a pyrazoloazole coupler

10. A silver halide color photographic material as in claim 4, wherein said magenta coupler is a pyrazoloazole coupler.

11. A silver halide color photographic material as in claim 1, wherein the silver chlorobromide or silver chlorobromoiodide emulsion has a silver chloride content of from 95 to 99.9 mol %.

12. A silver halide color photographic material as in claim 1, wherein the silver chlorobromide or silver chlorobromoiodide emulsion has a silver chloride content of from 98 to 99.9 mol %.

13. A silver halide color photographic material as in claim 1, wherein the silver chlorobromide or silver chlorobromoiodide emulsion has a silver chloride content of from 99 to 99.9 mol %.

14. A silver halide color photographic material as in claim 1, wherein the sensitive silver halide emulsion containing a cyan coupler comprises silver halide grains having a silver bromide-localized phase containing from 10 to 95 mol % silver bromide.

15. A silver halide color photographic material as in claim 1, wherein the sensitive silver halide emulsion containing a cyan coupler comprises silver halide grains having a silver bromide-localized phase containing from 20 to 60 mol % silver bromide.

16. A silver halide color photographic material as in claim 1, wherein the sensitive silver halide emulsion containing a cyan coupler comprises silver halide grains having a silver bromide-localized phase containing from 30 to 60 mol % silver bromide.

17. A silver halide color photographic material as in claim 1, wherein the silver halide in a photosensitives layer containing cyan coupler contains at least one metal ion selected from the group consisting of metal ion in Group VIII of the Periodic Table, transition metal ion in Group II, Pb ion, Au ion and Cu ion.

18. A silver halide color photographic material as in claim 1, wherein the silver halide in a photosensitives layer containing cyan coupler contains at least one metal ion selected from the group consisting of Ir ion, Pd ion, Rh ion, Zn ion, Fe ion, Pt ion, Au ion and Cu ion.

19. A silver halide color photographic material as in claim 17, wherein the metal ion is added prior to completion of physical repening.

20. A silver halide color photographic material as in claim 14, the silver bromide-localized phase contains Ir ion and/or Rd ion.

21. A silver halide color photographic material as in claim 1, wherein a blue light sensitivity or green light sensitivity of the red-sensitive silver halide emulsion layer containing a cyan coupler has a sensitivity as printed from a color negative film of 1/16 to ½ that of blue light sensitivity of the blue-sensitive silver halide emulsion layer containing a yellow coupler or green light sensitivity of the green-sensitive silver halide emulsion layer containg a magenta coupler, respectively.

22. A silver halide color photographic material as in claim 14, wherein the silver bromide-localized phase constitutes from 0.03 to 35 mol % of the silver halide content of the sensitive silver halide emulsion containing a cyan coupler.

23. A silver halide color photographic material as in claim 14, wherein the silver bromide-localized phase contains an iridium compound.

24. A silver halide color photographic material as in claim 1, wherein the sensitive silver halide emulsion layer containing a cyan coupler is spectrally sensitized with a red-sensitive sensitizing dye and, in addition a green-sensitive sensitizing dye and/or a blue-sensitive sensitizing dye.

25. A silver halide color photographic material as in claim 1, wherein the sensitizing dye used for spectraly sensitizing silver halide emulsion layer is at least one selected from the group consisting of cyanine dye, merocyanine dye, complex merocyanine dye, complex cyanine dye, holopolar-cyanine dye, hemi-cyanine dye, styril dye and hemi-oxanol dye.

26. A silver halide color photographic material as in claim 25, wherein the sensitizing dye is a cyanine dye represented by formula (I):

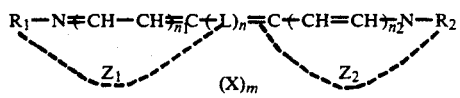

(I)

wherein L represents a methine group of a substituted methine group; $R_1$ and $R_2$ each represent and alkyl group or a substituted alkyl group; $Z_1$ and $Z_2$ each represent an atomic group which forms a nitrogen-containing 5-membered or 6-membered heterocyclic nucleus; X represents an anion; n represents 1,3 or 5; $n_1$ and $n_2$ each represent 0 or 1, with the proviso that when n=5, $n_1$ and $n_2$ are each 0 and when n=3, one of $n_1$ and $n_2$ is 0; m represents 0 or 1 with the proviso that when an inner salt is formed, m is 0; and when n is 5, the L groups may be combined together to form a substituted or unsubstituted 5-membered or 6-membered ring.

27. A silver halide color photographic material as in claim 26, wherein the sensitizing dye contains benzthiazole nuclei or benzoxazole nuclei.

28. A silver halide color photographic material as in claim 24, wherein the blue-sensitive sensitizing dye is a simple cyanine dye having benzthiazole nuclei, the green-sensitive sensitizing dye is a carbocyanine dye having benzoxazole nuclei, and the red-sensitive sensitizing dye is a dicarbocyanine dye having benzthiazole nuclei.

29. A silver halide color photographic material as in claim 25, wherein the sensitizing dye is added in an amount of $1\times10^{-6}$ mol to $1\times10^{-2}$ mol per mol of silver halide.

* * * * *